US007784420B2

(12) United States Patent
Tufte

(10) Patent No.: US 7,784,420 B2
(45) **Date of Patent: *Aug. 31, 2010**

(54) COVER SYSTEM FOR A BOAT

(76) Inventor: Brian N. Tufte, 19043 Vogel Farm Trail, Eden Prairie, MN (US) 55347

( * ) Notice: Subject to any disclaimer, the term of this patent is extended or adjusted under 35 U.S.C. 154(b) by 256 days.

This patent is subject to a terminal disclaimer.

(21) Appl. No.: 12/037,778

(22) Filed: Feb. 26, 2008

(65) Prior Publication Data

US 2008/0141926 A1 Jun. 19, 2008

Related U.S. Application Data

(63) Continuation-in-part of application No. 11/275,621, filed on Jan. 19, 2006, now Pat. No. 7,373,897, which is a continuation-in-part of application No. 10/905,818, filed on Jan. 21, 2005, now Pat. No. 7,520,240.

(51) Int. Cl.
*B63B 17/00* (2006.01)

(52) U.S. Cl. ..... 114/361

(58) Field of Classification Search ..... 114/361
See application file for complete search history.

(56) References Cited

U.S. PATENT DOCUMENTS

| | | | |
|---|---|---|---|
| 245,651 | A | 8/1881 | Meech |
| 600,272 | A | 3/1898 | Seymour |
| 739,389 | A | 9/1903 | Castle |
| 869,399 | A | 10/1907 | Walter |
| 1,663,347 | A | 3/1928 | Miller |
| 2,280,729 | A | 4/1942 | Sutton |
| 2,493,833 | A | 1/1950 | Reynolds |
| 2,570,911 | A | 10/1951 | Birdlebough |
| 2,821,989 | A | 2/1958 | Shepard |
| 2,947,277 | A | 8/1960 | Stevens |
| 3,021,535 | A | 2/1962 | Dorst |
| 3,083,540 | A | 4/1963 | Smith |
| 3,160,436 | A | 12/1964 | Duddleston |
| 3,165,111 | A | 1/1965 | Foster |
| 3,165,762 | A | 1/1965 | Hage |
| 3,179,959 | A | 4/1965 | McDougall |
| 3,195,459 | A | 7/1965 | Stevens |

(Continued)

FOREIGN PATENT DOCUMENTS

DE 29508245 8/1995

(Continued)

OTHER PUBLICATIONS

"PWR-ARM Hydraulic Bimini Top, Your Bimini At the Push of a Button," Brochure, 2 pages, downloaded Jan. 19, 2009.

(Continued)

*Primary Examiner*—Stephen Avila
(74) *Attorney, Agent, or Firm*—Brian N. Tufte

(57) ABSTRACT

A cover system for a boat that can be articulated between a lowered covering position, to provide some level of protection to the interior of the boat when the boat is not in use, and one or more other positions. The one or more other positions may include, for example, a raised covering position, a raised retracted position, a lowered retracted position, and/or any other suitable position, as desired.

35 Claims, 61 Drawing Sheets

U.S. PATENT DOCUMENTS

| | | | | |
|---|---|---|---|---|
| 3,290,706 | A | 12/1966 | Hale | |
| 3,304,657 | A | 2/1967 | Singleton | |
| 3,312,990 | A | 4/1967 | Lapworth | |
| 3,320,698 | A | 5/1967 | Hummel | |
| 3,336,612 | A | 8/1967 | Stevens | |
| 3,370,308 | A | 2/1968 | Krenzler | |
| 3,371,672 | A | 3/1968 | Hale et al. | |
| 3,434,166 | A | 3/1969 | Clymer | |
| 3,572,353 | A | 3/1971 | Pinkley | |
| 3,773,379 | A | 11/1973 | Loiseau | |
| 3,805,724 | A | 4/1974 | Butler | |
| 3,857,601 | A | 12/1974 | Robbins | |
| 3,942,830 | A | 3/1976 | Woodard | |
| 3,955,228 | A | 5/1976 | Gaschenko et al. | |
| 4,019,212 | A | 4/1977 | Downer | |
| 4,082,347 | A | 4/1978 | Petretti | |
| 4,091,484 | A * | 5/1978 | Means | 114/361 |
| 4,223,414 | A | 9/1980 | Dickson | |
| 4,425,861 | A | 1/1984 | Raikamo | |
| 4,582,016 | A | 4/1986 | Hansen | |
| 4,641,600 | A | 2/1987 | Halvorsen | |
| 4,659,136 | A | 4/1987 | Martin et al. | |
| 4,685,411 | A | 8/1987 | Wick | |
| 4,715,312 | A | 12/1987 | Bouvart | |
| 4,828,317 | A | 5/1989 | Muscat | |
| 4,926,782 | A | 5/1990 | Lacy | |
| 4,979,456 | A | 12/1990 | Steward | |
| 5,009,184 | A | 4/1991 | Voldrich | |
| 5,016,558 | A | 5/1991 | Oehler | |
| 5,044,298 | A | 9/1991 | Pepper et al. | |
| 5,058,946 | A | 10/1991 | Faber | |
| 5,088,438 | A | 2/1992 | Richardson, Jr. et al. | |
| 5,303,667 | A | 4/1994 | Zirkelbach et al. | |
| 5,479,872 | A | 1/1996 | Hulett | |
| 5,520,139 | A | 5/1996 | King et al. | |
| 5,706,752 | A | 1/1998 | Menne, Jr. et al. | |
| 5,769,105 | A | 6/1998 | Margol et al. | |
| 5,803,104 | A | 9/1998 | Pollen | |
| 5,850,799 | A | 12/1998 | Geisel et al. | |
| 5,860,440 | A | 1/1999 | Murray et al. | |
| 5,894,812 | A | 4/1999 | Dessingue | |
| 5,901,657 | A | 5/1999 | Schwartz | |
| 5,909,921 | A | 6/1999 | Nesbeth | |
| 5,983,824 | A | 11/1999 | Hernandez | |
| 6,006,692 | A | 12/1999 | Szukhent, Jr. | |
| 6,102,059 | A | 8/2000 | Miller | |
| 6,158,377 | A | 12/2000 | Szukhent, Jr. | |
| 6,209,477 | B1 | 4/2001 | Boedenweg | |
| 6,260,505 | B1 | 7/2001 | Polidan | |
| 6,349,666 | B1 | 2/2002 | Hastings | |
| 6,357,379 | B1 | 3/2002 | Murphy, Jr. | |
| 6,439,150 | B1 | 8/2002 | Murphy et al. | |
| 6,443,090 | B1 | 9/2002 | Giffin et al. | |
| 6,447,038 | B1 | 9/2002 | Davis et al. | |
| 6,588,361 | B2 | 7/2003 | Biedenweg | |
| 6,637,364 | B1 * | 10/2003 | Campeau | 114/361 |
| 6,659,035 | B2 | 12/2003 | Treytiak | |
| 6,666,163 | B2 | 12/2003 | Pastor et al. | |
| 6,672,241 | B2 | 1/2004 | Warfel et al. | |
| 6,688,252 | B1 | 2/2004 | Caravella | |
| 6,786,171 | B1 | 9/2004 | Elbers | |
| 6,799,529 | B1 | 10/2004 | Willis | |
| 6,820,569 | B2 | 11/2004 | Warfel et al. | |
| 6,946,248 | B2 | 9/2005 | Sowers et al. | |
| 6,983,716 | B1 | 1/2006 | Ankney et al. | |
| 7,051,669 | B2 | 5/2006 | Warfel et al. | |
| 7,093,558 | B1 | 8/2006 | Mandanici | |
| 7,159,131 | B2 | 1/2007 | Park | |
| 7,216,604 | B2 | 5/2007 | Finney et al. | |
| 7,249,568 | B1 | 7/2007 | Cultrara | |
| 7,270,075 | B1 | 9/2007 | Jones | |
| 7,370,597 | B1 | 5/2008 | Schwindaman | |
| 7,389,737 | B1 | 6/2008 | Schwindaman | |
| 7,412,940 | B2 | 8/2008 | Kemmer et al. | |
| 7,438,015 | B1 | 10/2008 | Schwindaman | |
| 7,484,472 | B1 | 2/2009 | Highfield | |
| 7,520,240 | B2 * | 4/2009 | Tufte, Brian N. | 114/361 |
| 2003/0127037 | A1 | 7/2003 | Himmel | |
| 2003/0217683 | A1 | 11/2003 | Heckman | |
| 2004/0070516 | A1 | 4/2004 | Nielsen | |
| 2006/0231010 | A1 | 10/2006 | Baylor | |
| 2008/0011217 | A1 | 1/2008 | Russikoff | |

FOREIGN PATENT DOCUMENTS

| | | |
|---|---|---|
| GB | 2275450 | 8/1994 |
| GB | 2392881 | 3/2004 |
| JP | 362031515 | 2/1987 |
| WO | 9406676 | 3/1994 |

OTHER PUBLICATIONS

FLOE, "Aluminum PWC, Boat & Pontoon Lift Systems," FLOE International, Inc., 12 pages, 2005.

Sea-Legs, "The Pontoon Lift That Goes Where You Go," 4 pages, 2005.

http://www.custompontoonboatkitsetc.com, "Custom Pontoon Boat Kits etc." 7 pages, printed Feb. 1, 2005.

http://www.hilltopboat.com, "Boat Covers—Pontoon—0279-1551 Pontoon w Fold Down Hard Top 14'6" × a02", 2 pages, printed Feb. 1, 2005.

http://www.taylormarine.com/press_releases/pressarchive.php, Capabilities—Archived Press Releases, Taylor Made Systems, Taylor Made Systems unveils Power Convertible Top, 2 pages, printed Mar. 3, 2006.

http://www.taylormarine.com/press_releases/pressarchive.php, Capabilities—Archived Press Releases, Taylor Made Systems, Taylor Made Power Power Convertible Top Featured At IBEX, 2 pages, printed Mar. 3, 3006.

* cited by examiner

COVER SYSTEM FOR A BOAT

This application is a continuation-in-part of U.S. patent application Ser. No. 11/275,621, filed Jan. 19, 2006, now U.S. Pat. No. 7,373,897, and entitled "Cover System for a Boat", which is a continuation-in-part of U.S. patent application Ser. No. 10/905,818, filed Jan. 21, 2005, now U.S. Pat. No. 7,520,240 and entitled "Cover System for a Boat".

FIELD

The present invention generally relates to boats, and more particularly, to cover systems for boats.

BACKGROUND

Many forms of boat covers are known, some of which are simple, make-shift canvas or the like covers sometimes of the button-on, button-off type. Such boat covers are typically manually installed by the user of the boat, and provide some level of protection to the interior of the boat while the boat is not in use.

When in use, some boats include a sun shade cover, often called a bimini top or the like, that provides some level of protection to the occupants of the boat from the sun. In many cases, a fabric cover is mounted on a tubular aluminum framework, which can be either fixed on the boat for convertible movement and/or pivoted between a shade providing position and a folded non-shade providing position. In the shade providing position, the sun shade cover is often suspended above the interior of the boat with open sides so that the occupants can move about and interior of the boat and see laterally out of the sides of the boat. In the folded non-shade providing position, the fabric cover is typically collapsed and wrapped around the tubular aluminum framework, and the entire structure is pivoted out of the way to one side of the boat, typically towards the rear or front of the boat.

What would be desirable is a boat cover that can provide some level of protection to the interior of the boat when the boat is not in use, and can also provide some level of protection to the occupants of the boat from the sun and/or other elements when the boat is in use and/or be moved away when protection from the sun and/or other elements is not desired.

SUMMARY

The present invention relates to a cover system for a boat that may be articulated between a lowered covering position to provide some level of protection to the interior of the boat when the boat is not in use, and one or more other position. The one or more other position may include, for example, a raised covering position, a raised retracted position, a lowered retracted position, and/or any other suitable position, as desired.

BRIEF DESCRIPTION OF THE DRAWINGS

Other objects of the present invention and many of the attendant advantages of the present invention will be readily appreciated as the same becomes better understood by reference to the following detailed description when considered in connection with the accompanying drawings, in which like reference numerals designate like parts throughout the figures thereof and wherein.

DESCRIPTION

Figure 1:
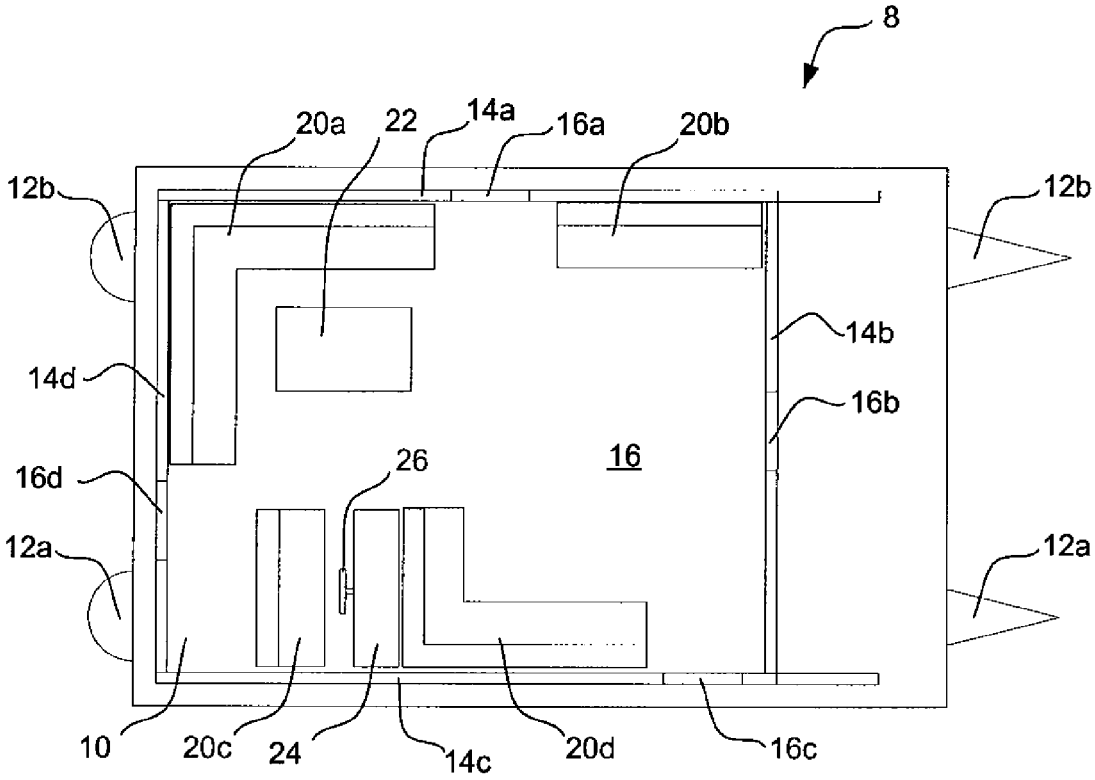
FIG. 1 is a schematic top view of an illustrative pontoon boat.

The following description should be read with reference to the drawings wherein like reference numerals indicate like elements throughout the several views. The detailed description and drawings show several illustrative embodiments which are meant to be illustrative of the present invention.

For illustration purposes, a pontoon boat is used as an example in many of the Figures and examples provided below. It is contemplated, however, that the present invention may be used in conjunction with any type of boat including recreational speed type boats, fishing boats of all sizes, cruisers, and/or any other type of boat, as desired.

FIG. 1 is a schematic top view of an illustrative pontoon boat. The illustrative pontoon boat is generally shown at 8, and includes a platform 10 that is positioned above and attached to two (or more) spaced pontoon floats 12*a* and 12*b*. The spaced pontoon floats 12*a* and 12*b* provide floatation for the pontoon boat 8.

One or more side walls, such as side walls 14*a*-14*d*, may extend up from the platform 10 around a perimeter of a protected area 16. In the illustrative embodiment, the protected area 16 is defined by the side walls 14*a*-14*d*. In some cases, some or all of the side walls 14*a*-14*d* may include a door, such as doors 16*a*-16*d*. The doors 16*a*-16*d* may help provide access to/from the protected area 16 of the pontoon boat 8.

One or more seats, tables, sinks, bathrooms, control consoles, wet bars or the like may be provide in the protected area. In the illustrative embodiment, seats 20*a*-20*d*, a table 22 and a control console 24 including a steering wheel 26 are provided in the protected area 16. These, however, are only illustrative. The protected area may also be carpeted in some cases.

In many cases, it is desirable to cover the protected area to help prevent sun, rain, debris and/or other elements or objects from entering the protected area of the pontoon boat 8 when the pontoon boat 8 is not in use. If the protected area is not covered, the sun may cause the seats 20*a*-20*d*, table 22, control console 24 and carpet to deteriorate faster. Also, rain may cause the seats 20*a*-20*d* and other objects in the protected area 16 to become wet, which may be uncomfortable to the users of the boat when the boat is eventually used. Dust, dirt, debris, seedlings and other objects may also enter the protected area 16, which may require extensive cleaning by the boat user prior to its use.

As such, it is often desirable to cover the protected area when the boat is not in use. Currently, this is typically done by manually fitting a tarp or the like over the protected area and securing the edges of the tarp to the side walls. One or more support poles are sometimes manually positioned between the platform 10 and the middle of the tarp to help prevent sagging of the tarp, which if not addressed, can collect water. The process of manually fitting the tarp over the protected area after each boat use, and removing and storing the tarp prior to each boat use, can be a fairly laborious and tedious task. This sometimes causes the boat user to not use the pontoon boat 18 as much as he/she would like, particularly for shorter excursions or outings.

Figure 2A:
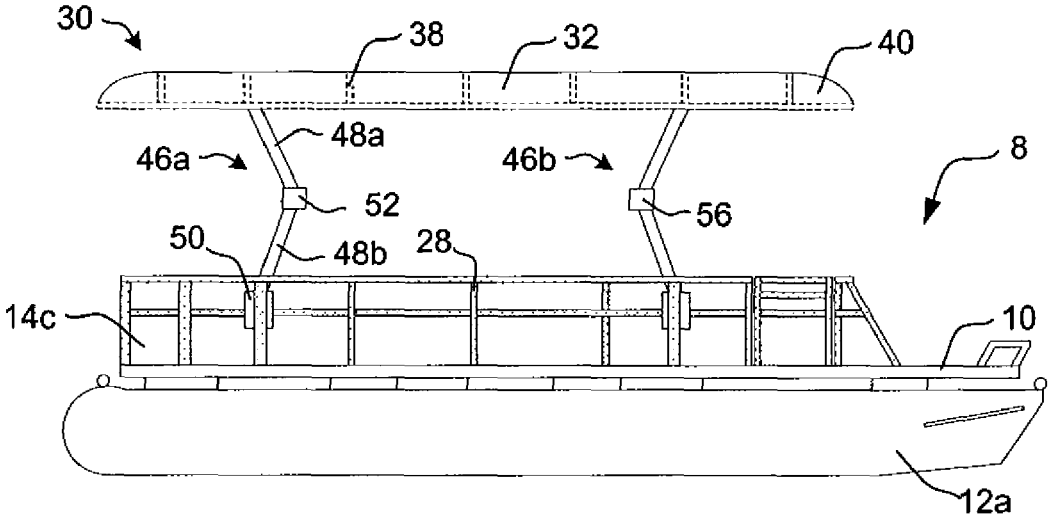
FIG. 2A is a schematic side view of a pontoon boat, with a cover assembly in a raised position.
Figure 2B:
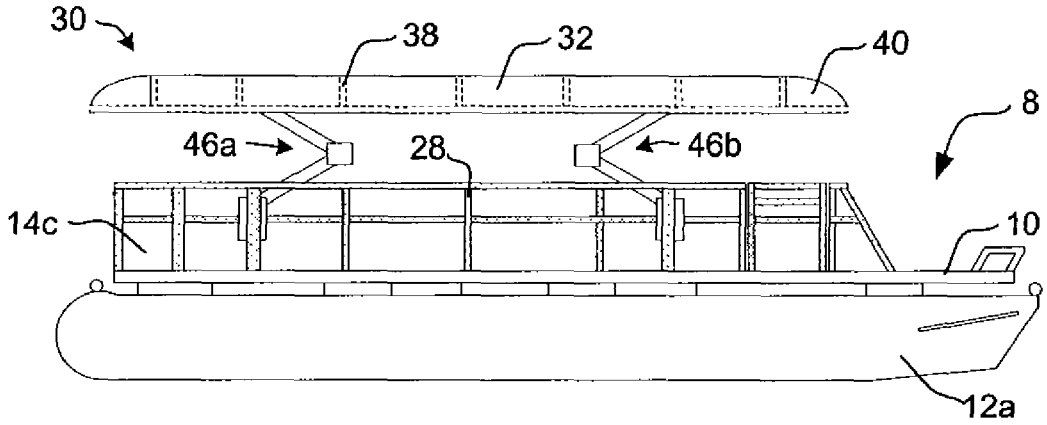
FIG. 2B is a schematic side view of the pontoon boat of FIG. 2A, with the cover assembly in an intermediate position.
Figure 2C:
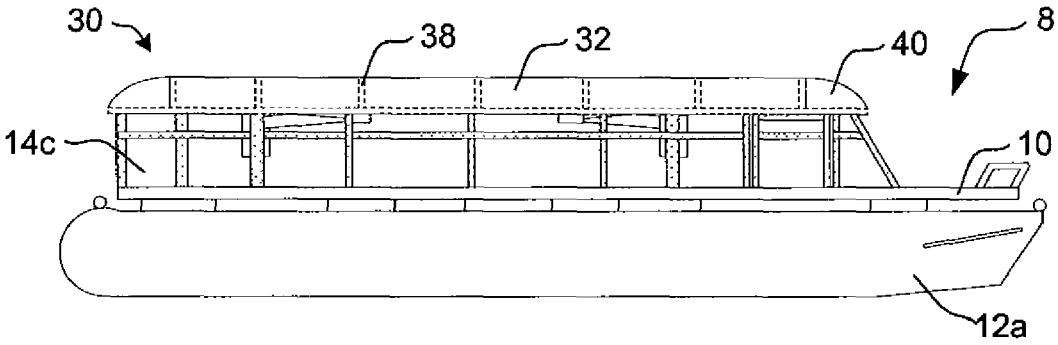
FIG. 2C is a schematic side view of the pontoon boat of FIG. 2A, with the cover assembly in a lowered position.

FIG. 2A-2C are schematic side view drawings of the pontoon boat 8 of FIG. 1, fitted with a boat cover system 30 in accordance with one illustrative embodiment of the present invention. In the illustrative embodiment, the side walls 14*a*-14*d* extend up from the platform and include one or more support members, such as support member 28. In some cases, one or more panels may be fixed to the support members to provide a wall like structure around the perimeter of the protected area 16. The one or more panels may help prevent sun, rain, and debris from entering the protected area through the side walls 14*a*-14*d*. Side walls with such panels may be used in conjunction with the various illustrative embodiments described herein, as desired.

The illustrative boat cover system 30 may include a cover assembly 32 that can be moved between a raised position (see FIG. 2A) and a lowered position (see FIG. 2C). In the illustrative embodiment, the cover assembly 32 includes a support frame 38 and a cover 40, wherein the support frame 38 supports the cover 40. Also, four cover supports may be provided for supporting the cover assembly 32 above the platform 10. Only the starboard side cover supports 46*a* and 46*b* are shown in FIGS. 2A-2C. In some cases, the cover 40 may be a flexible material such as canvas, flexible plastic, or any other suitable flexible material. In other cases, the cover 40 may be a rigid material, such as fiberglass, metal or any other suitable rigid material. When the cover 40 is a rigid material, the support frame 38 may not need to be as extensive as when a flexible material is used, and in some cases, the support frame 28 may not be provided at all.

In the raised position, the cover assembly 30 provides some level of protection to the occupants of the pontoon boat 8 from sun, rain and/or other elements when the boat is in use. The cover assembly 30 may be positioned sufficiently far above the platform 10 so that people can walk under the cover assembly 30 without bending over. In the lowered position (see FIG. 2C), the cover assembly 32 may provide protection to the interior of the pontoon boat 8 in the protected area 16.

In some embodiments, the cover supports 46*a* and 46*b* may be adapted to allow the cover assembly 30 to be moved between the raised position (see FIG. 2A) and the lowered position (see FIG. 2C). In the illustrative embodiment, each cover support includes an upper leg and a lower leg. For example, cover support 46*a* includes an upper leg 48*a* and a lower leg 48*b*. In one illustrative embodiment, the lower end of the lower leg 48*b* may be pivotally connected to the side wall (or platform) as shown at 50, the upper end of the lower leg 48*b* may be pivotally connected to the lower end of the upper leg 48*a* as shown at 52, and the upper end of the upper leg 48*a* may be pivotally connected to the cover assembly 30. In the illustrative embodiment, when the cover assembly 30 is lowered, the pivotal connection 52 between the lower leg 48*b* and the upper leg 48*a* of the cover support 46*a* moves toward the bow, and the pivotal connection 56 between the lower leg and the upper leg of the cover support 46*b* moves toward the stern (i.e. in opposite directions), however, this is not required in all embodiments.

In some cases, a bias may be applied via the cover supports 46*a* and 46*b* that biases the cover assembly 30 against gravity. The bias may be provided by one or more springs, rubber straps, compressed cylinders, or any other suitable bias providing element(s). The bias may make it easier to move the cover assembly 30 between the lowered position and the raised position, if desired. A bias may be provided, but it is not required.

In some cases, the cover assembly 30 can be moved between the lowered position and the raised position under human power. A crank, a wench, or simply pushing and/or pulling the cover assembly 30, and/or any other suitable human powered moving mechanism or method may be employed. In other cases, the cover assembly 30 can be moved between the lowered position and the raised position using a powered system, such as a motor or pump. When a motor or pump is used, and in the illustrative embodiment, motion and/or energy from the motor or pump may be transferred to rotate the lower legs of the cover supports 46*a* and 46*b* in opposite directions to move the cover assembly 30 between the lowered and raised positions. Any number of methods may be used to transfer the motion and/or energy from the motor or pump to the lower legs of the cover supports 46*a* and 46*b* including via one or more belts, cables, screw drives, shafts, tracks, hydraulic cylinders, hydraulic tubes, pulleys, gears, and/or any other suitable system or method, as desired.

FIG. 2A is a schematic side view of the pontoon boat 8, with the cover assembly 30 in the raised position. FIG. 2B is a schematic side view of the pontoon boat 8, with the cover assembly 30 in an intermediate position, and FIG. 2C is a schematic side view of the pontoon boat 8, with the cover assembly 30 in the lowered position.

In some embodiments, and in the lowered position, a perimeter of the cover assembly 30 may extend laterally out to at least the side walls 14*a*-14*d* of the pontoon boat 8 (see FIG. 3) to provide a cover for all or substantially all of the protected area 16. In some cases, the perimeter of the cover assembly 30 may extend laterally out past the side walls 14*a*-14*d* of the pontoon boat 8, and in some cases, overlaps in a downward vertical direction over a top portion of the side walls 14*a*-14*d* (see FIG. 2C and FIG. 4), but this is not required in all embodiments. Such a vertical overlap may, in some cases, provide better protection to the protected area 16 of the pontoon boat 8 from wind swept rain, blowing dirt, dust, debris, etc.

Figure 3:
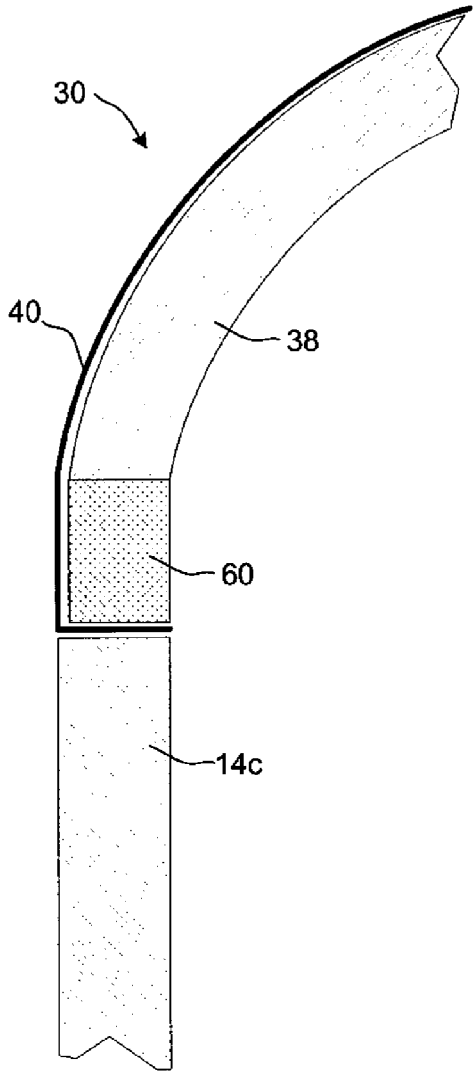
FIG. 3 is a schematic cross-sectional side view of a cover system that extends to the side wall of a boat.

FIG. 3 is a schematic cross-sectional exploded side view of a cover system 30 that extends to the side walls (e.g. side wall 14*c*) of a pontoon boat 8. As can be seen, the illustrative cover system 30 includes a support frame 38 and a cover 40, wherein the support frame 38 supports the cover 40. In this illustrative embodiment shown in FIG. 3, the cover system 30 is sized such that the perimeter of the cover system 30 extends and is roughly aligned with the side walls (e.g. side wall 14*c*) of the pontoon boat 8. In some cases, the support frame 38 includes a lower support member 60 that extends around the perimeter of the support frame 38, and rests on the top of the side walls (e.g. side wall 14*c*) when the cover assembly 30 is in the lowered position. In this configuration, rain or the like falling on the cover system 30 tends to run off the cover system 30 and down the outside of the side walls 14*c*, thereby providing protection to the protected area 16 of the pontoon boat 8.

Figure 4:
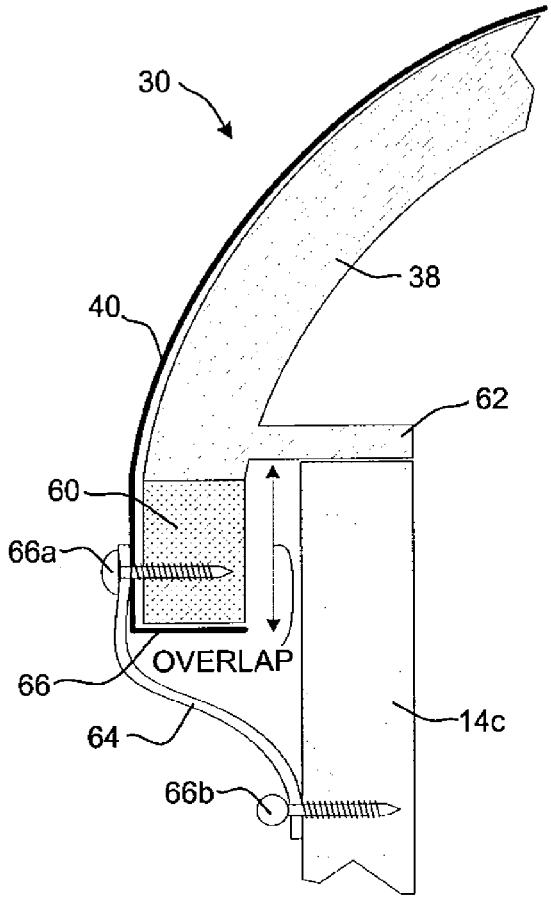
FIG. 4 is a schematic cross-sectional side view of a cover system that extends out laterally past the side walls of a boat, and overlaps the side wall in a vertical direction.

FIG. 4 is a schematic cross-sectional exploded side view of a cover system 30 that extends out laterally past the side walls (e.g. side wall 14*c*) of the pontoon boat 8, and overlaps the top of the side wall 14*c* in a vertical direction as shown. In some embodiments, the support frame 38 may include one or more resting supports 62 that are elevated above the lower edge 66 of the support frame 38 and extend inward from the perimeter of the support frame 38. These resting supports 62 may rest on the top of the side walls (e.g. side wall 14*c*) to support the cover assembly 30 when the cover assembly 30 is in the lowered position. Such a vertical overlap may, in some cases, provide better protection to the protected area 16 of the pontoon boat 8 from wind swept rain, blowing dirt, dust, debris, etc.

FIG. 4 also shows a safety strap 64 that may be selectively attached between the support frame 38 and the side wall (e.g. side wall 14*c*). The safety strap 64 may help ensure that the cover assembly 30 does not significantly rise up from the lowered position during high wind or other conditions. The safety strap 64 may be particularly useful when, for example, the pontoon boat 8 is being transported by trailer, where high wind conditions are expected. Also, safety strap 64 may provide a measure of safety during storms or the like. In some embodiments, multiple safety straps may be provided around the perimeter of the cover assembly 30 to help keep the cover assembly 30 in the lowered position. While a safety strap 64 is only shown in FIG. 4, it is contemplated that a safety strap may also be used in conjunction with the illustrative embodiment shown in FIG. 3, as well as other embodiments, as desired. Also, rather than a safety strap 64, a latch or the like may be used. While a safety strap 64 is shown in FIG. 4, it is contemplated that any suitable mechanism may be used to help secure the cover assembly 30 relative to the side walls (e.g. side wall 14*c*), as desired.

Figure 5A:
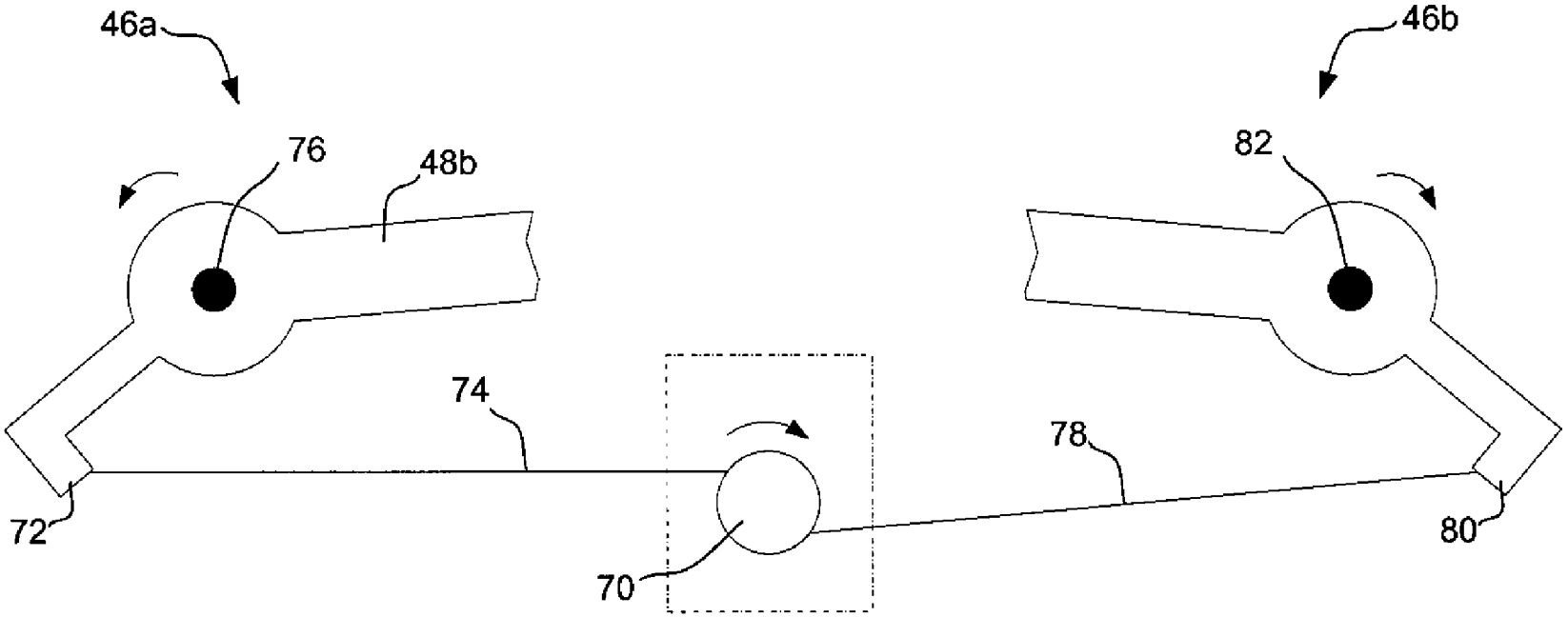
FIG. 5A is a schematic side view of one illustrative drive mechanism for the cover assembly of FIG. 2A-2C, with the cover system in the lowered position.

FIG. 5A is a schematic side view of one illustrative drive mechanism for the cover assembly 30 of FIG. 2A-2C, with the cover system 30 in the lowered position. The illustrative drive mechanism includes a rotating shaft 70 that is driven by a motor or the like. A first cable 74 is attached to a lower connecting arm 72 of the lower arm 48*b* of the cover support 46*a* (see FIG. 2A), and is wrapped around the rotating shaft 70 in a first direction. The lower arm 48*b* of the cover support 46*a* pivots about a pivot point 76, as shown. Likewise, a second cable 78 is attached to a lower connecting arm 80 of the lower arm of the cover support 46*b* (see FIG. 2A), and is wrapped around the rotating shaft 70 in a second direction, as shown. The lower arm of the cover support 46*b* pivots about a pivot point 82, as shown.

Figure 5B:
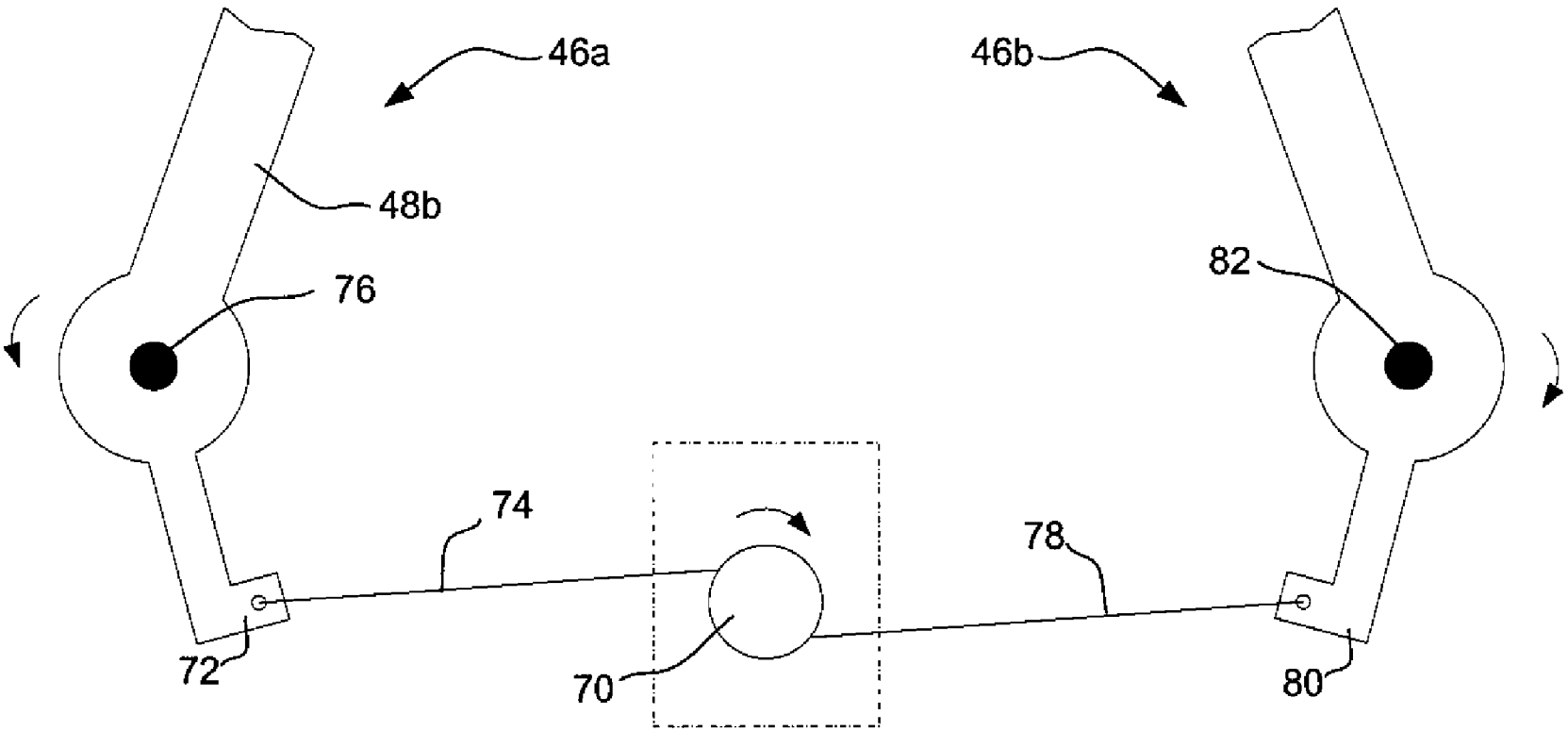
FIG. 5B is a schematic side view of the illustrative drive mechanism of FIG. 5A, with the cover system in the raised position.

To raise the cover assembly 30 of FIG. 2C, the rotating shaft 70 is rotated in a clockwise direction, as shown in FIG. 5B. With reference to FIG. 5B, such rotation causes the rotating shaft 70 to wind up and shorten the first cable 74 and the second cable 78, which pulls the lower connecting arm 72 and the lower connecting arm 80 toward each other. This causes the lower arm 48*b* of the cover support 46*a* to rotate in a counter-clockwise direction about the pivot point 76, and the lower arm of the cover support 46*b* to rotate in a clock-wise direction about the pivot point 82. This, in turn, causes the cover assembly 30 to move from the lowered position to the raised position, as best shown in FIGS. 2A-2C. To move the cover assembly 30 from the raised position to the lowered, the rotating shaft 70 is rotated in the opposite direction.

In some cases, a bias may be applied to bias the cover assembly 30 against gravity. The bias may be provided by one or more springs, rubber straps, compressed cylinders, or any other suitable bias providing element(s). The bias may make it easier to move the cover assembly 30 between the lowered position and the raised position, if desired. Providing such a bias may help reduce the power and cost of the components used to move the cover assembly 30 between the lowered position and the raised position. For example, the size, power and cost of any motor (not shown) that is used to drive the rotating shaft 70 of FIG. 5A may be reduced if a bias is applied to at least partially bias the cover assembly 30 against gravity.

Figure 6A:
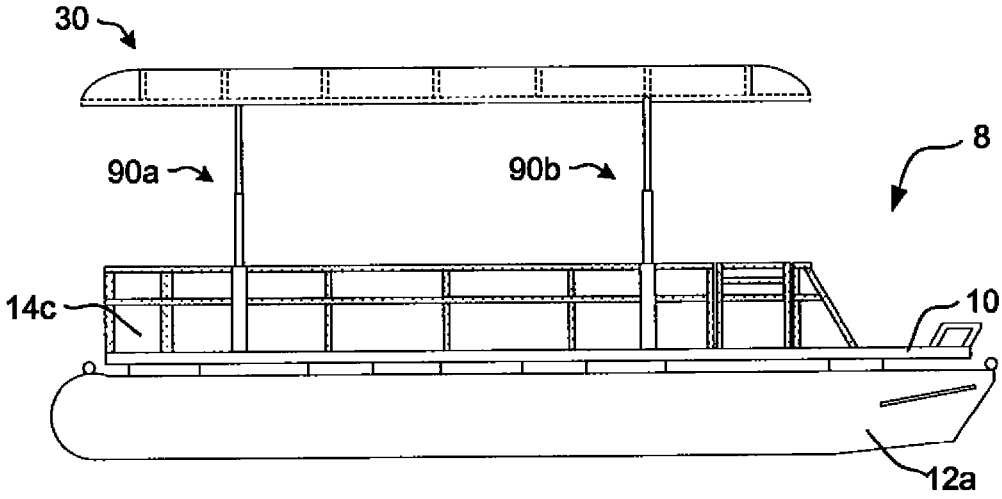
FIG. 6A is a schematic side view of another illustrative pontoon boat, with a cover assembly in a raised position.
Figure 6B:
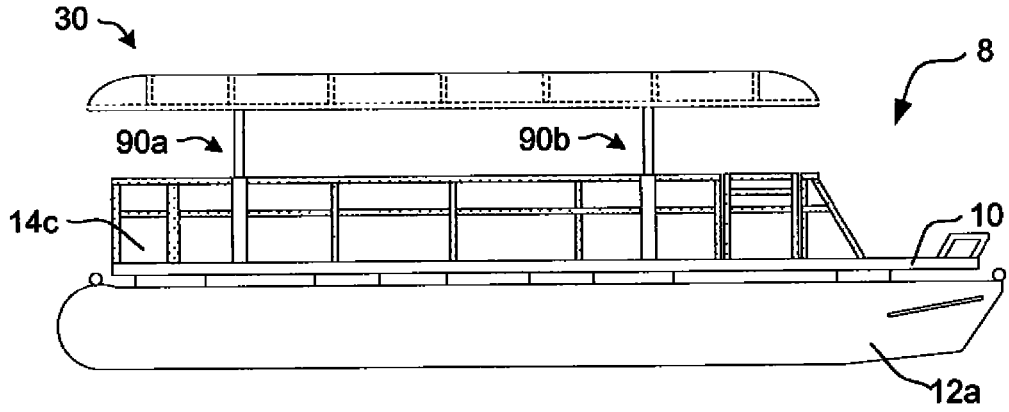
FIG. 6B is a schematic side view of the pontoon boat of FIG. 6A, with the cover assembly in an intermediate position.
Figure 6C:
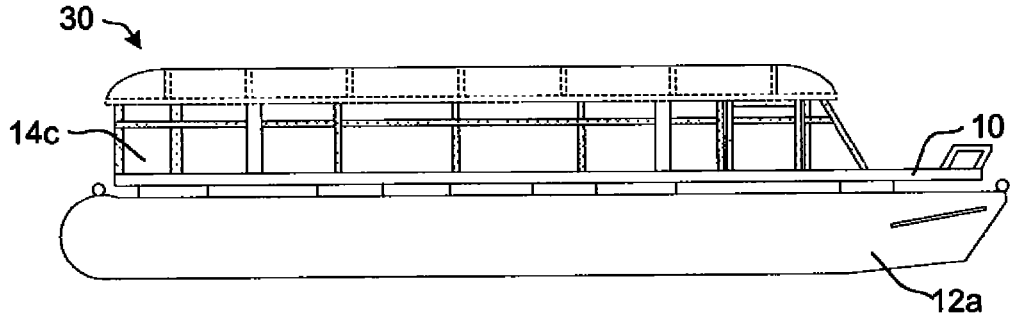
FIG. 6C is a schematic side view of the pontoon boat of FIG. 6A, with the cover assembly in a lowered position.

FIG. 6A is a schematic side view of the illustrative pontoon boat 8 of FIG. 1, with a cover assembly 30 in a raised position. FIG. 6B is a schematic side view of the pontoon boat of FIG. 6A, with the cover assembly in an intermediate position, and FIG. 6C is a schematic side view of the pontoon boat of FIG. 6A, with the cover assembly in a lowered position. In this illustrative embodiment, the cover assembly 30 is supported above the platform by one or more telescoping support members. In the illustrative embodiment, four telescoping support members 90*a* and 90*b* are used, with only the telescoping support members on the starboard side shown. However, more or less telescoping members may be used, as desired. The telescoping members 90*a* and 90*b* may be any type of telescoping member that telescopes between an extended position (see FIG. 6A) and a retracted position (see FIG. 6B and FIG. 6C). Illustrative telescoping members may include, for example, hydraulic cylinder type telescoping members, screw drive telescoping members, and/or any other type of telescoping member, as desired. The illustrative telescoping members 90*a* and 90*b* are shown having three telescoping sections, but it is contemplated that more or less telescoping sections may be used, as desired.

A lower end of the telescoping members 90*a* and 90*b* is shown secured to the platform 10, and an upper end of the telescoping members 90*a* and 90*b* is shown secured to the cover assembly 30. In some cases, the lower end or section of the telescoping members 90*a* and 90*b* may be secured to the side wall (such as side wall 14*c*) rather than, or in addition to, the platform 10, as desired.

When the cover assembly 30 is moved under human power, the telescoping members 90*a* and 90*b* may help provide a bias against gravity so that the cover assembly 30 can more easily be lifted from the lowered position (see FIG. 6C) to the raised position (see FIG. 6A). For example, and in one illustrative embodiment, the telescoping members 90*a* and 90*b* may be adapted to compress a gas and/or a fluid when the cover assembly 30 is moved from the raised position to the lowered position, which then provides a bias force in the opposite direction. This may also help limit the speed at which the cover assembly 30 drops from the raised position to the lowered position. It is contemplated that other suitable methods may be used to provide a bias against gravity to the cover assembly. In some embodiments, a locking mechanism may be provided to lock the telescoping members 90*a* and 90*b* in the extended position (see FIG. 6A) and/or the retracted position (see FIG. 6C), as desired.

When the cover assembly is moved using a powered system, such as by a motor or pump, the telescoping members 90*a* and 90*b* may be adapted to transfer energy from the motor or pump to movement between the retracted position (see FIG. 6C) and the extended position (see FIG. 6A). In some cases, the telescoping members 90*a* and 90*b* may be telescoping hydraulic cylinders that respond to hydraulic fluid being pumped into and out of the hydraulic cylinders. In other cases, the telescoping members 90*a* and 90*b* may be moved between the retracted position (see FIG. 6C) and the extended position (see FIG. 6A) using a screw drive. For example, the intermediate section of the telescoping members 90*a* and 90*b* may be in threaded engagement with the lower section of the telescoping members 90*a* and 90*b*, such that when the intermediate section is rotated relative to the lower section, the intermediate section moves in relation to the lower section. Likewise, the upper section of the telescoping members 90*a* and 90*b* may be in threaded engagement with the intermediate section of the telescoping members 90*a* and 90*b*, such that when the upper section is rotated relative to the intermediate section, the upper section moves in relation to the intermediate section. Any other suitable powered telescoping system may also be used, as desired.

Like the illustrative embodiment shown in FIGS. 2A-2C, the cover assembly 30 may be moved to the raised position (see FIG. 6A) to provide some level or protection to the occupants of the boat in the protected area 16 from the sun and/or other elements, particularly when the sun is directly overhead. When the user does not intend to use the boat, the telescoping members 90*a* and 90*b* may allow the cover assembly 30 to be moved to the lowered position (see FIGS. 6B-6C). In the lowered position, the cover assembly 30 may extend at least out to the side walls (e.g. sidewall 14*c*), and in some cases, may extend over and vertically overlap the top end of the side walls, around the perimeter of the protected area 16. This may help protect the protected area from the elements when the boat is not in use.

Figure 7A:
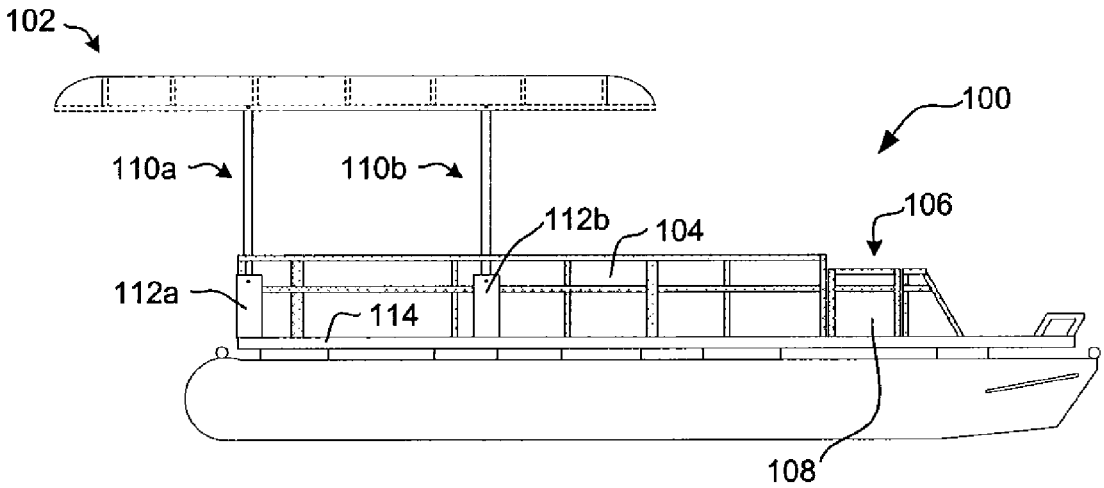
FIG. 7A is a schematic side view of another illustrative pontoon boat, with a cover assembly in a raised position.
Figure 7B:
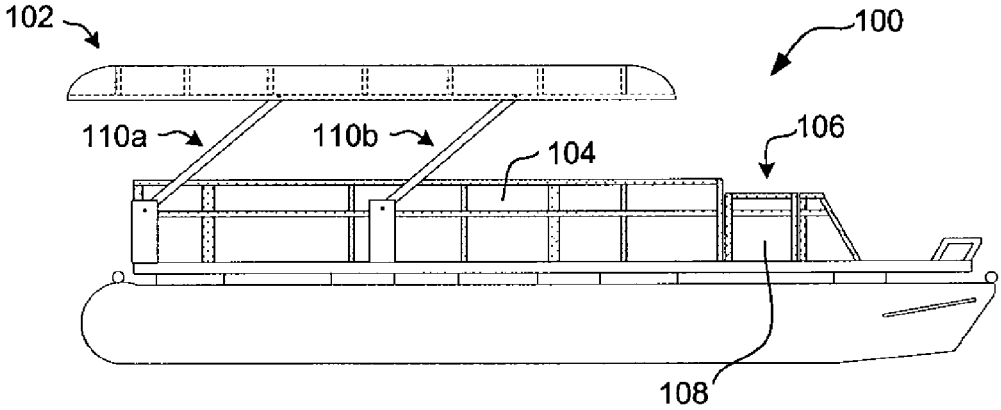
FIG. 7B is a schematic side view of the pontoon boat of FIG. 7A, with the cover assembly in an intermediate position.

FIG. 7A is a schematic side view of another illustrative pontoon boat 100, with a cover assembly 102 in a raised position. As can be seen, the pontoon boat 100 differs from the pontoon boat 8 of FIG. 1 in that the protected area is smaller. The protected area is defined by side walls, such as side wall 104, which extends around the perimeter of the protected area. A non-protected area 106 of the pontoon boat 102 may still include side walls 108, if desired, and as shown in FIGS. 7A-7B. In the illustrative embodiment, the side walls 108 of the non-protected area 106 extend out from the side walls of the protected area, and are lower in height. This may allow the cover assembly 102 to vertically overlap the top of the higher sidewalls 104 of the protected area, without interfering with the sidewalls 118 of the non-protected area 106.

In some cases, the sidewalls 108 of the non-protected area may be the same height as the side walls 104 of the protected area. When so provided, a slot may be provided in the side walls 108 of the non-protected area adjacent to the side walls of the protected area to allow the cover assembly 102 to vertically overlap the top of the higher side walls 104 of the protected area without interfering with the side walls 118 of the non-protected area 106. In another embodiment, a slot or the like may be provided in the cover assembly. Alternatively, the cover assembly 30 may extend out to and rest on the side walls 104 of the protected area, and thus no slot may be provided in the side walls 108 of the non-protected area 106. In yet another embodiment, no side walls may be provided around the non-protected area 106. Any other suitable configuration may also be used, as desired.

In the illustrative embodiment of FIG. 7A, the cover assembly 102 is supported above the platform by a number of pivoting support members. In the illustrative embodiment, four pivoting support members 110*a* and 110*b* are used, with only those on the starboard side shown. However, more or less pivoting support members may be used, as desired.

Figure 7C:
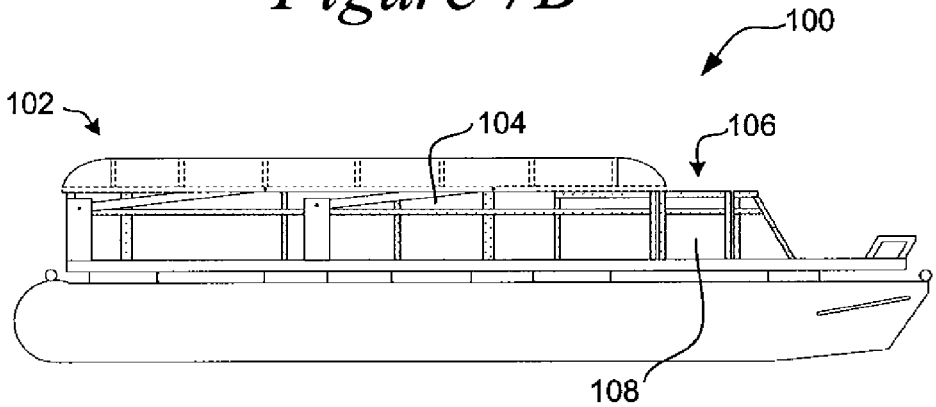
FIG. 7C is a schematic side view of the pontoon boat of FIG. 7A, with the cover assembly in a lowered position.

The lower end of each of the pivoting support members 110*a* and 110*b* is pivotally connected to the platform 114 and/or side walls 104 by a corresponding pivot member, such as pivot members 112*a* and 112*b*. In the illustrative embodiment, the upper end of each of the pivoting support members 110*a* and 110*b* is pivotally connected to the cover assembly 102, as shown. As the pivoting support members 110*a* and 110*b* rotate in a clockwise direction, the cover assembly 102 is moved forward and down (see FIG. 7B) until the cover assembly 102 engages and/or overlaps the side walls 104 (see FIG. 7C) to provide protection to the protected area of the pontoon boat 100. In some cases, the illustrative embodiment of FIGS. 7A-7C may allow more of the protected area of the pontoon boat 100 to be exposed to the sun and/or other elements when the cover assembly 102 is in the raised position. Like above, the cover assembly 102 may be moved between the raised position (see FIG. 7A) and the lowered position (see FIG. 7C) either under human power, or by powered system such as a motor or pump system.

Figure 8:
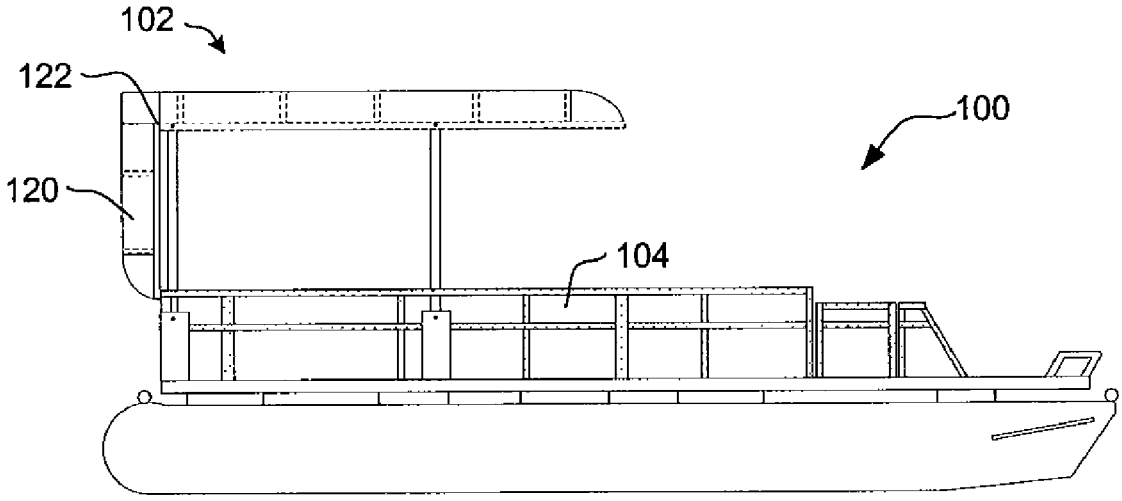
FIG. 8 is a schematic side view of the pontoon boat of FIG. 7A, with the cover assembly in the raised position and with a portion of the cover system folded down.

FIG. 8 is a schematic side view of the pontoon boat of FIG. 7A, with the cover assembly 102 in the raised position and with a portion 120 of the cover assembly 102 folded down. In the illustrative embodiment, the rearward portion 120 of the cover assembly 102 is hinged with the remainder of the cover assembly 102 at a hinge point 122. A lock mechanism may be provided to lock the rearward portion 120 in the upright position (see FIG. 7A), and/or in the folded down position (see FIG. 8), if desired. In some cases, the cover of the cover assembly may include one or more transparent or semi-transparent window(s) in the rearward portion 120 to help provide visibility in the rearward direction when the rearward portion 120 is folded down as shown. One or more transparent or semi-transparent window(s) may also be provided in the cover above the protected area, to provide additional light into the protected area when the cover assembly 102 is in the raised position, if desired.

Figure 9A:
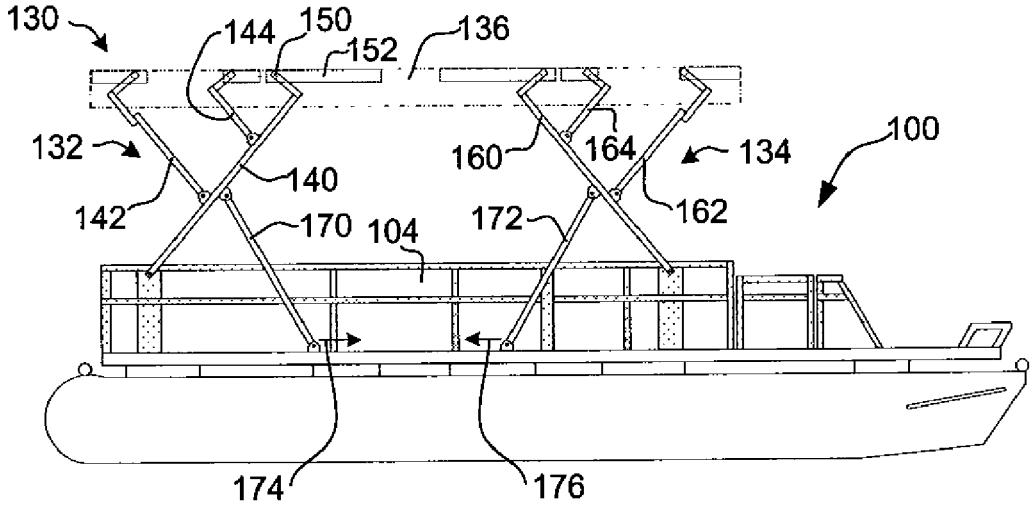
FIG. 9A is a schematic side view of another illustrative pontoon boat, with a cover assembly in a raised position.
Figure 9B:
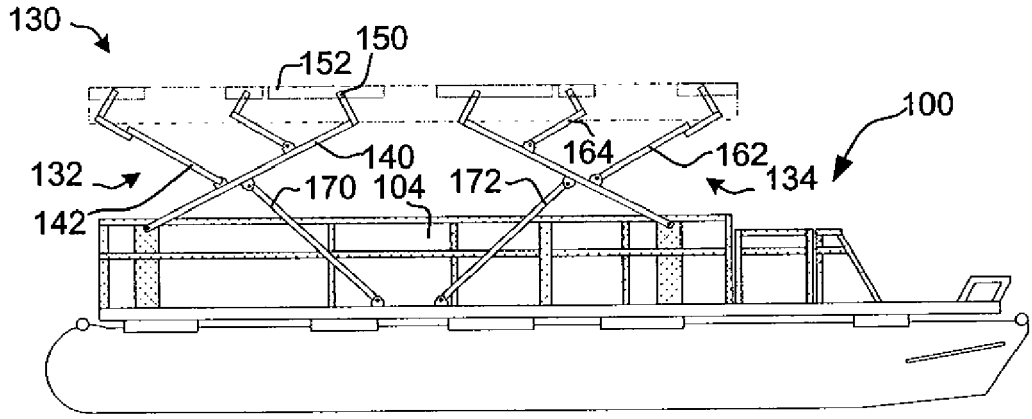
FIG. 9B is a schematic side view of the pontoon boat of FIG. 9A, with the cover assembly in an intermediate position.
Figure 9C:
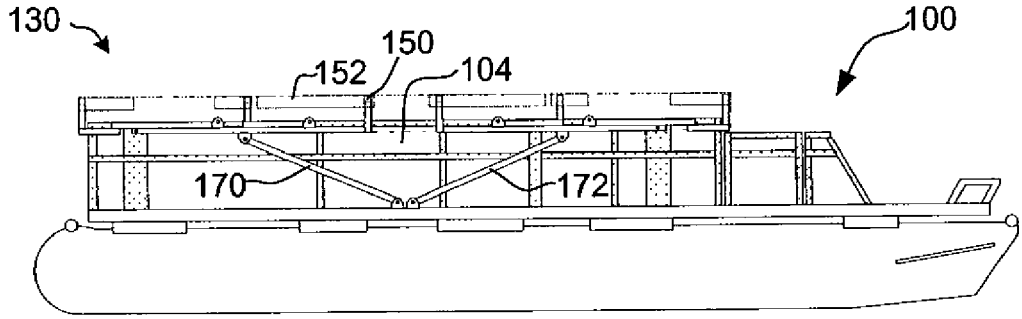
FIG. 9C is a schematic side view of the pontoon boat of FIG. 9A, with the cover assembly in a lowered position.

FIG. 9A is a schematic side view of the illustrative pontoon boat 100, with a cover assembly 130 in a raised position. FIG. 9B is a schematic side view of the pontoon boat of FIG. 9A, with the cover assembly 130 in an intermediate position, and FIG. 9C is a schematic side view of the pontoon boat 130 of FIG. 9A, with the cover assembly 130 in a lowered position. In this illustrative embodiment, cover assembly 130 includes a rear support frame 132 and a front support frame 134, wherein both the front support frame 132 and the rear support frame 134 support a cover 136. A front and a rear support frame may also be provided on the port side of the pontoon boat 100, but they are not shown in FIGS. 9A-9C. In this, front and rear are relative terms pertaining to the illustrated embodiment, and should not be interpreted as limiting in any manner.

In the illustrative embodiment, the rear support frame 132 includes a main pivoting support member 140, with a number of pivoting cover supports 142 and 144 extending off of the main pivoting support member 140. The upper ends of the main pivoting support member 140 and each of the pivoting cover supports 142 and 144 may include a laterally extending member that extends transversely (into the page) across the protected area of the pontoon boat 100. In some cases, the laterally extending members may each be received by a pocket or sleeve formed in the lower side of the cover 136.

Likewise, the front support frame 134 may include a main pivoting support member 160, with a number of pivoting cover supports 162 and 164 extending off of the main pivoting support member 160. The upper ends of the main pivoting support member 160 and each of the pivoting cover supports 162 and 164 may include a laterally extending member that extends transversely (into the page) across the protected area of the pontoon boat 100. The laterally extending members may each be received by a pocket or sleeve formed in the lower side of the cover 136.

When the cover assembly 130 is in the fully raised position (see FIG. 9A), each laterally extending member may engage one side of its corresponding pocket or sleeve. For example, the laterally extending member 150 may engage the left side of its corresponding pocket 152. Likewise, when the cover assembly 130 is in the fully lowered position (see FIG. 9C), each laterally extending member may engage the other side of its corresponding pocket or sleeve. For example, the laterally extending member 150 may engage the right side of its corresponding pocket 152. This may help the cover 136 to be pulled tight in both the raised position and lowered position, while allowing the rear support frame 132 and the front support frame 134 to change support configurations during the transition.

The lower ends of the main pivoting support members 140 and 160 may be pivotally attached to the side wall 104 of the pontoon boat 100. In the illustrative embodiment shown, the main pivoting support member 140 is pivotally attached to the side wall 104 near the rear of the pontoon boat 100, and the main support member 160 is pivotally attached to the side wall 104 near the front of the pontoon boat 100. As the main support member 140 is rotated clockwise, and the main support member 160 is rotated counter-clockwise, the cover assembly 130 moves from the raised position shown in FIG. 9A to the lowered position shown in FIG. 9C.

In some embodiments, a rear driving support member 170 is pivotally attached to the rear main pivoting support member 140, and a front driving support member 172 is pivotally attached to the front main pivoting support member 160. The lower end of the rear driving support member 170 may be adapted to be moved in the rightward direction, as indicated by arrow 174, to move the cover assembly 130 from the raised position to the lowered position. Likewise, the lower end of the front driving support member 172 may be adapted to be moved in the leftward direction, as indicated by arrow 176, to move the cover assembly 130 from the raised position to the lowered position. Conversely, the lower end of the rear driving support member 170 may be adapted to be moved in the leftward direction to move the cover assembly 130 from the lowered position to the raised position, and the lower end of the front driving support member 172 may be adapted to be moved in the rightward direction to move the cover assembly 130 from the lowered position to the raised position.

Figure 15:
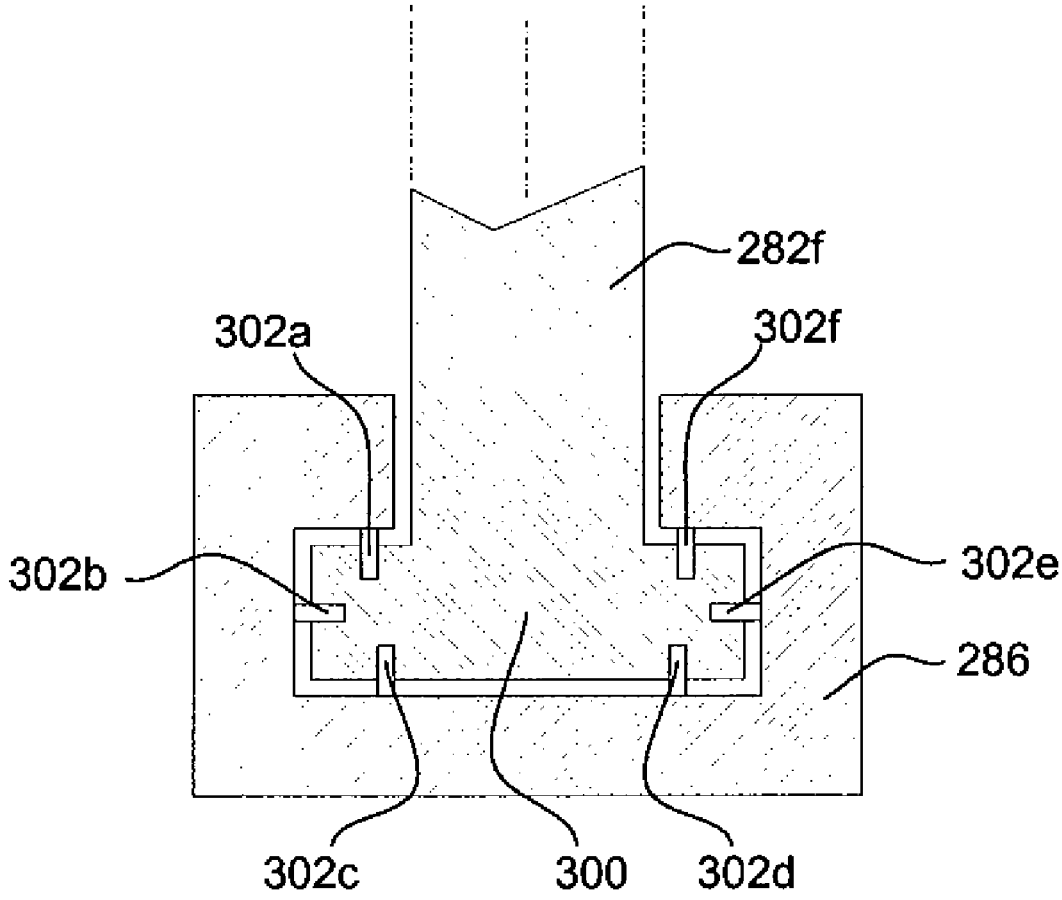
FIG. 15 is a schematic cross-sectional side view of a track and a movable support member.

In some embodiments, the lower end of the rear driving support member 170 and the lower end of the front driving support member 172 may be slide along a track or the like, wherein the track or the like is attached to the platform and/or side walls of the pontoon boat 100 (see, for example, FIG. 15). A drive mechanism may be provided for moving the lower end of the rear driving support member 170 and the lower end of the front driving support member 172 along the track. The drive mechanism may include, for example, a belt, a cable, a chain, a screw drive, a hydraulic drive, or any other suitable drive mechanism, as desired.

Figure 10:
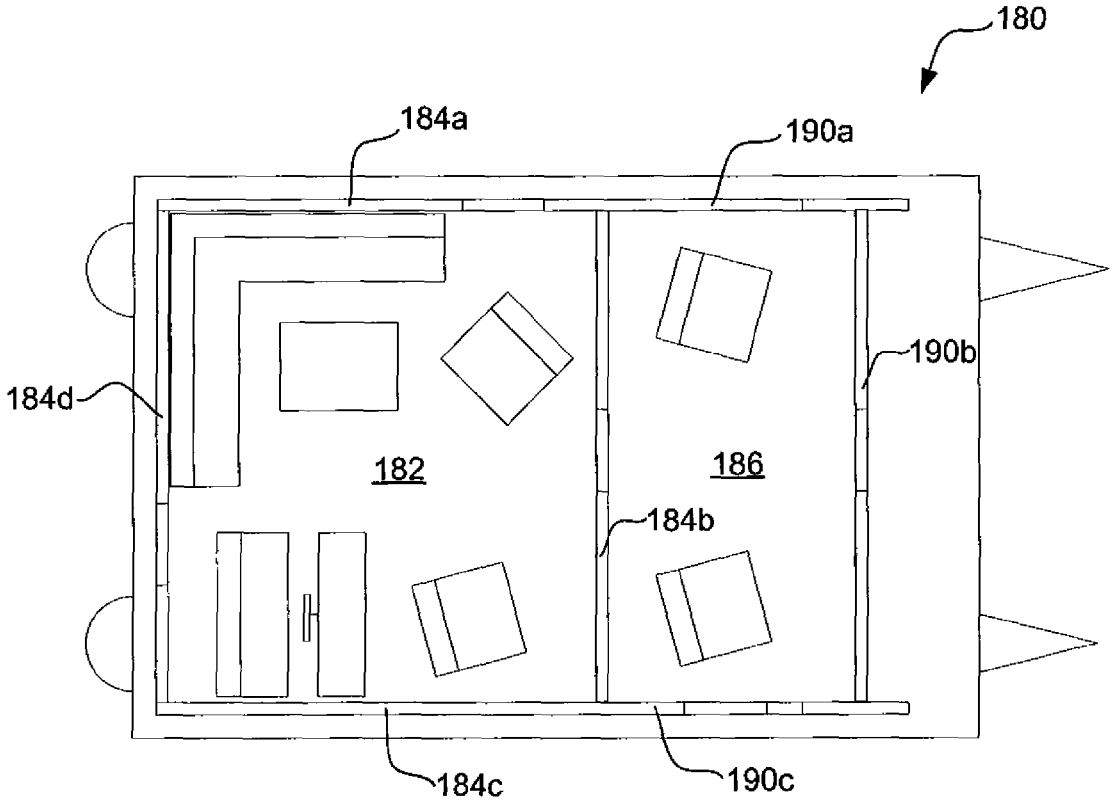
FIG. 10 is a schematic top view of another illustrative pontoon boat with a smaller protected area defined by side walls.

FIG. 10 is a schematic top view of another illustrative pontoon boat, generally shown at 180. As can be seen, the pontoon boat 180 differs from the pontoon boat 8 of FIG. 1 and the pontoon boat 100 of FIG. 7A in that the protected area 182 is even smaller in size. The protected area is defined by side walls 184*a*-184*d*, which extend around the perimeter of the smaller protected area 182. In some cases, a non-protected area 186 of the pontoon boat 180 may still include side walls 190*a*-190*c*. In the illustrative embodiment, the side walls 190*a*-190*c* of the non-protected area 186 extend out from side wall 184*b* of the protected area 182 and are lower in height, but his is not required in all embodiments. This may allow a cover assembly to vertically overlap the top of the higher sidewalls 184*a*-184*d* of the protected area 182, without interfering with the sidewalls 190*a* and 190*c* of the non-protected area 186.

In some cases, the sidewalls 190*a*-190*c* of the non-protected area 186 may be the same height as the side walls 184*a*-184*d* of the protected area 182. When so provided, a slot may be provided in the side walls 190*a* and 190*c* of the non-protected area 186 adjacent to the side wall 184*b* of the protected area 182 to allow a cover assembly to vertically overlap the top of the higher side walls 184*a*-184*d* of the protected area 182 without interfering with the side walls 190*a* and 190*c* of the non-protected area 186. Alternatively, a cover assembly may extend out to and rest on the side walls 184*a*-184*d* of the protected area 182, and thus no slot may be needed in the side walls 190*a* and 190*c* of the non-protected area 186. In another embodiment, a slot or the like may be provided in the cover assembly. In yet another embodiment, no side walls may be provided around the non-protected area 186. Any other suitable configurations may also be used, as desired.

By providing a smaller protected area 182 than in the pontoon boat 8 of FIG. 1 and the pontoon boat 100 of FIG. 7A, a cover assembly may be made smaller. This may reduce the cost of the cover assembly and drive mechanism, and may allow more of the platform of the pontoon boat 180 to be exposed to the sun when the cover assembly is in the raised position. This may be more desirable for some boaters.

Figure 11A:
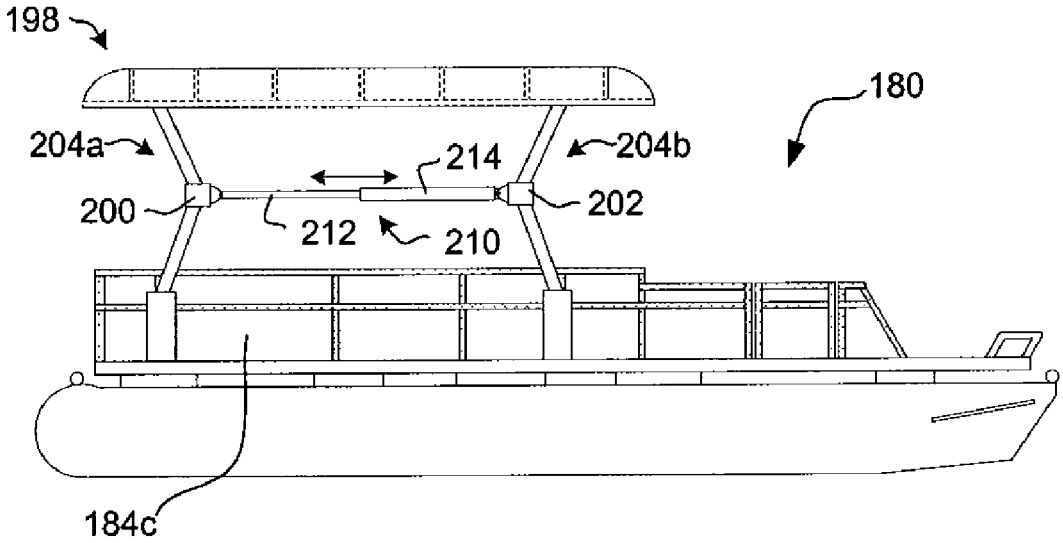
FIG. 11A is a schematic side view of another illustrative pontoon boat, with a cover assembly in a raised position.
Figure 11B:
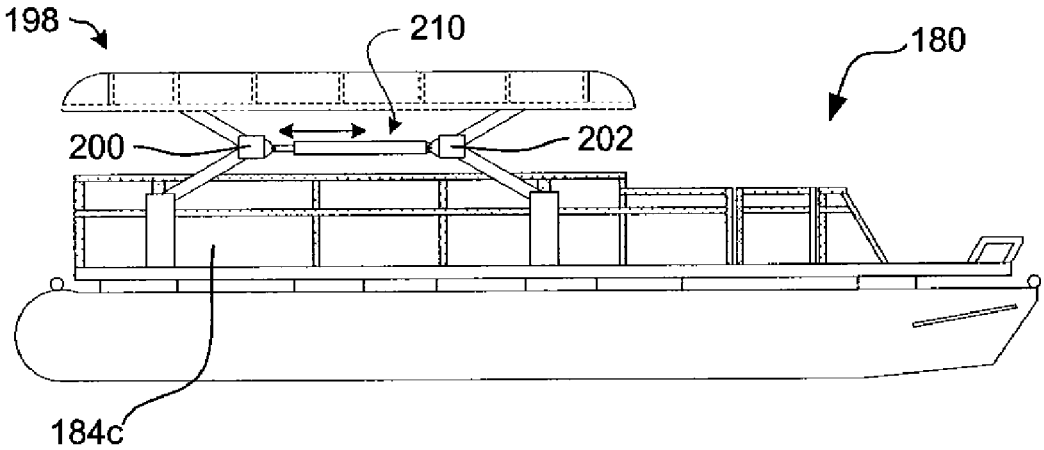
FIG. 11B is a schematic side view of the pontoon boat of FIG. 11A, with the cover assembly in an intermediate position.
Figure 11C:
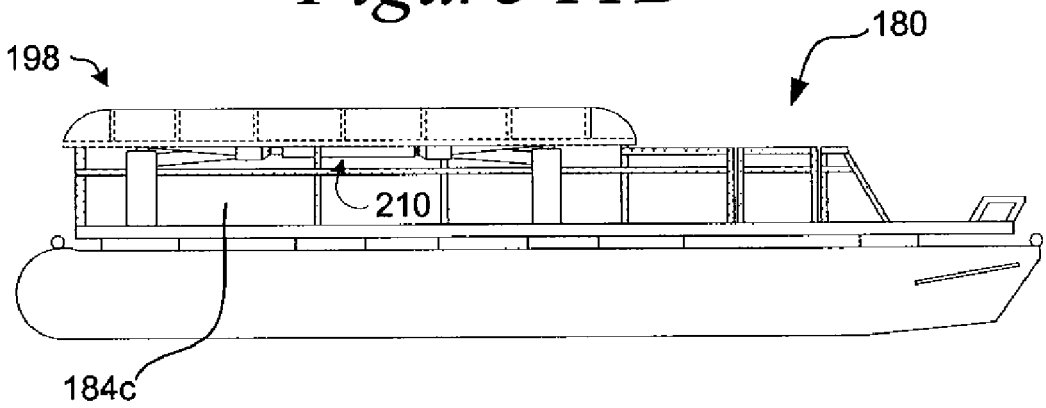
FIG. 11C is a schematic side view of the pontoon boat of FIG. 11A, with the cover assembly in a lowered position.

FIG. 11A is a schematic side view of the illustrative pontoon boat 180, with a cover assembly 198 in a raised position. FIG. 11B is a schematic side view of the pontoon boat 180 of FIG. 11A, with the cover assembly 198 in an intermediate position, and FIG. 11C is a schematic side view of the pontoon boat 180 of FIG. 11A, with the cover assembly 198 in a lowered position.

The illustrative cover assembly 198 is similar to that shown and described with reference to FIGS. 2A-2C. However, in this illustrative embodiment, a screw drive mechanism generally shown at 210 is provided between pivot points 200 and 202 of cover supports 204*a* and 204*b*. The screw drive mechanism 210 may include, for example, a rotating screw 212 that is threaded with a support member 214. A motor or the like may be provided at or near the pivot point 200 to rotate the rotating screw 212. Alternatively, or in addition, a motor or the like may be provided at or near the pivot point 202 to rotate the support member 214. Depending on the direction that the rotating screw 212 (and/or support member 214) is rotated, the rotating screw 212 moves either in or out of the support member 214, causing the cover assembly 198 to move toward the raised position (see FIG. 11A) or toward the lowered position (see FIG. 11C).

In some embodiments, the screw drive mechanism 210 may be similar to the screw drive used in FLOE Vertical Screw Boat Lifts, commercially available from FLOE International Inc., located in McGregor, Minn. In some cases, only one screw drive mechanism 210 is used, and may be positioned on, for example, either the starboard or port side of the pontoon boat 180. In other cases, a screw drive mechanism 210 may be provided on both sides of the pontoon boat 180, but this is not required in all embodiments. Also, although the screw drive mechanism 180 is shown in conjunction with pontoon boat 180, it is contemplated that the screw drive mechanism 180 may be used on other boats, including the pontoon boat 8 of FIG. 1 and the pontoon boat 100 of FIG. 7A, as desired.

Figure 12A:
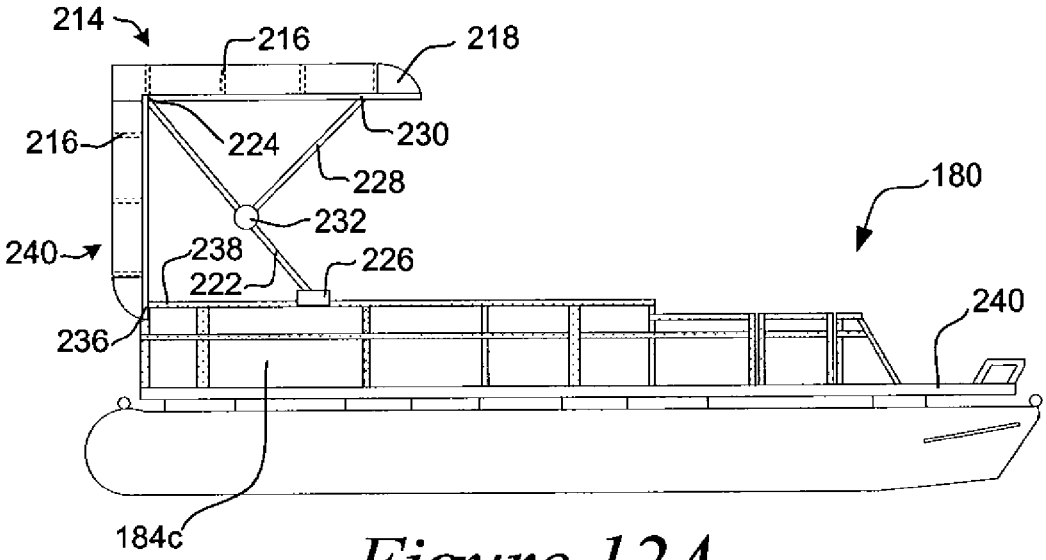
FIG. 12A is a schematic side view of another illustrative pontoon boat, with a cover assembly in a raised position.
Figure 12B:
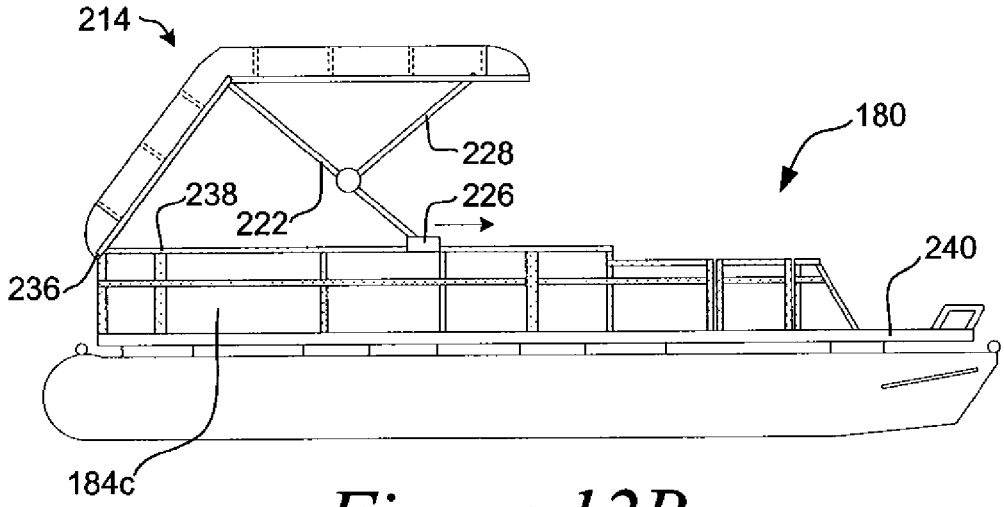
FIG. 12B is a schematic side view of the pontoon boat of FIG. 12A, with the cover assembly in an intermediate position.
Figure 12C:
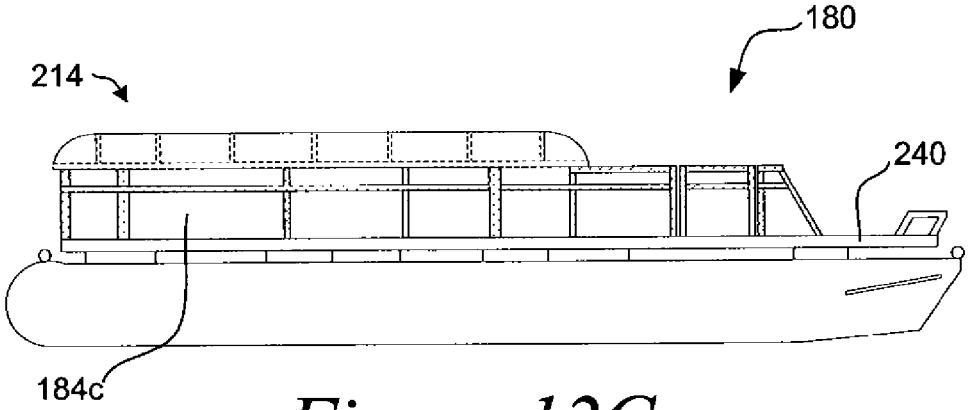
FIG. 12C is a schematic side view of the pontoon boat of FIG. 12A, with the cover assembly in a lowered position.

FIG. 12A is a schematic side view of the illustrative pontoon boat 180 of FIG. 10, with a movable cover assembly 214 in a raised position. FIG. 12B is a schematic side view of the pontoon boat 180 of FIG. 12A, with the cover assembly 214 in an intermediate position, and FIG. 12C is a schematic side view of the pontoon boat 180 of FIG. 12A, with the cover assembly 214 in a lowered position. The illustrative cover assembly 214 includes a support frame 216 that supports a cover 218. In the illustrative embodiment, the support frame 216 is hinged at an intermediate location 224. A top end of a first support member 222 may be pivotally connected to the support frame 216 at or near the intermediate location 224, as shown. A lower end of the first support member 222 may be connected to a track car 226. The track car 226 may be adapted to slide along a track or the like (see, for example, FIG. 15) that is positioned along the top of the side wall 238, along the platform 240 of the pontoon boat 180, or along some other location, as desired.

In the illustrative embodiment, a top end of a second support member 228 may be pivotally connected to a more forward location 230 of the support frame 216, as shown. A lower end of the second support member 228 may be pivotally connected to an intermediate location 232 of the first support member 222. A rear end of the support frame 216 of the cover assembly 214 may be pivotally connected to the side wall 238 at a rear location 236, the platform 240, or at some other location, as desired.

During use, the track car 226 may be moved forward from the location shown in FIG. 12A. As the track car 226 is moved forward, the cover assembly 214 begins to move forward and down, as shown in FIG. 12B. When the track car 226 is moved sufficiently far forward, the cover assembly 214 moves to a lowered position, as shown in FIG. 12C. In the lowered position, the cover assembly 214 may extend at least out to the side walls (e.g. sidewall 184*c*), and in some cases, may extend over and vertically overlap the top end of the side walls, around the perimeter of the protected area 182. This may help protect the protected area 182 from the elements when the boat 180 is not in use. In some cases, the track car 226 may be moved under human power, while in others, the track car 226 may be moved using a powered motor, pump or other such device.

In some embodiments, the cover 218 may include a transparent or semi-transparent window. For example, such a window may be provided in a window region 240 in the cover 218. This may improve the visibility in a rearward direction when the cover is in the raised position.

Figure 13A:
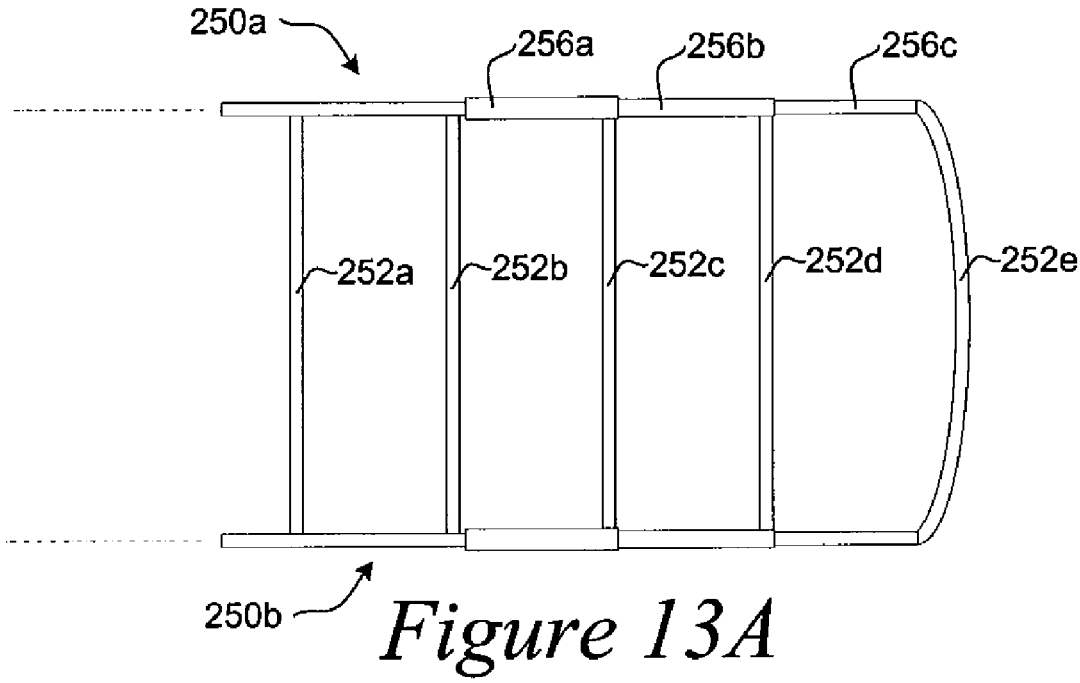
FIG. 13A is a schematic top view of a cover assembly in an extended position.

FIG. 13A is a schematic top view of a cover assembly in an extended position. The illustrative cover assembly includes a support frame that has side support members 250*a* and 250*b*, and a number of transverse support members 252*a*-252*e*. The side support members 250*a* and 250*b* may extend the length of the support frame, and the transverse support members 252*a*-252*e* may extend the width of the support frame. The side support members 250*a*-250*b* and the transverse support members 252*a*-252*e* may be adapted to support a cover (not explicitly shown in FIGS. 13A-12C).

Figure 13B:
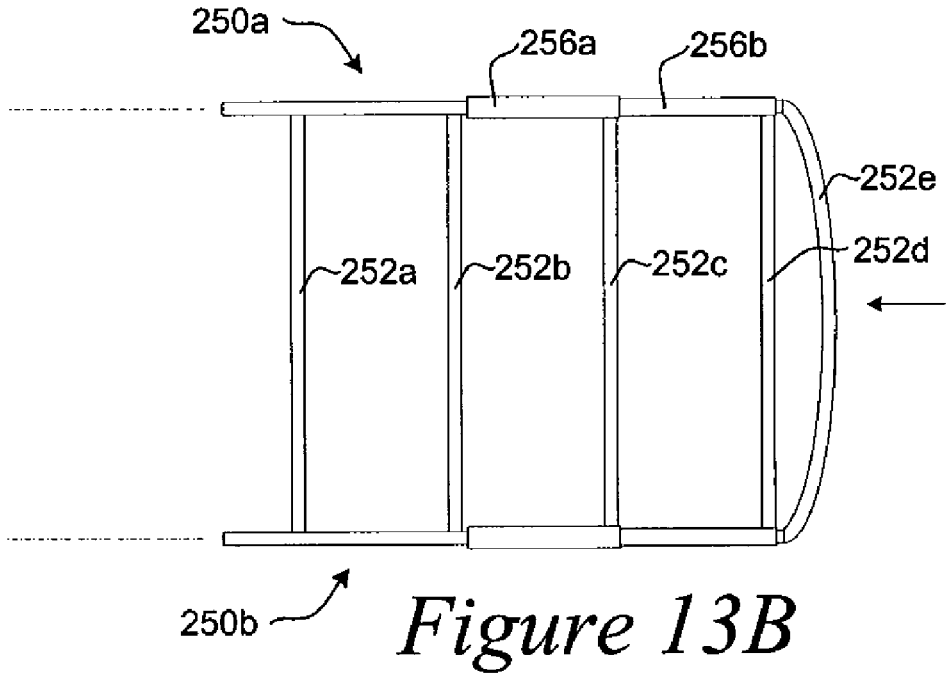
FIG. 13B is a schematic top view of a cover assembly in an intermediate extended position.
Figure 13C:
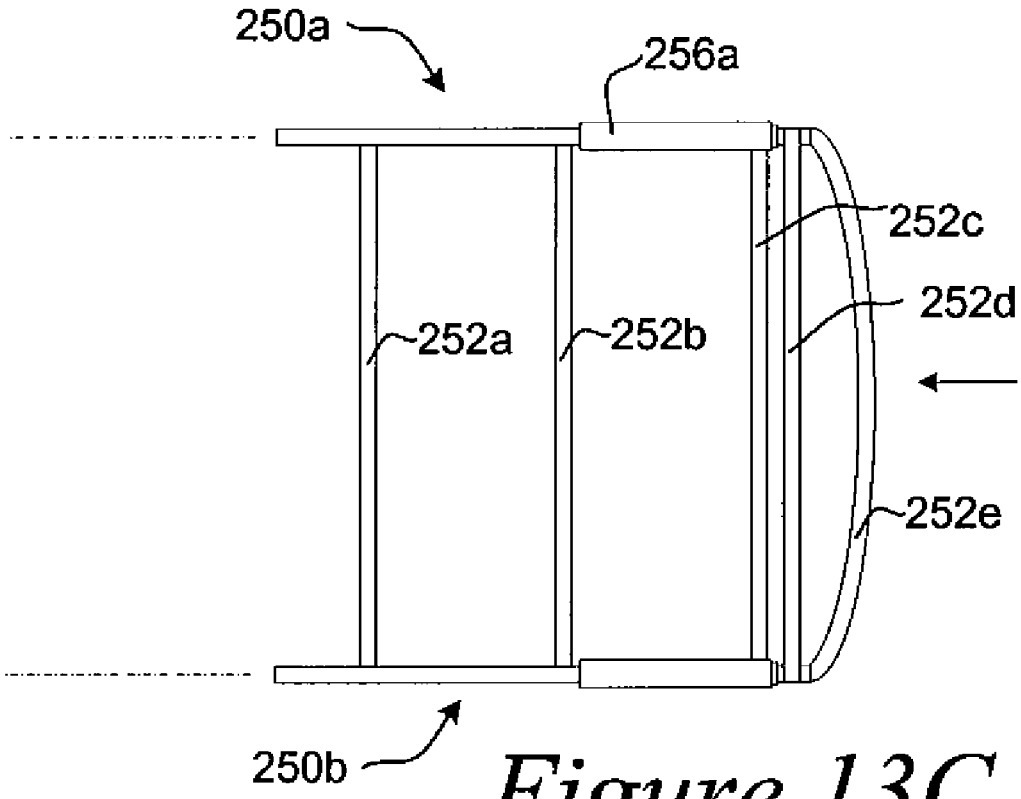
FIG. 13C is a schematic top view of a cover assembly in a retracted position.

In some embodiments, the support frame may be moved between an extended position and a retracted or partially retracted position. This may allow the occupants of a boat to adjust the area of the boat that is covered by the cover assembly, particularly when the cover assembly is in the raised position. In the illustrative embodiment, the side support members 250*a* and 250*b* may each include telescoping sections, such as telescoping sections 256*a*-256*c*. By pushing on the transverse support member 252*e*, telescoping section 256*c* may be moved into telescoping section 256*b*, allowing the transverse support member 252*e* to be retracted toward transverse support member 252*d*, as shown in FIG. 13B. Likewise, by pushing on the transverse support member 252*d*, telescoping section 256*b* may be moved into telescoping section 256*a*, allowing the transverse support member 252*d* to be retracted toward transverse support member 252*c*, as shown in FIG. 13C. While a telescoping arrangement is shown in FIGS. 13A-13C, it is contemplated that any suitable arrangement may be used to move the support frame (and cover) between an extended position and a retracted or partially retracted position.

Figure 14A:
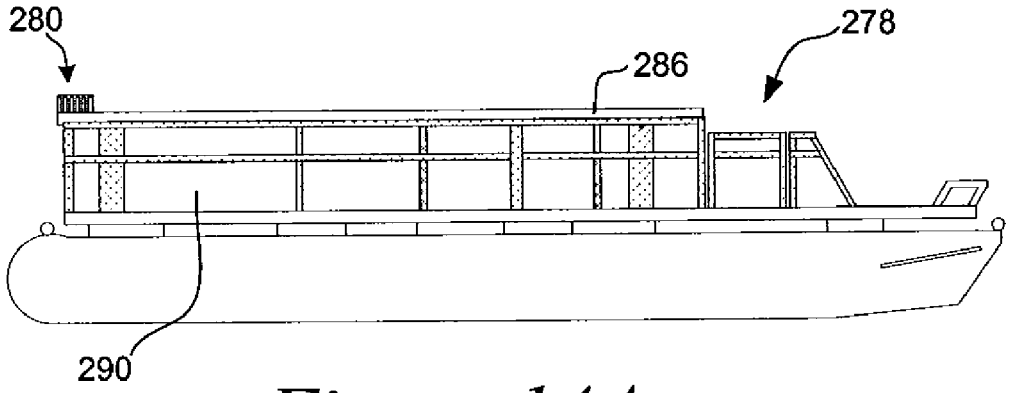
FIG. 14A is a schematic side view of another illustrative pontoon boat, with a cover assembly in retracted storage position.
Figure 14B:
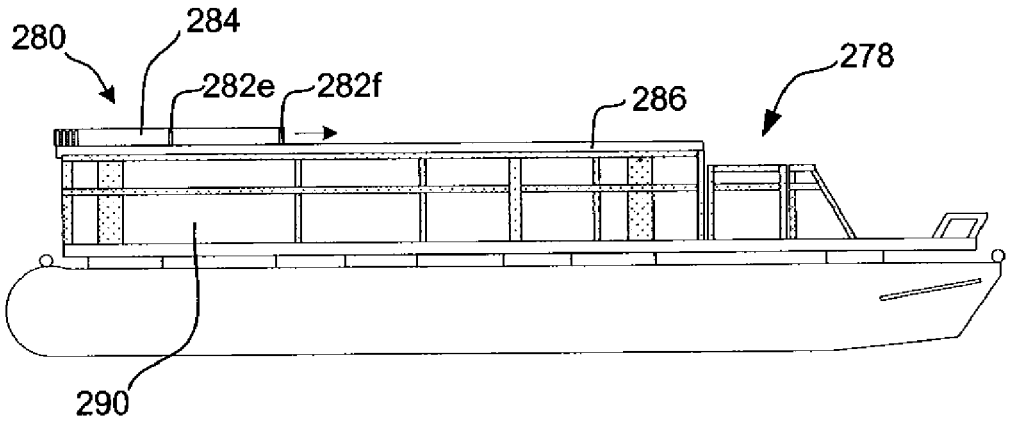
FIG. 14B is a schematic side view of the pontoon boat of FIG. 14A, with the cover assembly in an intermediate position.
Figure 14C:
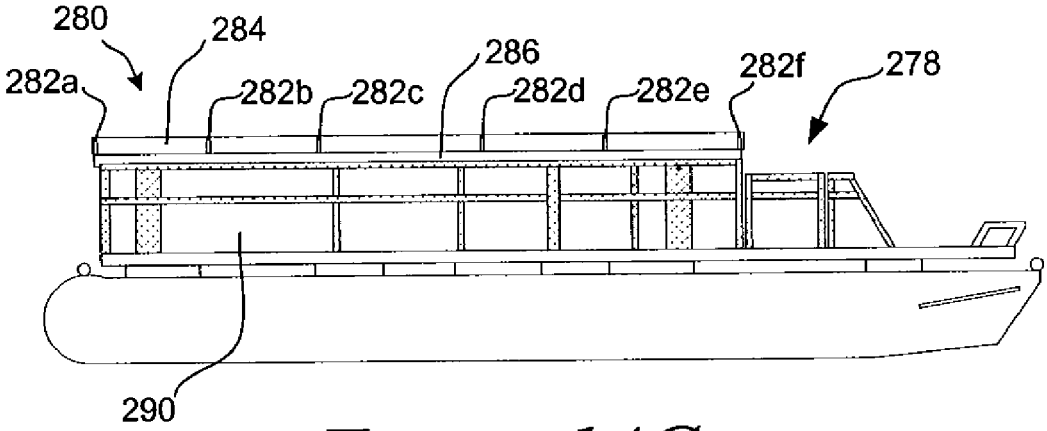
FIG. 14C is a schematic side view of the pontoon boat of FIG. 14A, with the cover assembly in an extended covering position.

FIG. 14A is a schematic side view of another illustrative pontoon boat 278, with a cover assembly 280 in a retracted storage position. FIG. 14B is a schematic side view of the pontoon boat 278 of FIG. 14A, with the cover assembly 280 in an intermediate position, and FIG. 14C is a schematic side view of the pontoon boat 278 of FIG. 14A, with the cover assembly 280 in an extended covering position. In the illustrative embodiment, the cover assembly includes a number of transverse support members 282*a*-282*f* that support a cover 284.

Each of the transverse support members 282*a*-282*f* may be connected to a track car (e.g. track car 300 in FIG. 15), that slides along a track 286. In the illustrative embodiment, a right track 286 extends along the right side wall (e.g. side wall 290) of a protected area of the pontoon boat 278, and a left track extends along the left side wall (not shown) of a protected area of the pontoon boat 278. It is contemplated, however, that the tracks may extend along the front and back side walls of the protected area, if desired.

From the retracted position shown in FIG. 14A, the track cars attached to the most forward transverse support member 282*f* may be moved in a forward direction, as shown in FIG. 14B. When the most forward transverse support member 282*f* moves forward sufficiently far, the next transverse support member 282*e* may be moved forward (see FIG. 14B). This continues until the most forward transverse support member 282*f* reaches the front of the protected area of the pontoon boat (see FIG. 14C).

In some embodiments, the cover 284 may include a number of spaced pockets or sleeves that each are adapted to receive a corresponding one of the transverse support members 282*a*-282*f*. Thus, when the most forward transverse support member 282*f* is pulled forward sufficiently far, so that the portion of the cover 284 between the most forward pocket or sleeve and the pocket or sleeve that receives the next transverse support member 282*e* becomes tight, the cover begins pulling the next transverse support member 282*e* forward. This may continue until the most forward transverse support member 282*f* reaches the front of the protected area of the pontoon boat (see FIG. 14C). In the illustrative embodiment, the rear most transverse support member 282*a* may be fixed at or near the rear of the protected area of the pontoon boat. It is contemplated that the transverse support member 282*a*-282*f* may extend up from the side walls sufficiently far to support the cover and provide clearance over seats, control consoles and/or anything else in the protected area, if desired.

In some cases, the transverse support members 282*a*-282*f* may be moved under human power, while in others, the transverse support members 282*a*-282*f* may be moved using a powered motor, pump or other such device.

FIG. 15 is a schematic cross-sectional side view of a track and a movable support member. In the illustrative embodiment, the movable support member may be the transverse support member 282*f* of FIGS. 14A-14C. However, the movable support member may be any other support member, including those shown and described in other embodiments of the present invention.

The movable support member may be connected to a track car 300 as shown. It is contemplated that the movable support member may be directly connected to the track car 300, pivotally connected, integrally formed with, or connected in any other suitable way. A track 286 may be provided for receiving the track car 300. In the illustrative embodiment, the track 286 includes a cavity that is shaped to receive the track car 300. In some embodiments, the track car 300 may include one or more sliders 302*a*-302*f*. The sliders 302*a*-302*f* may be made from plastic, Teflon™, metal, or any other suitable material, as desired. The sliders 302*a*-302*f* may help reduce the friction between the track car 300 and the track 286. In some cases, the sliders 302*a*-302*f* may include wheels, ball bearings or the like. The track 286 and track car 300 arrangement may be used in conjunction with any number of illustrative embodiments, including those shown in FIGS. 9A-9C, 12A-12C, 14A-14C, as well as other embodiments, as desired.

Figure 16:
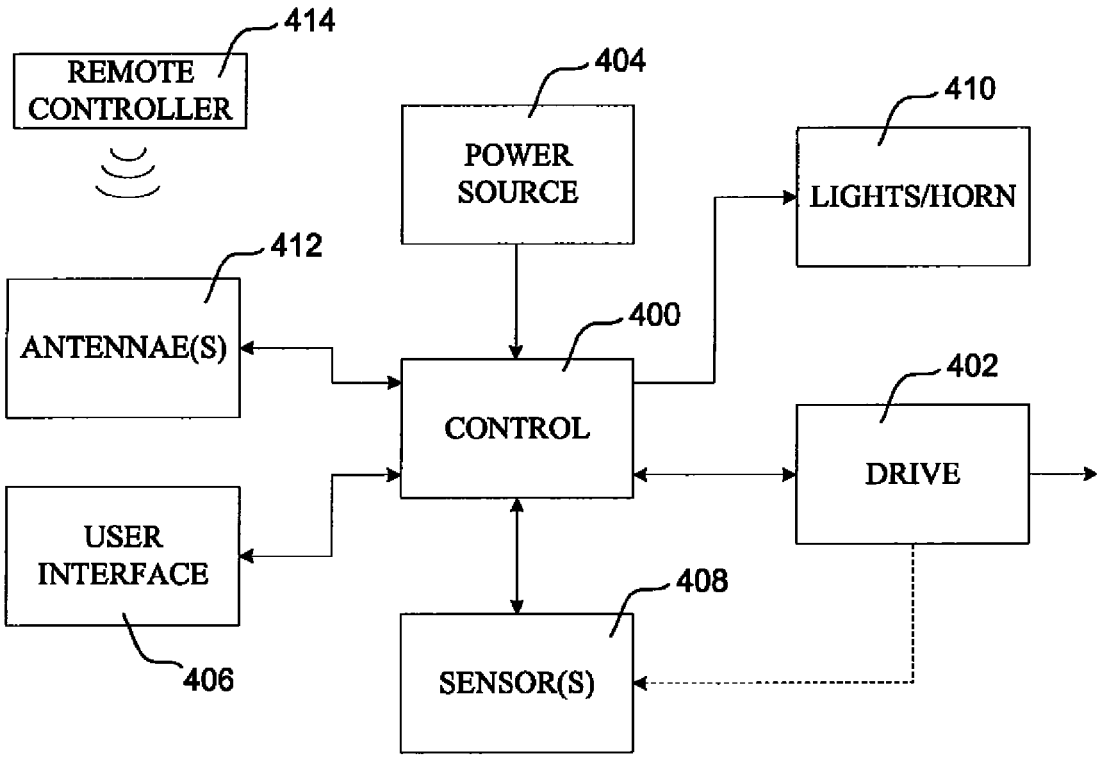
FIG. 16 is a schematic block diagram of a control system for a movable cover system for a boat.

FIG. 16 is a schematic block diagram of a control system for a powered cover system for a boat. The illustrative control system may include a controller 400 that is coupled to a drive mechanism 402. The drive mechanism 402 may include, for example, a motor, a pump, or any other powered system for moving the cover system of a boat between a first position and a second position. The drive mechanism 402 may also receive power from a power source 404, either directly or from the controller 400, as desired.

The controller 400 may be adapted to control the drive mechanism 402 to move the cover system between a first position (e.g. raised or retracted position) and a second position (e.g. lowered or extended position). The controller 400 may include, for example, a microprocessor, a number of relays or power transistors, a memory, switches, a timer and/or any other suitable device or devices to provide the desired level of control.

In some embodiments, the controller 400 may be coupled to a user interface 406. The user interface 406 may allow a user to interact in some way with the controller 400. For example, the user interface 406 may include one or more switches and/or buttons. In some cases, the user interface may include a display, such as an LCD display, and/or one or more light indicators such as LED indicators. In some cases, the user interface 406 may be mounted on the control console of the boat.

The controller 400 may also be coupled to one or more sensors 408. The sensors may include, for example, a rain sensor, a wind speed sensors, a light sensor, a current and/or voltage sensor, and/or any other type of sensors as desired. In one example, the controller 400 may receive a signal from a rain sensor that indicates that rain is present, and may move the cover from a raised position to a lowered position. The controller 400 may also be coupled to one or more lights and/or horns 410. The controller 400 may first provide a warning light and/or warning sound via the lights and/or horns 410 prior to moving the cover from the raised position to the lowered position. In some cases, the user may override the controller 400 from moving the cover from the raised position to the lowered position after the warning light and/or warning sound is provided.

In another example, the controller 400 may receive a signal from a wind speed sensor that indicates that the wind speed has exceeded a threshold value, and may move the cover from a raised position to a lowered position. In some cases, the controller 400 may first provide a warning light and/or warning sound via the lights and/or horns 410 prior to moving the cover from the raised position to the lowered position. In some cases, the user may override the controller 400 from moving the cover from the raised position to the lowered position after the warning light and/or warning sound is provided.

In yet another example, the controller 400 may receive a signal from a light detector that indicates that the sun has gone down, and may move the cover from a raised position to a lowered position. In some cases, the controller 400 may first provide a warning light and/or warning sound via the lights and/or horns 410 prior to moving the cover from the raised position to the lowered position. In some cases, the user may override the controller 400 from moving the cover from the raised position to the lowered position after the warning light and/or warning sound is provided.

The controller 400 may also monitor one or more current or voltage sensors to determine if the boat is or has recently been underway, and/or if there are other signs that occupants may be using the boat (e.g. radio on). In some cases, the controller 400 may not move the cover from the raised position to the lowered position if the boat is currently underway or it is believed that the boat is otherwise currently occupied.

The controller 400 may also monitor one or more current or voltage sensors to determine the load on the drive mechanism 402. If the load on the drive mechanism 402 exceeds a threshold value, the controller 400 may remove power from the drive mechanism 402, or reverse the direction of movement of the cover. This may provide a level of safety, much like the safety mechanisms of a garage door opener.

The controller 400 may also receive a command from the user interface 406 to move the cover between a first position and a second position. In some cases, the controller 400 may include a timer, and the controller may provide one or more visual and/or audible warnings via lights and/or horns 410 over a period of time, as specified by the timer, before moving the cover between the first position and the second position. This may provide a level of safety so that people around the boat will know that the cover is about to be moved. When the user interface is mounted in the boat, such as on the control console, this delay may allow a user sufficient time to egress the boat before the cover is moved between the first position and the second position.

In some cases, the drive mechanism 402 may control the position of the cover, both in an upward and downward direction. Thus, when the cover is in the lowered or covering position, the cover may not be able to be easily moved without activating the drive mechanism 402. Thus, in some cases, the cover may provide some level or security to the contents in the boat when the boat is not in use. The controller 400 may be adapted to require a key, a code or some other security measure to help prevent unauthorized activation and movement of the cover.

In some cases, the controller 400 may be coupled to one or more antennae 412. A remote controller 414 may be provided to provide remote control signals to the controller 400. For example, the remote controller 414 may provide a command to move the cover from a first position to a second position, or visa versa. The controller 400 may receive this command via the antennae 412, and instruct the drive mechanism 402 to perform the requested action. The controller 400 may also be programmed to turn on one or more lights and/or provide one or more sounds or the like before and/or during some actions. For example, when the controller 400 receives an instruction to move the cover from a raised position to a lowered position, the controller may first beep a warning tone for a period of time, turn on or flash one or more lights, and then instruct the drive mechanism to move the cover from the raised position to the lowered position, if desired. It is contemplated that the remote controller 414 may be any type of remote control device, and in some cases, may be similar to a remote keyless entry device commonly used for automobiles.

Figure 17:
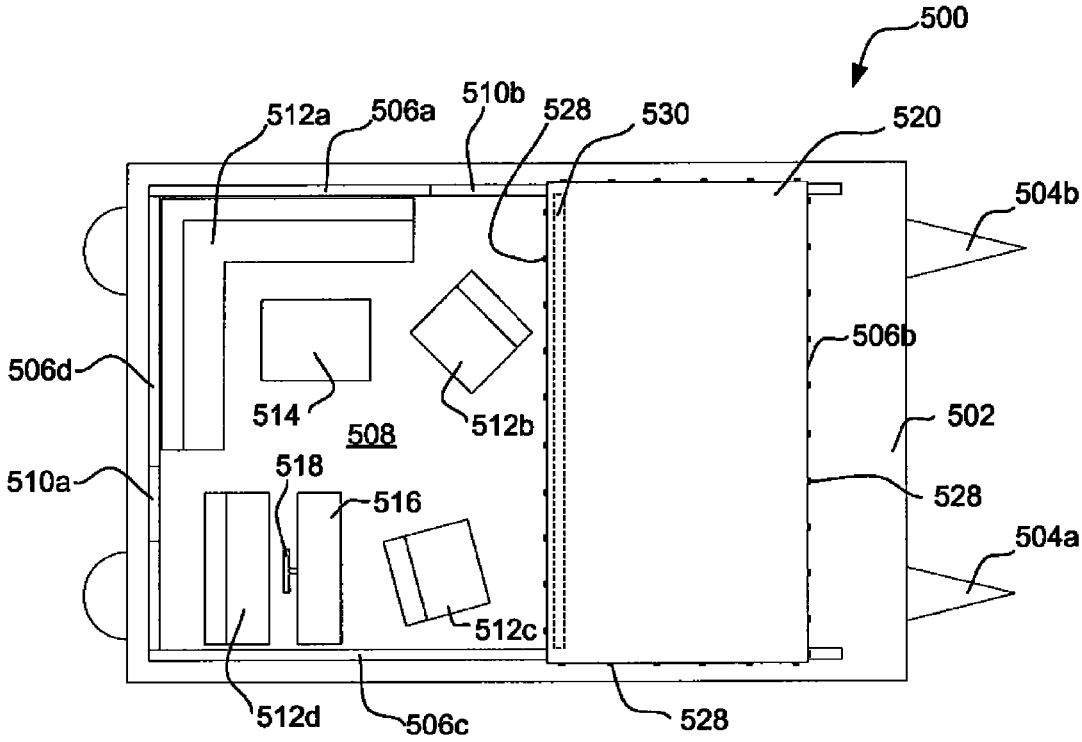
FIG. 17 is a schematic top view of another illustrative pontoon boat.

FIG. 17 is a schematic top view of another illustrative pontoon boat. The illustrative pontoon boat is generally shown at 500, and includes a platform 502 that is positioned above and attached to two (or more) spaced pontoon floats 504*a* and 504*b*. The spaced pontoon floats 504*a* and 504*b* provide floatation for the pontoon boat 500.

One or more side walls, such as side walls 506*a*-506*d*, may extend up from the platform 502 around a perimeter of a protected area 508. In the illustrative embodiment, the protected area 508 is defined by the side walls 506*a*-506*d*. In some cases, some or all of the side walls 506*a*-506*d* may include a door, such as doors 510*a*-510*b*. The doors 510*a*-510*b* may help provide access to/from the protected area 508 of the pontoon boat 500.

One or more seats, tables, sinks, bathrooms, control consoles, wet bars or the like may be provide in the protected area. In the illustrative embodiment, seats 512*a*-512*d*, a table 514 and a control console 516 including a steering wheel 518 are provided in the protected area 508. These, however, are only illustrative. The protected area may also be carpeted in some cases.

In many cases, it is desirable to cover the protected area 508 to help prevent sun, rain, debris and/or other elements or objects from entering the protected area 508 of the pontoon boat 500 when the pontoon boat 500 is not in use. If the protected area 508 is not covered, the sun may cause the seats 512*a*-512, table 514, control console 516 and carpet to deteriorate faster. Also, rain may cause the seats 512*a*-512*d* and other objects in the protected area 508 to become wet, which may be uncomfortable to the users of the boat when the boat is eventually used. Dust, dirt, debris, seedlings and other objects may also enter the protected area 508, which may require extensive cleaning by the boat user prior to its use.

As such, it is often desirable to cover the protected area 508 when the boat is not in use. In the illustrative embodiment, a first cover 520 having a perimeter that extends laterally out to at least some of the side walls 506*a*, 506*b* and 506*c* of the boat and only around part of the perimeter of the protected area 508 to provide a cover for only part of the protected area 508. The first cover 520 may extend over and be secured to the outside surface of side wall 506, as well as along the front portion of side walls 506*a* and 506*b*. The first cover 520 may be a made from a rigid material that can be unsecured and lifted off of the boat 500 by the user, or a more flexible material such as fabric, canvas, plastic sheeting or the like, that can be rolled up or otherwise easily removed from the boat 500. In some cases, the first cover 520 may be a flexible tarp like cover that is fastened to the side walls by buttons, snaps 528, clips, Velcro™ or other attachment mechanism.

In some embodiments, a cross member or support member 530 (shown in dotted lines) may be provided in the space between side wall 506*a* and side wall 506*c*, and along or adjacent to the edge 532 of the first cover 520. The first cover 520 may be secured to the cross member or support 530 along the edge 532 of the first cover 520, sometimes with buttons, snaps 528, clips, Velcro™ or another attachment mechanism, as desired. In some cases, the cross member or support member 530 may be releaseably secured to the side walls 506*a* and 506*c*, and may be used to help support the edge 532 of the first cover 520. In some embodiments, the cross member or support member 530 may be configured to elevate the edge 532 of the first cover 520 so that water does not tend to flow off of the first cover 520 and into the protected area 508 of the boat 500. Alternatively, or in addition, a vertical support 570 may be provided that extends between the platform 502 of the boat 500 and at least part of the first cover 520. The vertical support 570 may help support the first cover 520 above the platform 520. This may be particularly useful in helping to reduce pooling of water or the like on the first cover 520.

Prior to use, the first cover 520 may be removed by unsecuring the first cover 520 from the side walls 506*a*, 506*b* and 506*c*, and when provided, cross member or support member 530 and vertical support 570. Alternatively, the first cover 520 may remain on the boat during use, particularly since a number of seats 512*a*-512*d*, the control console 516 and other amenities are readily available to the user when the first cover 520 is left on the boat 500.

Figure 18A:
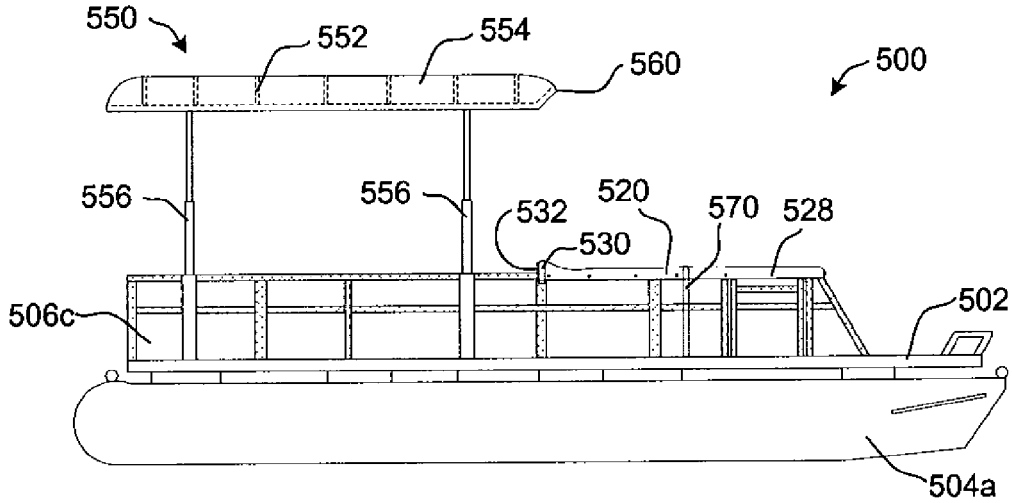
FIG. 18A is a schematic side view of the illustrative pontoon boat of FIG. 17, with part of a cover in a raised position.
Figure 18B:
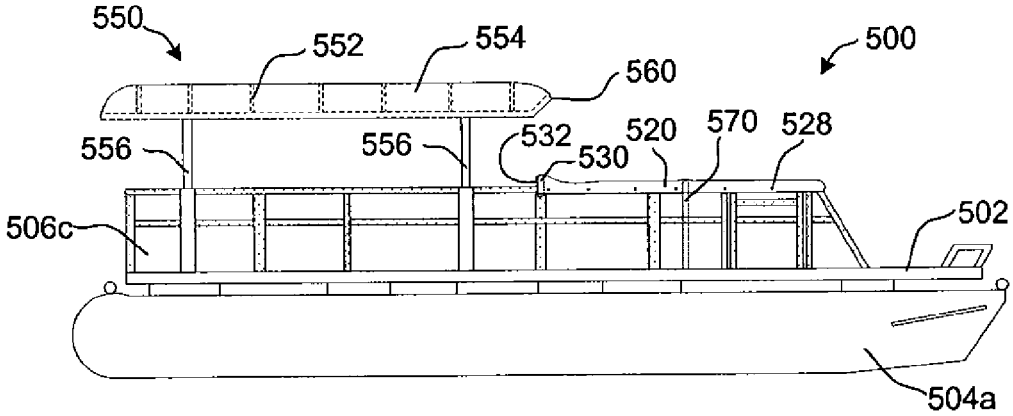
FIG. 18B is a schematic side view of the illustrative pontoon boat of FIG. 17, with part of the cover in an intermediate position.
Figure 18C:
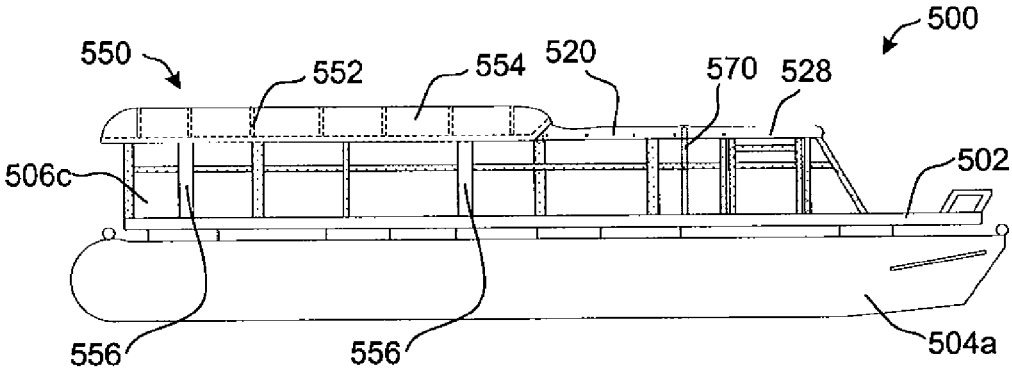
FIG. 18C is a schematic side view of the illustrative pontoon boat of FIG. 17, with part of the cover in a lowered position.

To help provide protection to that portion of the protected area 508 that is not protected by the first cover 520, it is contemplated that a second cover 550 may be provided. FIG. 18A shows an illustrative second cover 550 in a raised position, FIG. 18B shows the second cover 550 in an intermediate position, and FIG. 18C shows the second cover 550 in a lowered position.

In the illustrative embodiment, the second cover 550 has a support frame 552 and a cover 554, wherein the support frame 552 supports the cover 554, although this is not required in all embodiments. The second cover 550 may have one or more cover supports 556 for supporting the second cover 550 above the platform 502 of the boat 550. The one or more cover supports 556 may allow the second cover 550 to be moved between a raised position (see FIG. 18A) and a lowered position (see FIG. 18C).

The second cover 550 may be configured so that in the lowered position (see FIG. 18C), a perimeter of the second cover 550 extends laterally out to at least some of the side walls 506*a*, 506*c* and 506*d* of the boat 500 and only around part of the perimeter of the protected area 508 to provide a cover for at least part of the protected area that is not covered by the first cover 520. In the illustrative embodiment, the second cover 550 may provide a cover for all or substantially all of the protected area 508 that is not covered by the first cover 520.

In some embodiments, the second cover 550 may be adapted to overlap at least part of the first cover 520 when the second cover 550 is in the lowered position. This may help provide a relatively leak free interface along the boundary of the second cover 550 and the first cover 520. In some cases, and as indicated above, a cross member or support member 530 may be provided and configured to elevate the edge 532 of the first cover 520 so that water does not tend to flow off of the first cover 520 and into the protected area 508 of the boat 500. The second cover 550 may be configured to overlap the elevated edge 532 of the first cover 520. In some cases, the front lower edge 560 of the second cover 550 may extend down below the elevated edge 532 of the first cover 520 when the second cover 550 is in the lowered position.

While the one or more cover supports 556 are shown as telescoping support members in FIGS. 18A-18C, it is contemplated that any suitable support members may be used, as desired. Likewise, it is contemplated that the second cover 550 may be moved under human power or using a powered system, as desired.

Like the illustrative embodiments shown above, the second cover 550 may be moved to the raised position (see FIG. 18A) to provide some level or protection to the occupants of the boat in the protected area 508 from the sun and/or other elements, particularly when the sun is directly overhead. When the user does not intend to use the boat, the second cover 550 may be moved to the lowered position (see FIGS. 18B-18C). In the lowered position, the second cover 550 along with the first cover 520 may extend at least out to the side walls (e.g. sidewalls 506*a*-506*c*), and in some cases, may extend over and vertically overlap the top end of the side walls 506*a*-506*c*, around the perimeter of the protected area 508. This may help protect the protected area from the elements when the boat is not in use.

Figure 19A:
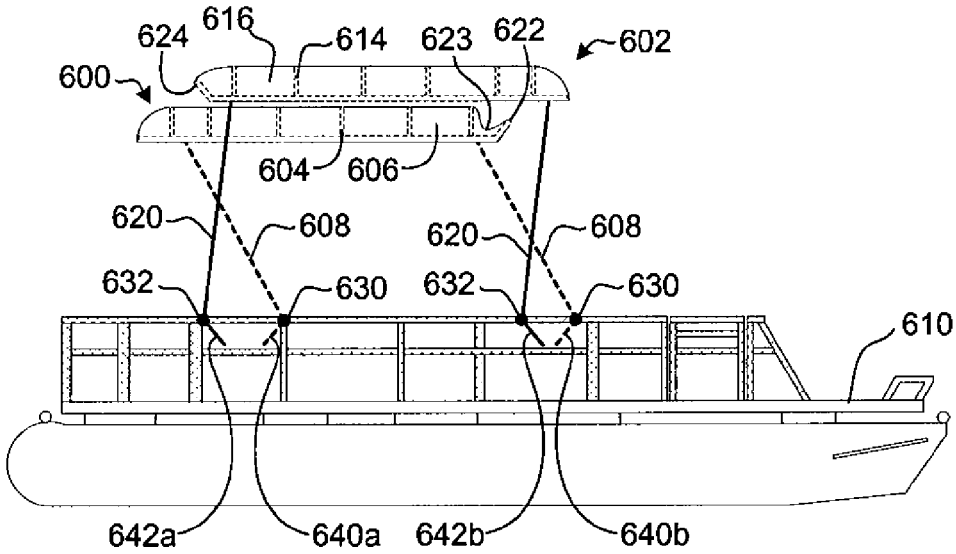
FIG. 19A is a schematic side view of another illustrative pontoon boat, with a cover in a raised position.
Figure 19B:
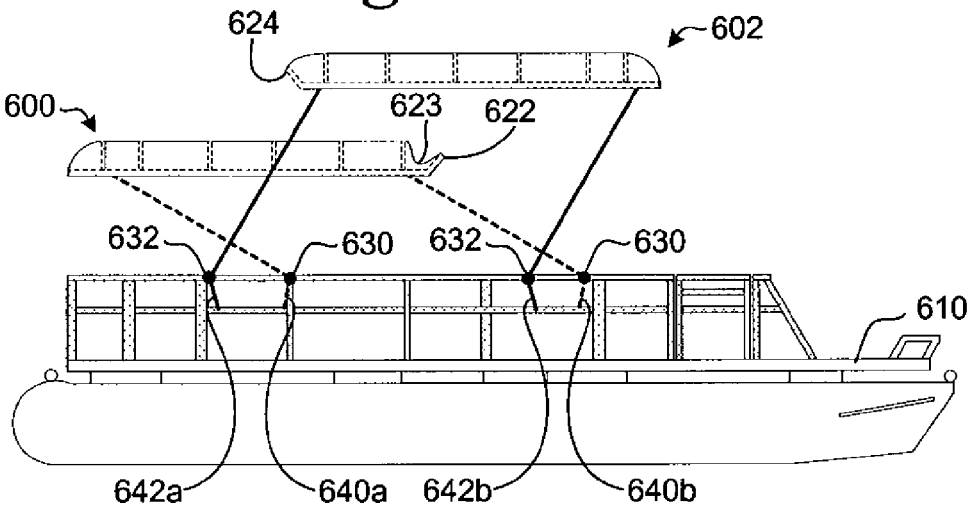
FIG. 19B is a schematic side view of the illustrative pontoon boat of FIG. 19A, with the cover in an intermediate position.
Figure 19C:
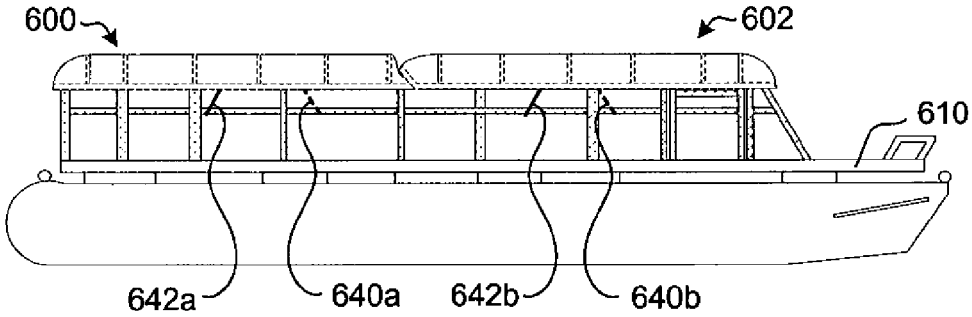
FIG. 19C is a schematic side view of the illustrative pontoon boat of FIG. 19A, with the cover in a lowered position.

FIG. 19A is a schematic side view of another illustrative pontoon boat, with a cover in a raised position. FIG. 19B is a schematic side view of the illustrative pontoon boat of FIG. 19A, with the cover in an intermediate position, and FIG. 19C is a schematic side view of the illustrative pontoon boat of FIG. 19A, with the cover in a lowered position. In this illustrative embodiment, a first cover assembly 600 and a second cover assembly 602 are provided. While two cover assemblies are shown in FIGS. 19A-19C, it is contemplated that more or less than two cover assemblies may be used, as desired.

The first cover assembly 600 is shown having a first support frame 604 and a first cover 606, wherein the first support frame 604 supports the first cover 606. The first cover assembly 600 also has a number of first cover supports 608 (only two starboard side supports are shown for clarity) for supporting the first cover assembly 600 above the platform 610. In the illustrative embodiment, the first cover supports 608 are adapted to allow the first cover assembly 600 to be moved between a raised position (see FIG. 19A) and a lowered position (see FIG. 19C).

Likewise, the second cover assembly 602 is shown having a second support frame 614 and a second cover 616, wherein the second support frame 614 supports the second cover 616. The second cover assembly 602 also has a number of second cover supports 620 (only two starboard side supports are shown for clarity) for supporting the second cover assembly 602 above the platform 610. In the illustrative embodiment, the second cover supports 620 are adapted to allow the second cover assembly 602 to be moved between a raised position (see FIG. 19A) and a lowered position (see FIG. 19C).

In the lowered position, and as shown in FIG. 19C, a perimeter of the first cover assembly 600 may extend laterally out to at least some of the side walls of the boat and only around part of the perimeter of the protected area to provide a cover for a first part of the protected area. Likewise, a perimeter of the second cover assembly 602 may extend laterally out to at least some of the side walls of the boat and only around part of the perimeter of the protected area to provide a cover for a second part of the protected area. In some embodiments, when the first and second cover assemblies 600 and 602 are in their lowered position, the first cover assembly 600 provides a cover for a first part of the protected area, and the second cover assembly 602 provides a cover for all or substantially all of the protected area that is not covered by the first cover assembly 600. In some cases, three or more cover assemblies may be used, wherein collectively, the three or more cover assemblies provide a cover for all or substantially all of the protected area. In yet other embodiments, one or more covers similar to cover 520 of FIG. 17 may be provided to cover part of the protected area, while one, two or more cover assemblies, which can be moved between a raised position and a lowered position, may collectively provide a cover for the remainder of the protected area.

In some embodiments, the second cover assembly 602 may be adapted to overlap at least part of the first cover assembly 600, or visa-versa, when the first and second cover assemblies 600 and 602 are in their lowered position. This may help provide a relatively leak free interface along the boundary between the first and second cover assemblies 600 and 602. In some cases, and as shown in FIGS. 19A-19C, the forward end of the first cover assembly 600 may be configured to have a trough 623 followed by a crest 622. The second cover assembly 602 may be configured to overlap the crest 622 of the first cover assembly 600, as best shown in FIG. 19C. In some cases, the rear lower edge 624 of the second cover 602 may extend down in the trough 623 and below the crest 622 of the first cover assembly 600 when the first and second cover assemblies 600 and 602 are in their lowered position, but this is not required.

In the illustrative embodiment, the first cover assembly 600 is supported by a number of first cover supports 608 (only two starboard side supports are shown for clarity) for supporting the first cover assembly 600 above the platform 610. The first cover supports 608 are shown rotationally mounted to the side wall of the pontoon boat around pivot points 630, and also rotationally mounted to the first cover assembly 600. Similarly, the second cover assembly 602 is shown supported by a number of second cover supports 620 (only two starboard side supports are shown for clarity) for supporting the second cover assembly 602 above the platform 610. The second cover supports 620 are also shown rotationally mounted to the side wall of the pontoon boat around pivot points 632, and also rotationally mounted to the second cover assembly 602.

In this configuration, the first cover assembly 600 may be rotated up and moved in a forward direction as the first cover assembly 600 is moved from its lowered position to its raised position. Likewise, the second cover assembly 602 may be rotated up and moved in a rearward direction as the second cover assembly 602 is moved from its lowered position to its raised position. In some cases, the first cover supports 608 may be of a different length than the second cover supports 620, which may allow the first cover assembly 600 to extend above or below and overlap in a horizontal direction the second cover assembly 602, when the first and second cover assemblies are in their raised positions (see FIG. 19A). This may be desirable in those cases where the user may want some direct sun exposure in the protected area when the boat is in use. While rotationally mounted cover supports are shown in FIGS. 19A-19C, it is contemplated that any suitable moving mechanism may be used to move the first and second cover assemblies in a same or similar manner. For example, a hydraulic, cable or other suitable moving mechanism may be used to achieve a same or similar result, if desired.

In the illustrative embodiment shown in FIGS. 19A-19C, the first cover supports 608 have support extension 640*a* and 640*b* that extend down below the pivot points 630. These support extensions may help provide leverage for a driving mechanism when the driving mechanism drives the first cover assembly 600 between the lowered and raised position. Likewise, the second cover supports 620 may have support extension 642*a* and 642*b* that extend down below the pivot points 632. These support extensions may also provide leverage for a driving mechanism when the driving mechanism drives the second cover assembly 602 between the lowered and raised position.

Figure 20:
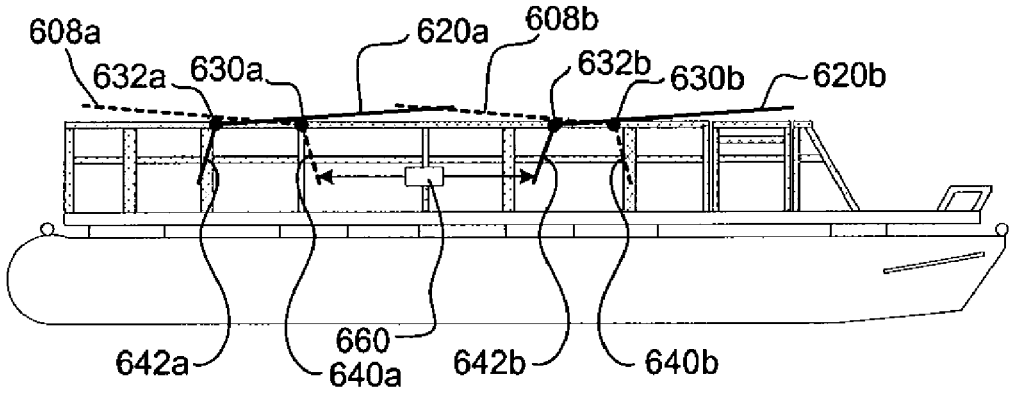
FIG. 20 is a schematic side view of an illustrative pontoon boat with cover supports similar to that shown in FIGS. 19A-19C in a lowered position, and an illustrative moving mechanism for moving the cover supports.

FIG. 20 is a schematic side view of an illustrative pontoon boat with cover supports similar to that shown in FIGS. 19A-19C in a lowered position, and an illustrative moving mechanism for moving the cover supports. The corresponding cover assemblies are not shown for clarity. However, it is contemplated that the top end of the cover supports 608 may be rotationally coupled to a first cover assembly, and the top end of the cover supports 620 may be rotationally coupled to a second cover assembly, similar to that shown in FIGS. 19A-19C.

In the illustrative embodiment shown in FIG. 20, a drive mechanism 660 may be fixed to the boat, and may provide rearward movement to the support extension 640*a*, and may provide forward movement to support extension 642*b*. Rearward movement of the support extension 640*a* will cause the rear cover support 608*a* to rotate about pivot point 630*a*, and raise the first cover assembly 600 (not shown in FIG. 20). Because the forward cover support 608*b* is also coupled to the first cover assembly 600 (see FIGS. 19A-19C), the forward cover support 608*b* will also rotate about its pivot point 630*b*, thereby raising the first cover assembly 600 (see FIGS. 19A-19C) from its lowered position to its raised position.

Likewise, forward movement of the support extension 642*b* will cause the front cover support 620*b* to rotate about pivot point 632*b*, and raise the second cover assembly 602 (not shown in FIG. 20). Because the rear cover support 620*a* is also coupled to the second cover assembly 602 (see FIGS. 19A-19C), the rear cover support 620*a* will also rotate about its pivot point 632*a*, thereby raising the second cover assembly 602 (see FIGS. 19A-19C) from its lowered position to its raised position. To lower the cover assemblies, the drive mechanism 660 may move the support extensions in the opposite direction.

The drive mechanism 660 may be any suitable drive mechanism. In some cases, the drive mechanism 660 may be human powered. A crank, a wench, simply pushing and/or pulling the cover assemblies or support extensions 640*a* and 642*b*, and/or using any other suitable human powered moving mechanism 660 or method may be employed. Springs or compressed cylinders may be provided in the moving mechanism 660 or elsewhere to assist in the raising and/or lowering of the cover assemblies, if desired. In other cases, the moving mechanism 660 can include a powered system, such as a motor or pump. When a motor or pump is used, motion and/or energy from the motor or pump may be transferred to the respective support extensions 640*a* and 642*b* using one or more belts, cables, screw drives, shafts, hydraulic cylinders, pulleys, gears, tubes and/or any other suitable system or method, as desired. It is contemplated that a similar moving mechanism may be provided on the port side of the boat (not explicitly shown in FIG. 20) to further assist in raising and/or lowering the cover assemblies, if desired.

Figure 21:
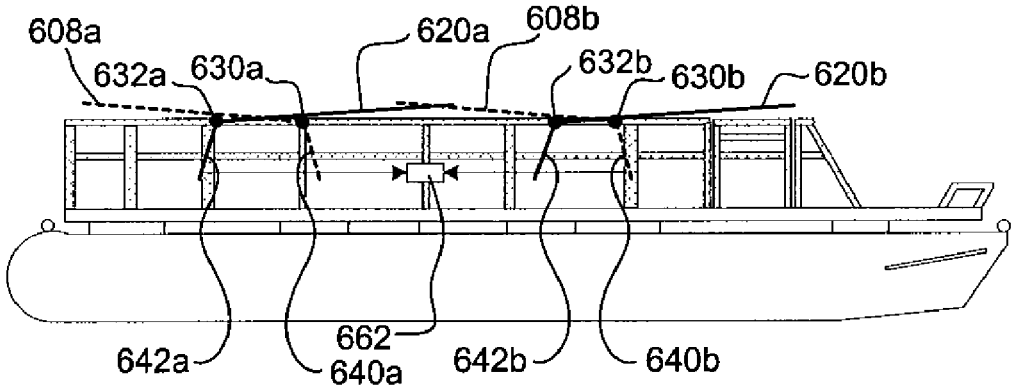
FIG. 21 is a schematic side view of an illustrative pontoon boat with cover supports similar to that shown in FIGS. 19A-19C in a lowered position, and another illustrative moving mechanism for moving the cover supports.

FIG. 21 is a schematic side view of an illustrative pontoon boat with cover supports similar to that shown in FIGS. 19A-19C in a lowered position, and another illustrative moving mechanism for moving the cover supports. As in FIG. 20, the corresponding cover assemblies are not shown for clarity. However, it is contemplated that the top end of the cover supports 608 may be rotationally coupled to a first cover assembly, and the top end of the cover supports 620 are rotationally coupled to a second cover assembly, similar to that shown in FIGS. 19A-19C.

In the illustrative embodiment shown in FIG. 21, a drive mechanism 662 may be fixed to the boat, and may provide rearward movement to the support extension 640*b*, and may provide forward movement to support extension 642*a*. Rearward movement of the support extension 640*b* will cause the front cover support 608*b* to rotate about pivot point 630*b*, and raise the first cover assembly 600 (not shown in FIG. 21). Because the rearward cover support 608*a* is also coupled to the first cover assembly 600 (see FIGS. 19A-19C), the rearward cover support 608*a* will also rotate about its pivot point 630*a*, thereby raising the first cover assembly 600 (see FIGS. 19A-19C) from its lowered position to its raised position.

Likewise, forward movement of the support extension 642*a* will cause the rear cover support 620*a* to rotate about pivot point 632*a*, and raise the second cover assembly 602 (not shown in FIG. 21). Because the forward cover support 620*b* is also coupled to the second cover assembly 602 (see FIGS. 19A-19C), the front cover support 620*b* will also rotate about its pivot point 632*b*, thereby raising the second cover assembly 602 (see FIGS. 19A-19C) from its lowered position to its raised position. To lower the cover assemblies, the drive mechanism 662 may move the support extensions in the opposite direction.

The drive mechanism 662 may be any suitable drive mechanism. In some cases, the drive mechanism 662 may be human powered. A crank, a wench, simply pushing and/or pulling the cover assemblies or support extensions 640*b* and 642*a*, and/or using any other suitable human powered moving mechanism 662 or method may be employed. Springs or compressed cylinders may be provided in the moving mechanism 662 or elsewhere to assist in the raising and/or lowering of the cover assemblies, if desired. In other cases, the moving mechanism 662 can include a powered system, such as a motor or pump. When a motor or pump is used, motion and/or energy from the motor or pump may be transferred to the respective support extensions 640*b* and 642*a* using one or more belts, cables, screw drives, shafts, hydraulic cylinders, pulleys, gears, tubes and/or any other suitable system or method, as desired. It is contemplated that a similar moving mechanism may be provided on the port side of the boat (not explicitly shown in FIG. 21) to further assist in raising and/or lowering the cover assemblies, if desired.

Figure 22:
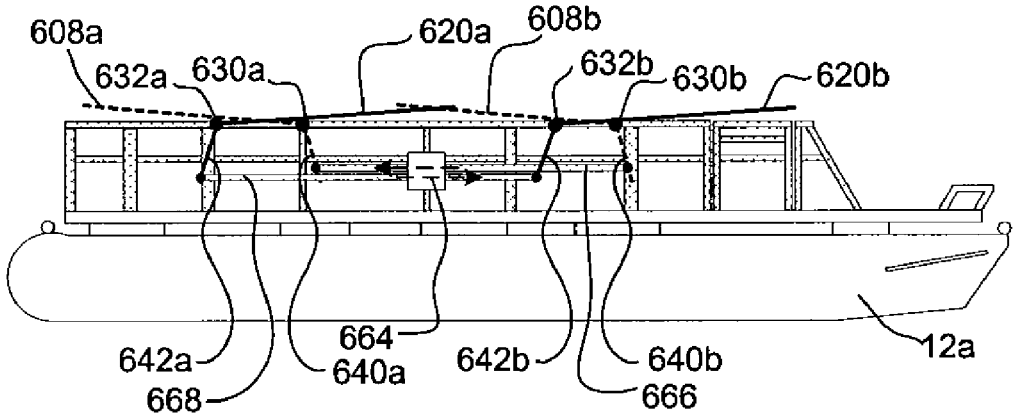
FIG. 22 is a schematic side view of an illustrative pontoon boat with cover supports similar to that shown in FIGS. 19A-19C in a lowered position, and another illustrative moving mechanism for moving the cover supports.

FIG. 22 is a schematic side view of an illustrative pontoon boat with cover supports similar to that shown in FIGS. 19A-19C in a lowered position, and another illustrative moving mechanism for moving the cover supports. As in FIGS. 20-21, the corresponding cover assemblies are not shown for clarity. However, it is contemplated that the top end of the cover supports 608 may be rotationally coupled to a first cover assembly, and the top end of the cover supports 620 are rotationally coupled to a second cover assembly, similar to that shown in FIGS. 19A-19C.

In the illustrative embodiment shown in FIG. 22, a drive mechanism 664 may be fixed to the boat, and may provide rearward movement to the support extensions 640*a* and 640*b*, and may provide forward movement to support extension 642*a* and 642*b*. A first bar or rod 666 may be used to couple the support extensions 640*a* and 640*b* together, and the drive mechanism 664 may move the first bar or rod 666 in a rearward direction to move the first cover assembly from a lowered position to a raised position. A second bar or rod 668 may be used to couple the support extensions 642*a* and 642*b* together, and the drive mechanism 664 may move the second bar or rod 668 in a forward direction to move the second cover assembly from a lowered position to a raised position. In some cases, the moving mechanism 664 may move the first bar or rod 666 and the second bar or rod 668 in unison, while in other cases, the moving mechanism 664 may provide independent control to the movement of the first bar or rod 666 and the second bar or rod 668.

Rearward movement of the first bar or rod 666 will cause the cover supports 608*a* and 608*b* to rotate about pivot points 630*a* and 630*b*, respectively, and raise the first cover assembly 600 (not shown in FIG. 22). Likewise, forward movement of the second bar or rod 668 will cause the cover supports 620*a* and 620*b* to rotate about pivot points 632*a* and 632*b*, respectively, and raise the second cover assembly 602 (not shown in FIG. 22). To lower the cover assemblies, the drive mechanism 664 may move the first bar or rod 666 and the second bar or rod 668 in the opposite direction.

The drive mechanism 664 may be any suitable drive mechanism. In some cases, the drive mechanism 664 may be human powered. A crank, a wench, simply pushing and/or pulling the cover assemblies or the first and second bar or rods, and/or using any other suitable human powered moving mechanism 664 or method may be employed. Springs or compressed cylinders may be provided in the moving mechanism 664 or elsewhere to assist in the raising and/or lowering of the cover assemblies, if desired. In other cases, the moving mechanism 664 can include a powered system, such as a motor or pump. When a motor or pump is used, motion and/or energy from the motor or pump may be transferred to the respective the first and second bar or rods using one or more belts, cables, screw drives, shafts, hydraulic cylinders, pulleys, gears, tubes and/or any other suitable system or method, as desired. It is contemplated that a similar moving mechanism may be provided on the port side of the boat (not explicitly shown in FIG. 22) to further assist in raising and/or lowering the cover assemblies, if desired.

Figure 23A:
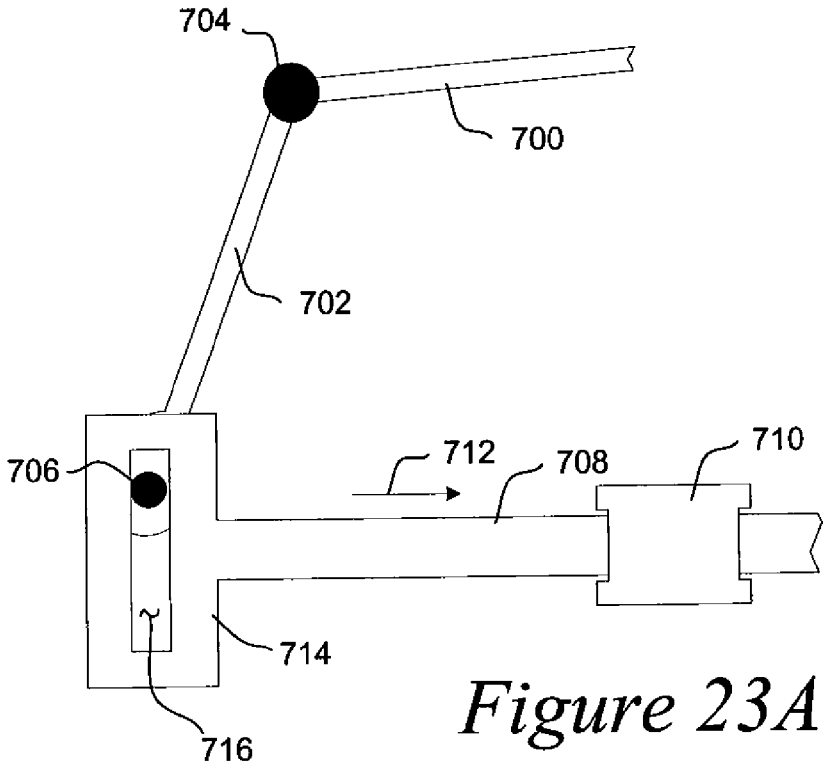
FIGS. 23A-23C are schematic side views of an illustrative cover support and an illustrative moving shaft for moving the cover support between a raised and a lowered position.
Figure 23B:
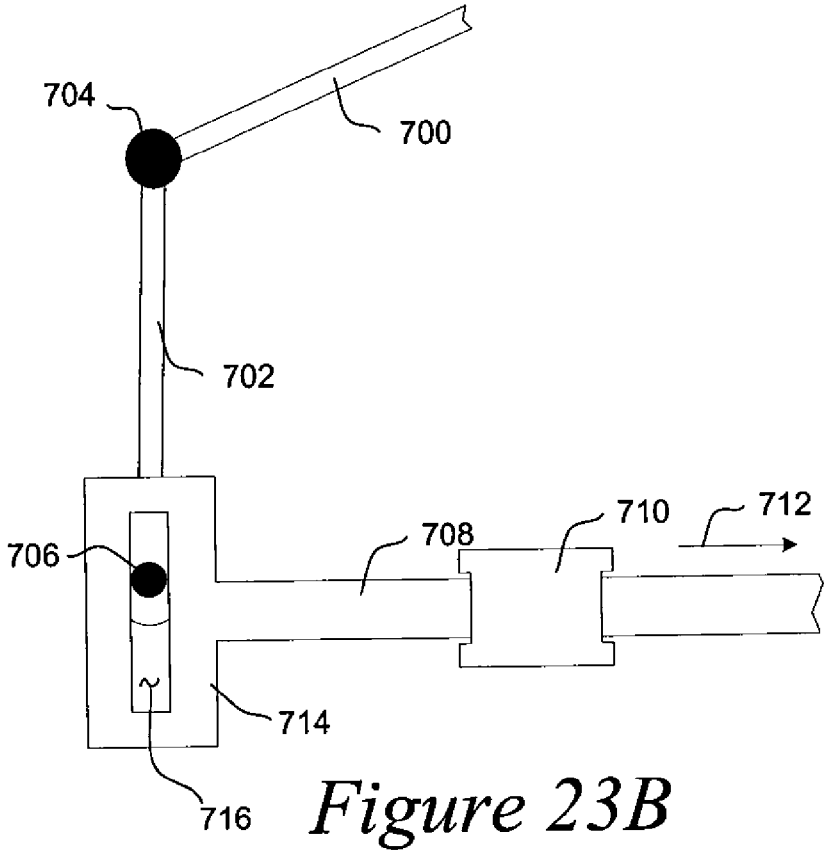
Figure 23C:
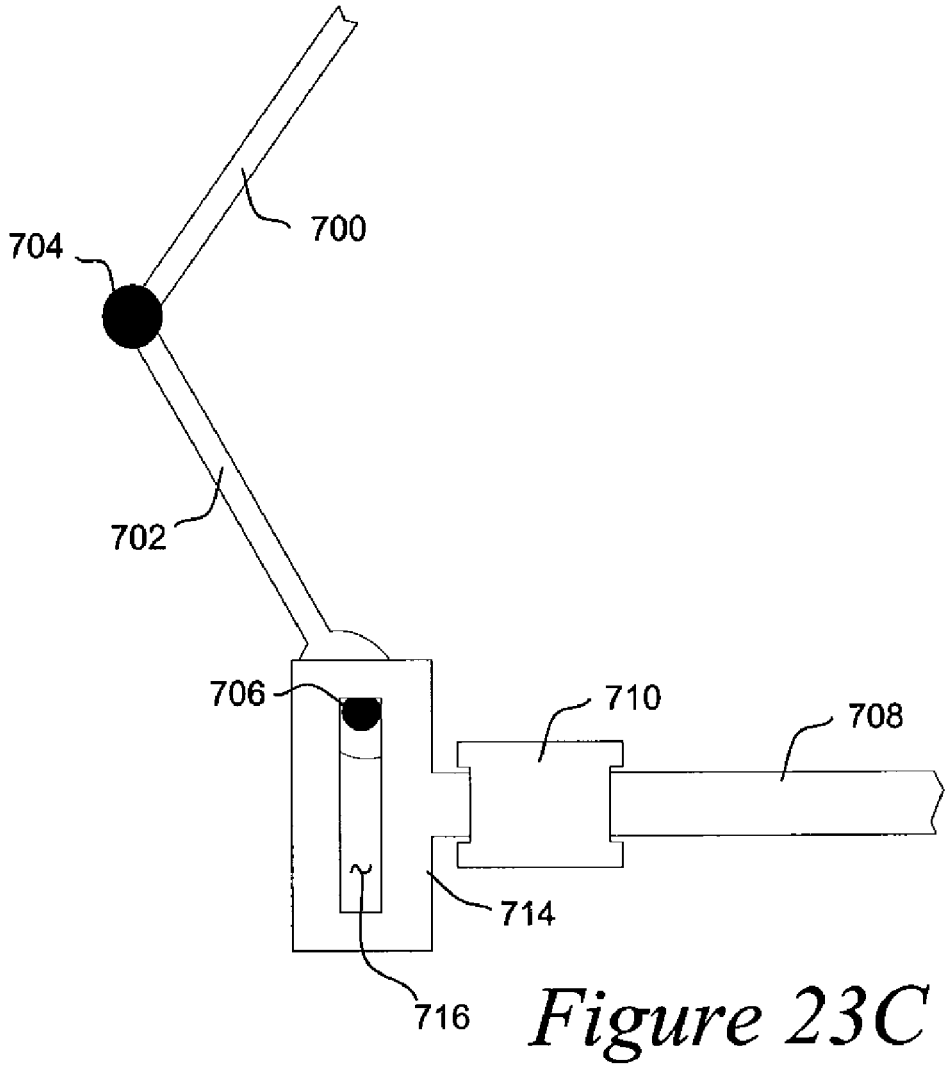

FIGS. 23A-23C are schematic side views of an illustrative cover support and an illustrative moving shaft for moving the cover support between a raised and a lowered position. Briefly referring back to FIG. 20, when the support extension 640*a* is moved in a rearward direction, or the support extension 642*b* is moved in the forward direction, the support extensions will tend to move in an arc about their respective pivot points. In some embodiments, it may be desirable to fix the moving mechanism (such as moving mechanisms 660, 662 and/or 664) relative to the boat.

FIG. 23A shows an illustrative cover support 700 that is fixed to the boat at a pivot point 704. The illustrative cover support 700 also includes a support extension 702. The support extension includes a pin 706 or the like that extends in a direction out of the page, and may include a cotter pin or the like at the end of the pin. A moving mechanism (not shown) may be adapted to move a moving shaft 708 in a horizontal direction, as shown at 712. A shaft guide 710 may be provided to help guide the shaft 708 along the desired horizontal path and provide additional support to the moving shaft 708. Like the moving mechanism (not shown), the shaft guide 710 may be fixed relative to the boat. One end 714 of the moving shaft 708 may include a vertical slot 716 that is adapted to receive the pin 706 of the support extension 702. The cotter pin or the like may secure the support extension 702 to the moving shaft 708 via the pin 706.

In this configuration, the moving shaft 708 may move the support extension 702 in a left and/or right direction, causing the cover support 700 to move between a lowered and raised position. When the moving shaft 708 moves the support extension 702 in the rightward direction, as shown at 712, the pin 706 will tend to move in the rightward direction. However, at least initially, the pin will also tend to move in a downward direction (along an arc), as shown in FIG. 23B. In FIG. 23B, the support extension 702 has been moved to the right, the cover support 700 has moved to an intermediate position, and the pin 706 has moved to just below the pivot point 704 and downward in the slot 716.

As the moving shaft 708 continues to move the support extension 702 in the rightward direction, the pin 706 will continue to move in the rightward direction, and may begin to move in an upward direction, as shown in FIG. 23C. In FIG. 23C, the support extension 702 has been moved to the right, the cover support 700 has been moved to a raised position, and the pin 706 has moved right of the pivot point 704 and upward to the top edge of the slot 716. In some cases, the top edge of the slot may be positioned and configured to provide an end stop for movement of the support extension 702 and thus the cover support 700. In some cases, the position of the top edge of the slot may be made adjustable, if desired. FIGS. 23A-23C show one illustrative method for moving the support extensions shown in FIGS. 20-22. However, it is contemplated that any suitable method may be used, as desired.

Figure 24:
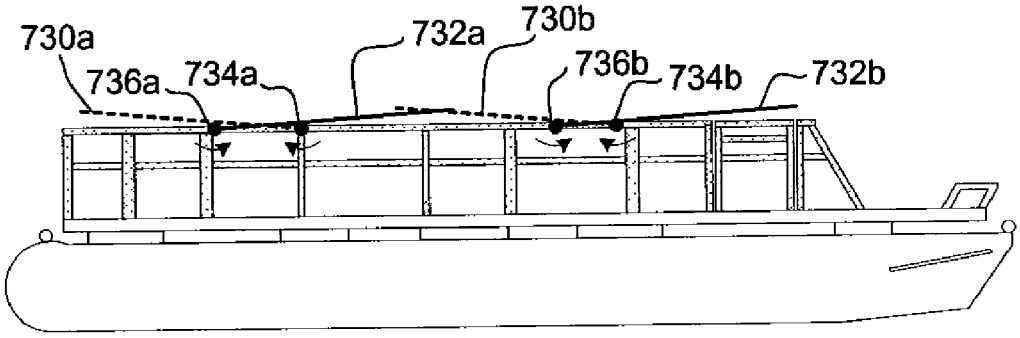
FIG. 24 is a schematic side view of an illustrative pontoon boat with cover supports in a lowered position.

FIG. 24 is a schematic side view of an illustrative pontoon boat with cover supports in a lowered position. FIG. 24 is similar to FIG. 20, except that the cover supports are moved by rotating the cover supports at or near their corresponding pivot points. For example, cover supports 730*a* and 730*b* may be moved by rotating the cover supports at or near their pivot points 734*a* and 734*b*, respectively. Likewise, cover supports 732*a* and 732*b* may be moved by rotating the cover supports at or near their pivot points 736*a* and 736*b*, respectively. It is contemplated that any suitable mechanism may be employed for rotating the cover supports, including rotating the cover supports with a hand crank, an electric motor sometimes with gears, a chain drive, a pneumatic drive, a hydraulic drive, or any other suitable mechanism, as desired.

Figure 25:
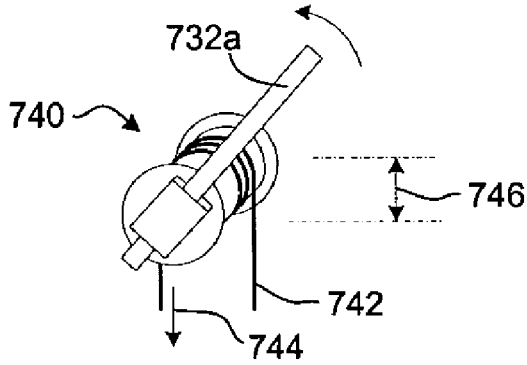
FIG. 25 is a schematic perspective view of an illustrative moving mechanism for moving the cover supports of FIG. 24.

FIG. 25 is a schematic perspective view of an illustrative moving mechanism for rotating the cover supports of FIG. 24. The illustrative moving mechanism of FIG. 25 includes a spindle 740 that is rotatably secured to the boat at a pivot point, such as pivot point 736*a* of FIG. 24. A cover support, such as cover support 732*a* of FIG. 24, is secured to one end of the spindle 740. Thus, as the spindle 740 rotates in a counter clockwise direction, the cover support 732*a* is rotated from a lowered position to a raised position.

A cable 742 is show wrapped around the spindle 740. When a driving mechanism (not shown) pulls one end of the cable 742 in a downward direction as shown at 744, the spindle 740 rotates in a counter clockwise direction thereby moving the cover support 732*a* from a lowered position to a raised position. If the spindle 740 is allowed to move or is driven in a clockwise direction, the cover support 732*a* is moved from a raised position to a lowered position.

The spindle 740 may have a diameter 746. In some cases, the diameter 746 of the spindles used for the different cover supports may differ to provide different movement rates. For example, and referring to FIGS. 19A-19C, the front cover assembly 602 may need to be moved further (in degrees) when going from the lowered position to the raised position than the rear cover assembly 600. In such a case, and with respect to the illustrative moving mechanism of FIG. 25, the diameter of the spindles used for moving the front cover assembly may be smaller than the diameter of the spindles used for moving the rear cover assembly, but this is not required.

Figure 26:
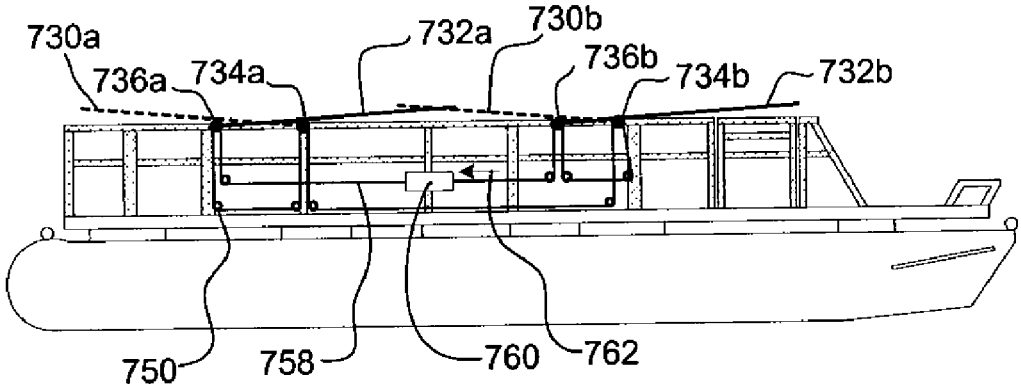
FIG. 26 is a schematic side view of an illustrative pontoon boat with cover supports in a lowered position and an illustrative moving mechanism for moving the cover supports.

FIG. 26 is a schematic side view of an illustrative pontoon boat with cover supports in a lowered position and an illustrative moving mechanism for moving the cover supports. In FIG. 26, a spindle similar to that shown in FIG. 25, may be coupled to cover supports 730*a*, 730*b*, 732*a* and 732*b* and mounted at pivot points 734*a*, 734*b*, 736*a*, and 736*b*. Pulleys, such as pulley 750, may be mounted to the side wall of the boat, and a cable 758 may be strung along the pulleys and spindles, as shown. A drive mechanism 760 may be used to move the cable 758 to move the cover supports 730*a*, 730*b*, 732*a* and 732*b* between their lowered and raised position. In the illustrative embodiment, the drive mechanism may move the cable 758 in one direction 762 to move the cover supports 730*a*, 730*b*, 732*a* and 732*b* from their lowered positions to their raised positions, and in the opposite direction to move the cover supports 730*a*, 730*b*, 732*a* and 732*b* from their raised positions to their lowered positions. It is contemplated that a similar moving mechanism may be provided on the port side of the boat (not explicitly shown in FIG. 26) to further assist in raising and/or lowering the cover supports 730*a*, 730*b*, 732*a* and 732*b*, but this is not required.

Figure 27:
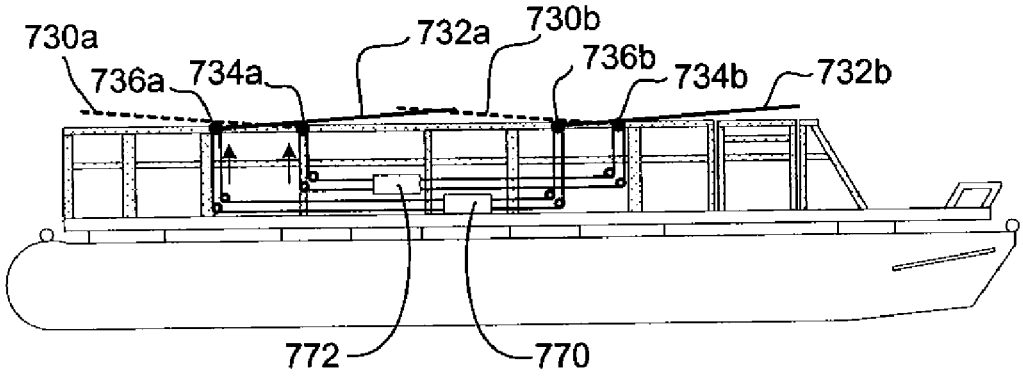
FIG. 27 is a schematic side view of an illustrative pontoon boat with cover supports in a lowered position and another illustrative moving mechanism for moving the cover supports.

FIG. 27 is a schematic side view of an illustrative pontoon boat with cover supports in a lowered position and another illustrative moving mechanism for moving the cover supports. This illustrative embodiment is similar to that shown and described above with respect to FIG. 26, but includes two independent drive mechanisms. A first drive mechanism 770 is adapted to move cover supports 730*a* and 730*b* between their lowered and raised positions, and a second drive mechanism 772 is adapted to move cover supports 732*a* and 732*b* between their lowered and raised positions. This may provide independent control over movement of a rear cover assembly (e.g. attached to the cover supports 730*a* and 730*b*) and a front cover assembly (e.g. attached to cover supports 732*a* and 732*b*), when desired.

Figure 28A:
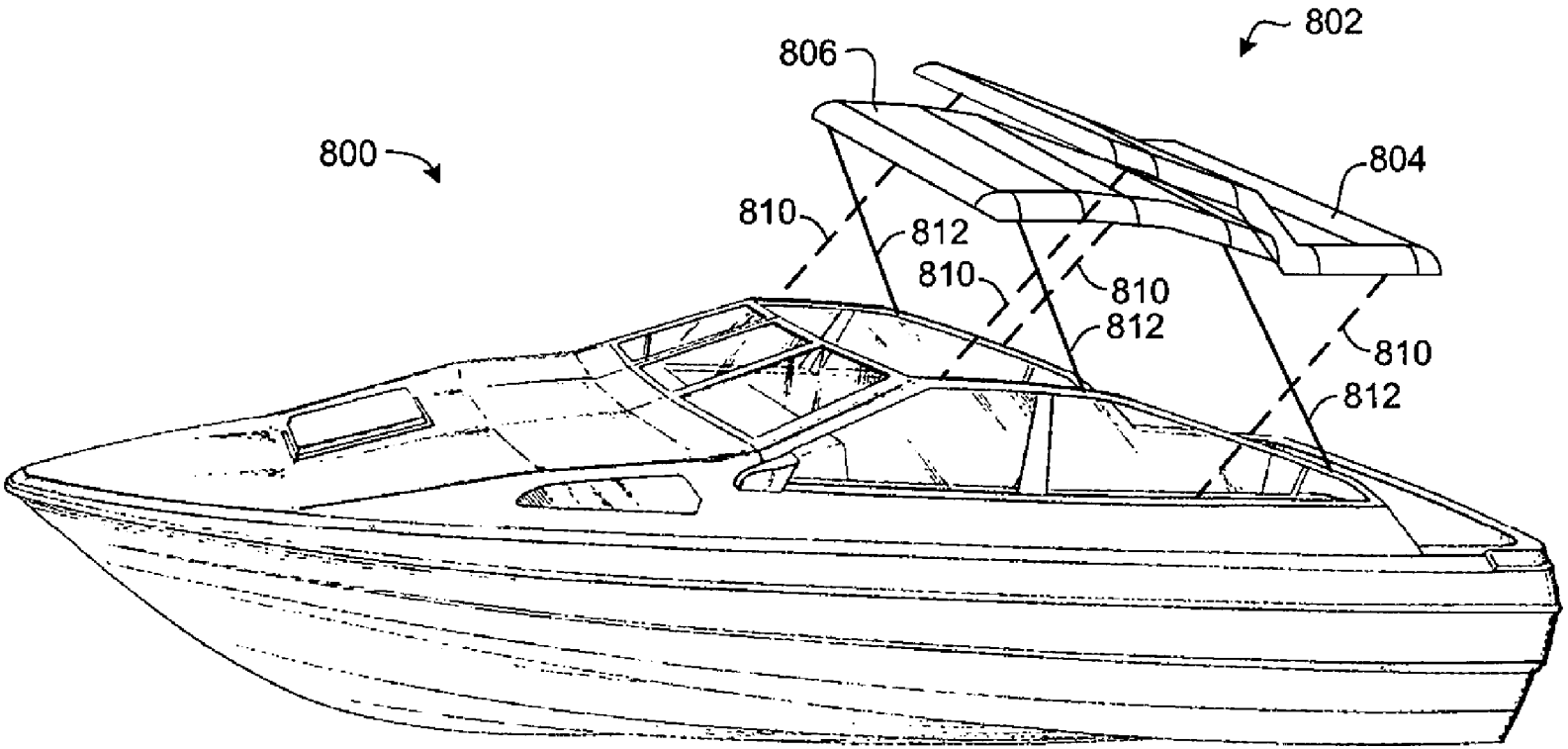
FIG. 28A is a schematic side view of an illustrative boat, with a cover in a raised position.
Figure 28B:
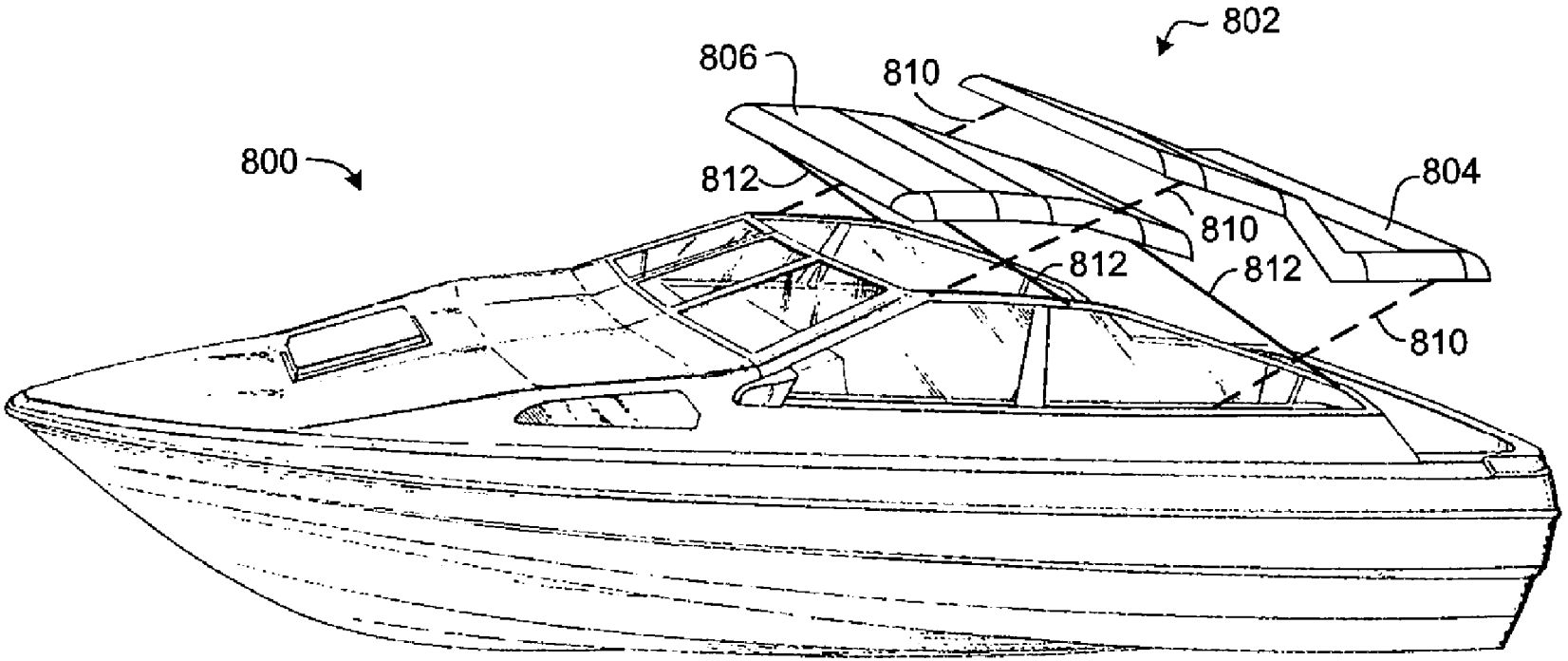
FIG. 28B is a schematic side view of the illustrative boat of FIG. 28A, with the cover in an intermediate position.
Figure 28C:
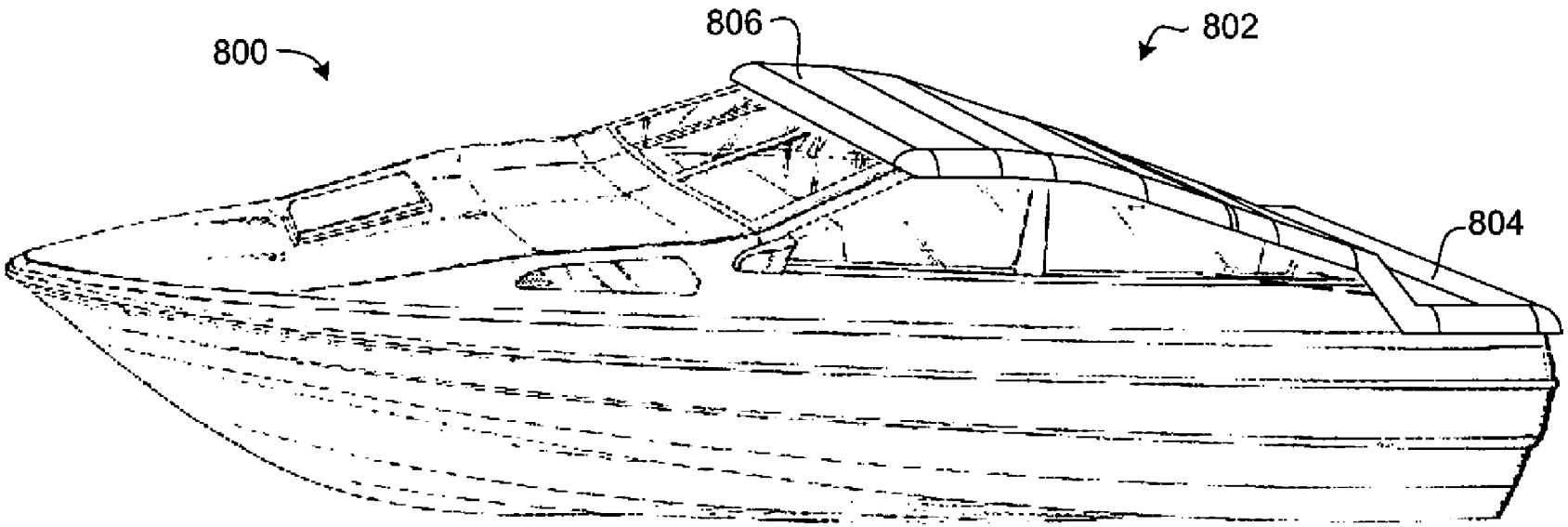
FIG. 28C is a schematic side view of the illustrative pontoon boat of FIG. 28A, with the cover in a lowered position.

FIG. 28A is a schematic side view of an illustrative boat, with a cover in a raised position. FIG. 28B is a schematic side view of the illustrative boat of FIG. 28A, with the cover in an intermediate position, and FIG. 28C is a schematic side view of the illustrative pontoon boat of FIG. 28A, with the cover in a lowered position. As noted above, it is contemplated that the various embodiments of the present invention may be used in conjunction with any type of boat including recreational speed type boats, fishing boats of all sizes, cruisers, and/or any other type of boat, as desired. FIG. 28 shows a small cruiser 800 outfitted with one illustrative cover system.

The illustrative cruiser 800 includes a boat cover system 802 that may provide some level of protection to the interior of the cruiser 800 when the cruiser 800 is not in use, and in some cases, also provide some level of protection to the occupants of the cruiser 800 from the sun, rain and/or other elements when the cruiser 800 is in use. In the illustrative embodiment, the boat cover system 802 includes a cover, at least part of which can be moved between a raised position (see FIG. 28A) and a lowered position (see FIG. 28C). In the lowered position (see FIG. 28C), the cover 802 may provide some level of protection to the interior of the cruiser 800 when the cruiser 800 is not in use, and in the raised position (see FIG. 28A), the cover 802 may provide some level of protection to the occupants of the cruiser 800 from the sun, rain and/or other elements when the cruiser 800 is in use.

In the illustrative embodiment shown, the cruiser 800 includes a first cover assembly 804 and a second cover assembly 806. While two cover assemblies are shown, it is contemplated that more or less than two cover assemblies may be used, as desired. The first cover assembly 804 is shown having a number of first cover supports 810 for supporting the first cover assembly 804 above the floor of the cruiser 800. The first cover supports 810 may be adapted to allow the first cover assembly 804 to be moved between a raised position (see FIG. 28A) and a lowered position (see FIG. 28C).

Likewise, the second cover assembly 806 is shown having a number of second cover supports 812 (the starboard-aft cover support is not shown for clarity) for supporting the second cover assembly 806 above the floor of the cruiser 800. The second cover supports 812 may be adapted to allow the second cover assembly 806 to be moved between a raised position (see FIG. 28A) and a lowered position (see FIG. 28C).

In the lowered position, and as shown in FIG. 28C, a perimeter of the first cover assembly 804 may extend laterally out to at least some of the side walls of the cruiser 800 and only around part of the perimeter of the protected area (i.e. passenger compartment) to provide a cover for a first part of the protected area. Likewise, a perimeter of the second cover assembly 806 may extend laterally out to at least some of the side walls of the cruiser 800 and only around part of the perimeter of the protected area (i.e. passenger compartment) to provide a cover for a second part of the protected area. In some embodiments, when the first and second cover assemblies 804 and 806 are in their lowered position (see FIG. 28C), the first cover assembly 804 provides a cover for a first part of the protected area (i.e. passenger compartment), and the second cover assembly 806 provides a cover for all or substantially all of the protected area (i.e. passenger compartment) that is not covered by the first cover assembly 804. In some cases, three or more cover assemblies may be used, wherein collectively, the three or more cover assemblies provide a cover for all or substantially all of the protected area (i.e. passenger compartment) of the cruiser 800. In yet other embodiments, one or more covers similar to cover 520 of FIG. 17 may provide a cover for part of the protected area (i.e. passenger compartment), while one, two or more cover assemblies, which can be moved between a raised position and a lowered position, may collectively provide a cover for the remainder of the protected area (i.e. passenger compartment).

In some embodiments, the first cover assembly 804 may be adapted to overlap at least part of the second cover assembly 806, or visa-versa, when the first and second cover assemblies 804 and 806 are in their lowered position. This may help provide a relatively leak free interface along the boundary between the first and second cover assemblies 804 and 806.

Figure 29:
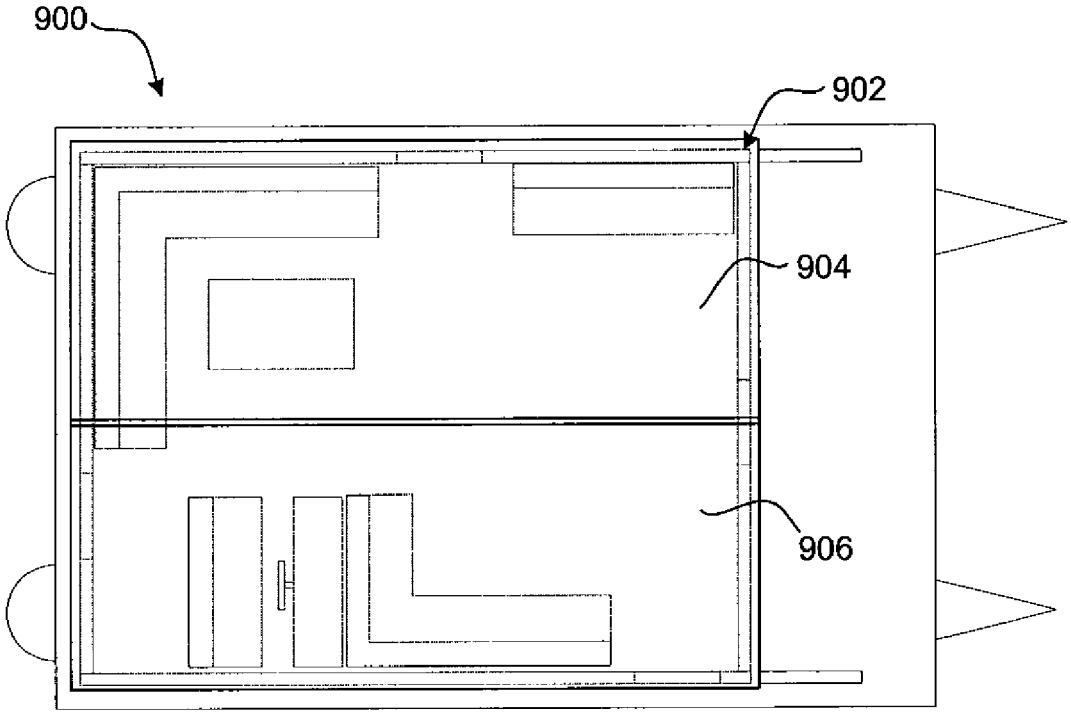
FIG. 29 is a schematic top view of another illustrative pontoon boat with a retractable cover.
Figure 30A:
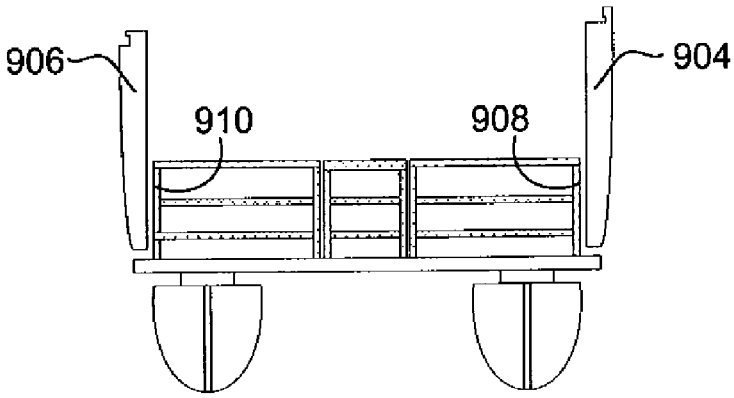
FIG. 30A is a schematic front view of the illustrative pontoon boat of FIG. 29, with the cover in a retracted position.

FIG. 29 is a schematic top view of another illustrative pontoon boat 900 with an illustrative retractable cover 902. The illustrative retractable cover 902 includes a port side portion 904 and a starboard side portion 906. FIG. 30A is a schematic front view of the illustrative pontoon boat 900 of FIG. 29, with the retractable cover in a retracted position.

Figure 30B:
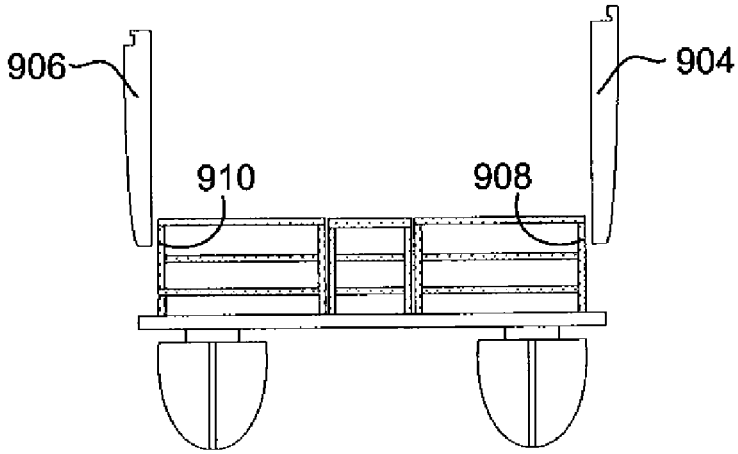
FIG. 30B is a schematic front view of the illustrative pontoon boat of FIG. 29, with the cover in an intermediate position.
Figure 30C:
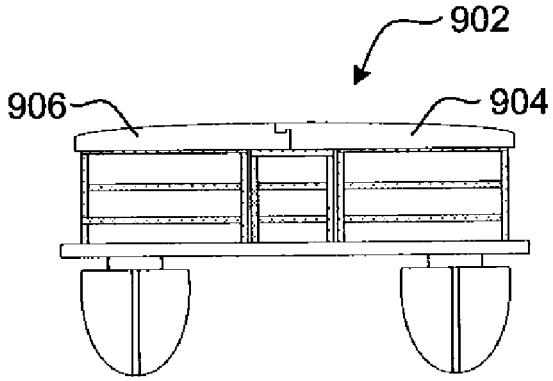
FIG. 30C is a schematic front view of the illustrative pontoon boat of FIG. 29, with the cover in a covering position.

In FIG. 30A, the port side portion 904 is shown in a vertical position along the side of the port side wall 908. Likewise, the starboard side portion 906 is shown in a vertical position along the side of the starboard side wall 910. FIG. 30B is a schematic front view of the illustrative pontoon boat 900 of FIG. 29, with the retractable cover 902 in an intermediate position. In the intermediate position, the port side portion 904 and the starboard side portion 906 are shown raised up with respect to that shown in FIG. 30A. FIG. 30C is a schematic front view of the illustrative pontoon boat 900 of FIG. 29, with the retractable cover 902 rotated into a lowered or covering position. In the covering position, the port side portion 904 and the starboard side portion 906 are shown folded down to provide a cover for the protected area of the pontoon boat 900.

Figure 31A:
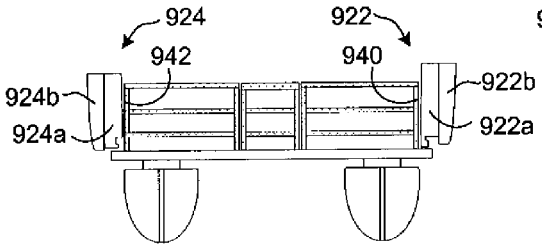
FIG. 31A is a schematic front view of an illustrative pontoon boat with a cover in a retracted position.

FIG. 31A is a schematic front view of an illustrative pontoon boat with a retractable cover in a retracted position. The illustrative retractable cover 920 includes a port side portion 922 and a starboard side portion 924. The port side portion 922 includes an inward portion 922*a* hinged to an outward portion 922*b*. Likewise, the starboard side portion 924 includes an inward portion 924*a* hinged to an outward portion 924*b*.

In FIG. 31A, the port side portion 922 is shown in a vertical position along the side of the port side wall 940, with the inward portion 922*a* folded adjacent to the outward portion 922*b*. Likewise, the starboard side portion 924 is shown in a vertical position along the side of the starboard side wall 942, with the inward portion 924*a* folded adjacent to the outward portion 924*b*.

Figure 31B:
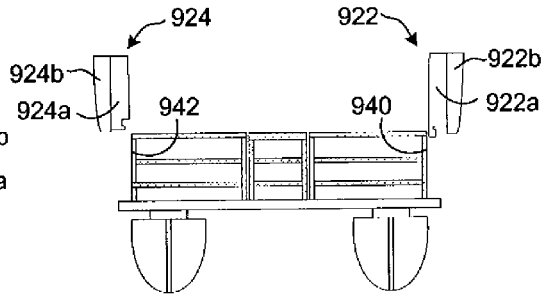
FIG. 31B is a schematic front view of the illustrative pontoon boat of FIG. 31A, with the cover in an intermediate folded position.

FIG. 31B shows the port side portion 922 lifted in a vertical direction relative to that shown in FIG. 31A, with the inward portion 922*a* still folded adjacent to the outward portion 922*b*. Also, the starboard side portion 924 is shown lifted in a vertical direction relative to that shown in FIG. 31A, with the inward portion 924*a* still folded adjacent to the outward portion 924*b*.

Figure 31C:
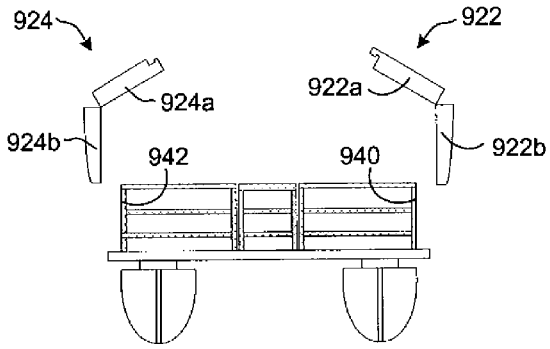
FIG. 31C is a schematic front view of the illustrative pontoon boat of FIG. 31A, with the cover in an intermediate unfolding position.
Figure 31D:
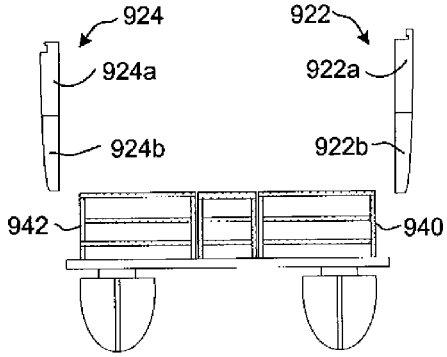
FIG. 31D is a schematic front view of the illustrative pontoon boat of FIG. 31A, with the cover in an intermediate unfolded position.
Figure 31E:
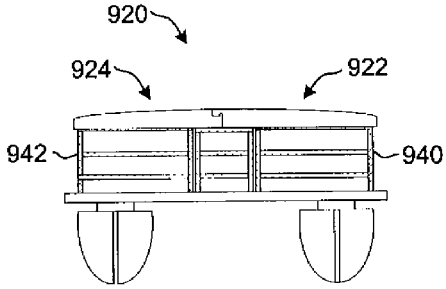
FIG. 31E is a schematic front view of the illustrative pontoon boat of FIG. 31A, with the cover in a covering position.

In FIG. 31C, the inward portion 922*a* of the port side portion 922 is shown beginning to unfold relative to the outward portion 922*b*. Likewise, the inward portion 924*a* of the starboard side portion 924 is shown beginning to unfold relative to the outward portion 924*b*. FIG. 31D shows the inward portion 922*a* of the port side portion 922 completely unfolded relative to the outward portion 922*b*, and the inward portion 924*a* of the starboard side portion 924 completely unfolded relative to the outward portion 924*b*. Finally, FIG. 31E shows the unfolded port side portion 922 rotated down to cover about half of the protected area of the pontoon boat, and the unfolded starboard side portion 924 rotated down to cover the other half of the protected area of the pontoon boat. The inward end of the port side portion 922 is shown overlapping part of the inward end of the starboard side portion 924 to help provide a leak free interface therebetween.

Figure 32:
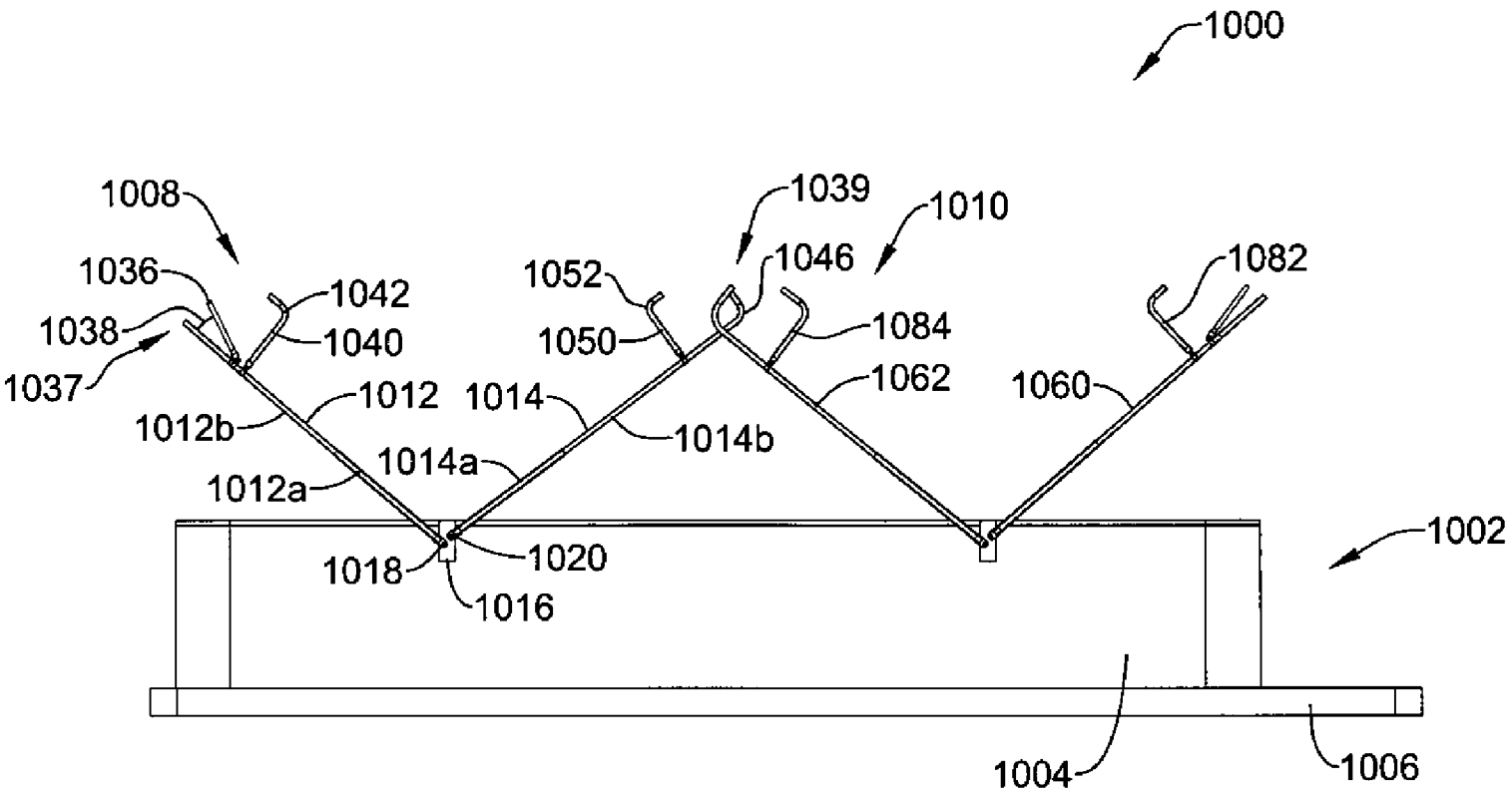
FIG. 32 is a schematic side view of another illustrative cover system for a boat.

FIG. 32 is a schematic side view of another illustrative cover system for a boat. The illustrative cover system is generally shown at 1000, and is shown mounted to a boat 1002. The boat 1002 may be any type of boat. In FIG. 32, the boat 1002 is illustrated as a pontoon boat with sidewalls 1004 extending up from a platform 1006 defining a protected area. Tubular pontoon floats are not shown in FIG. 32. While a pontoon type boat is used in this example, it should be understood that the present invention may be used in conjunction with any suitable boat type, as desired.

The illustrative cover system 1000 of FIG. 32 includes a rear cover assembly 1008 and a front cover assembly 1010. In this, front and rear are relative terms pertaining to the illustrated embodiment, and should not be interpreted as limiting in any manner. Each cover assembly 1008 and 1010 may support a flexible cover (see, for example, FIG. 41). The flexible cover may be made from a flexible material such as a canvas, a flexible plastic (e.g. polyester, nylon, etc.), an outdoor fabric such SunBrella™ available from Glen Raven Custom Fabrics, LLC of Glen Raven, N.C., or any other suitable material or combination of materials, as desired.

Figure 34:
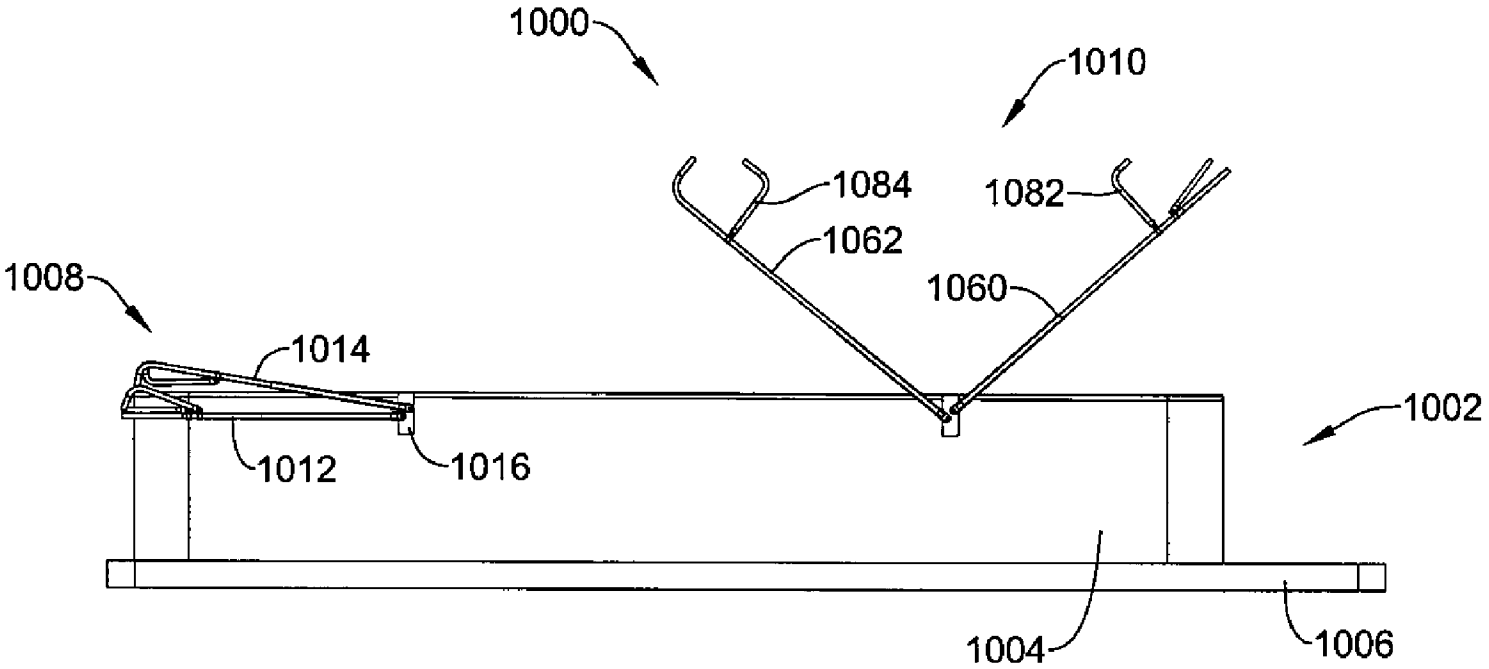
FIG. 34 is a schematic side view of the illustrative cover system of FIG. 32 with the rear cover assembly in a lowered retracted position, and the front cover assembly in a raised covering position.
Figure 35:
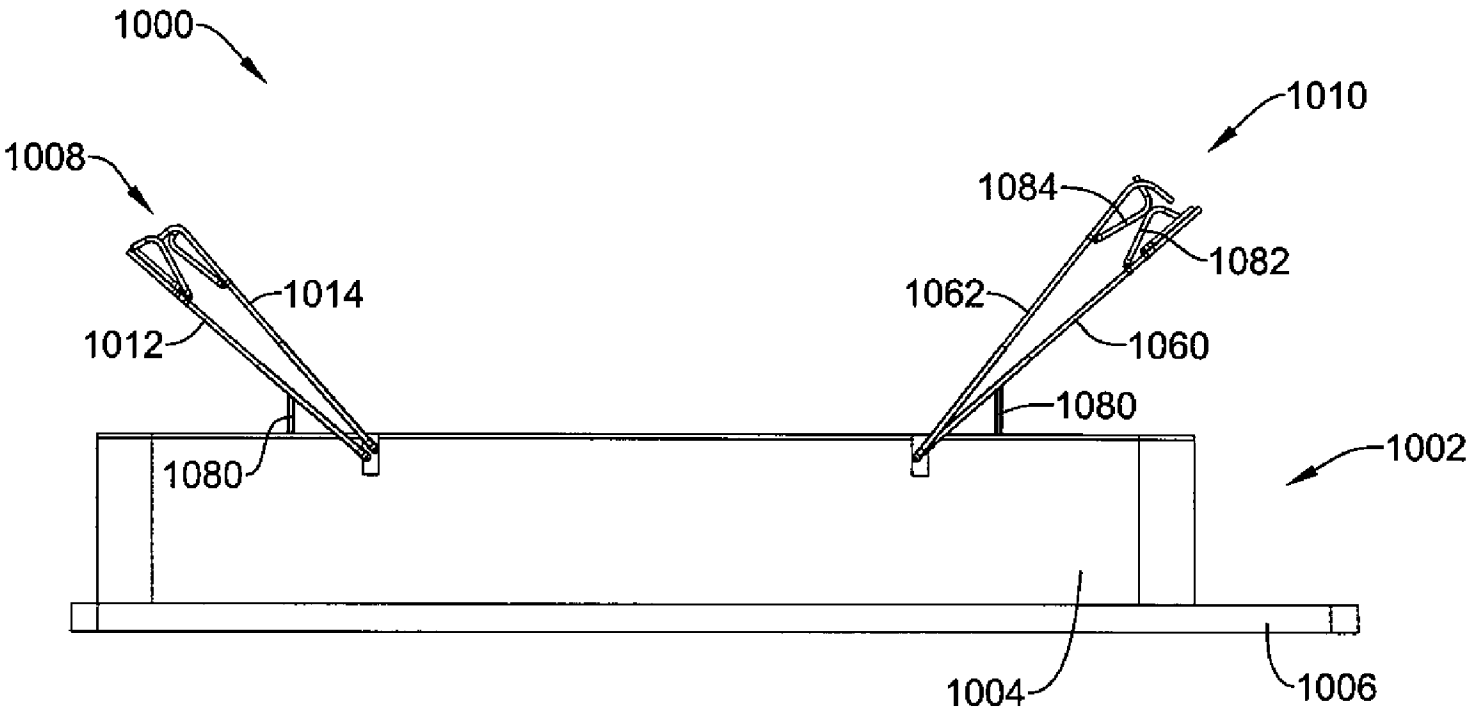
FIG. 35 is a schematic side view of the illustrative cover system of FIG. 32 with both the rear and front cover assemblies in raised retracted positions.
Figure 36:
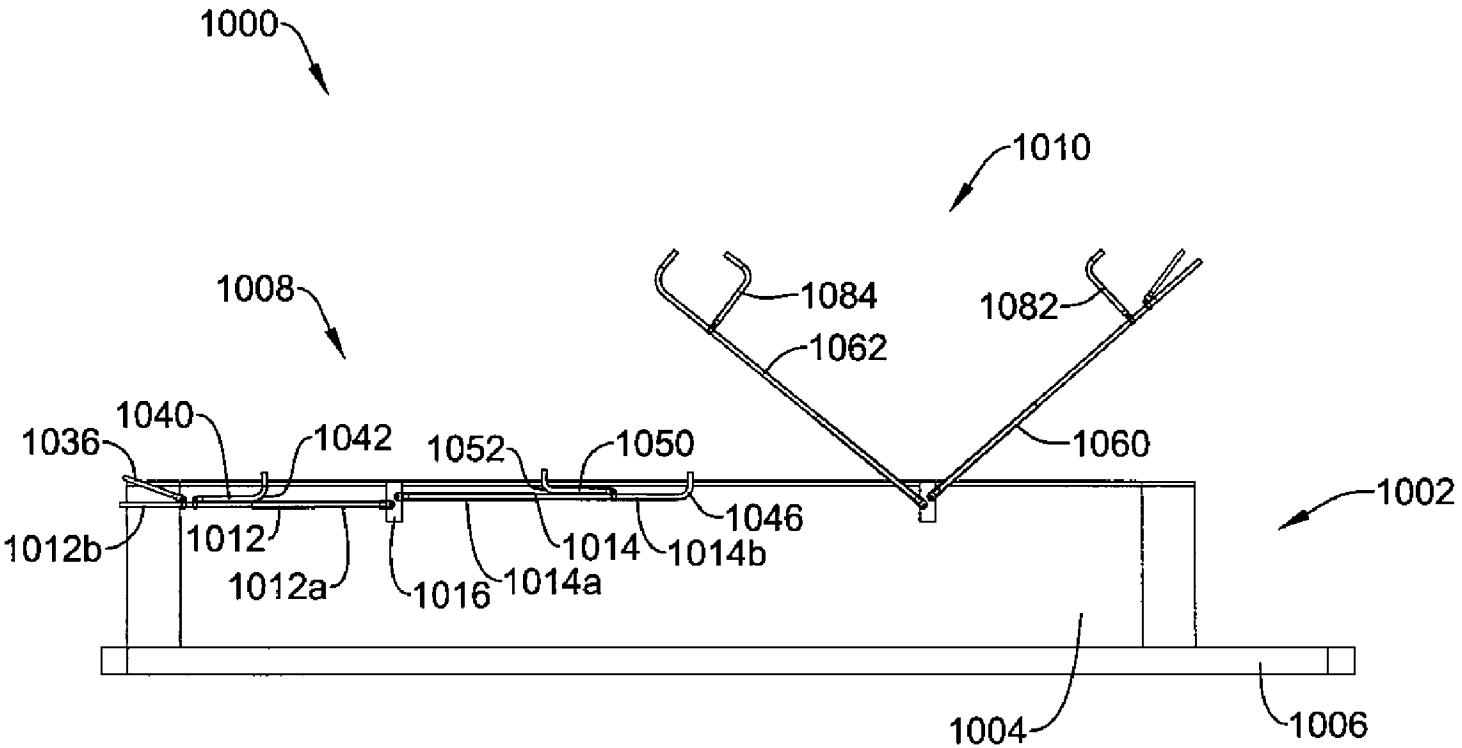
FIG. 36 is a schematic side view of the illustrative cover system of FIG. 32 with the rear cover assembly in a lowered covering position, and the front cover assembly in a raised covering position.
Figure 37:
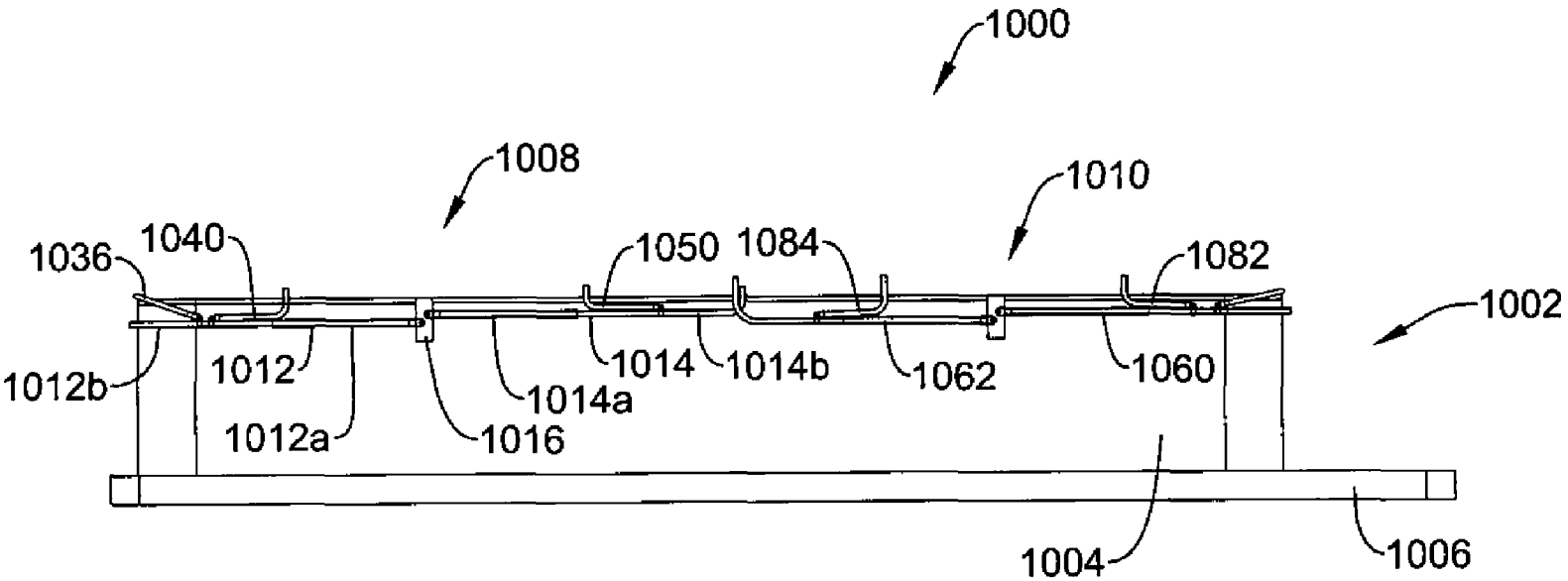
FIG. 37 is a schematic side view of the illustrative cover system of FIG. 32 with both the rear and front cover assemblies in lowered covering positions.
Figure 38:
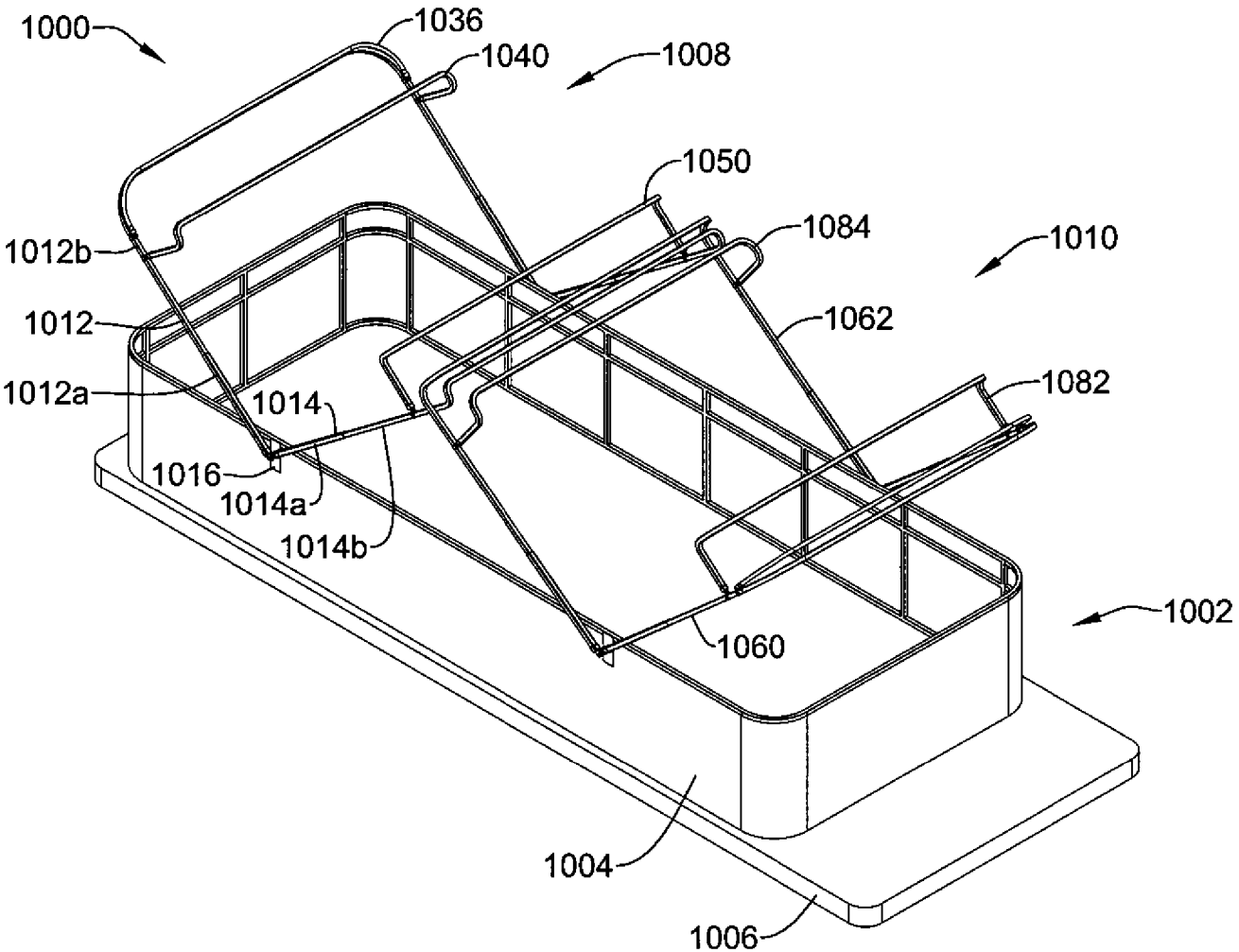
FIG. 38 is a perspective view of the illustrative cover system of FIG. 32 with both the rear and front cover assemblies in raised covering positions.
Figure 39:
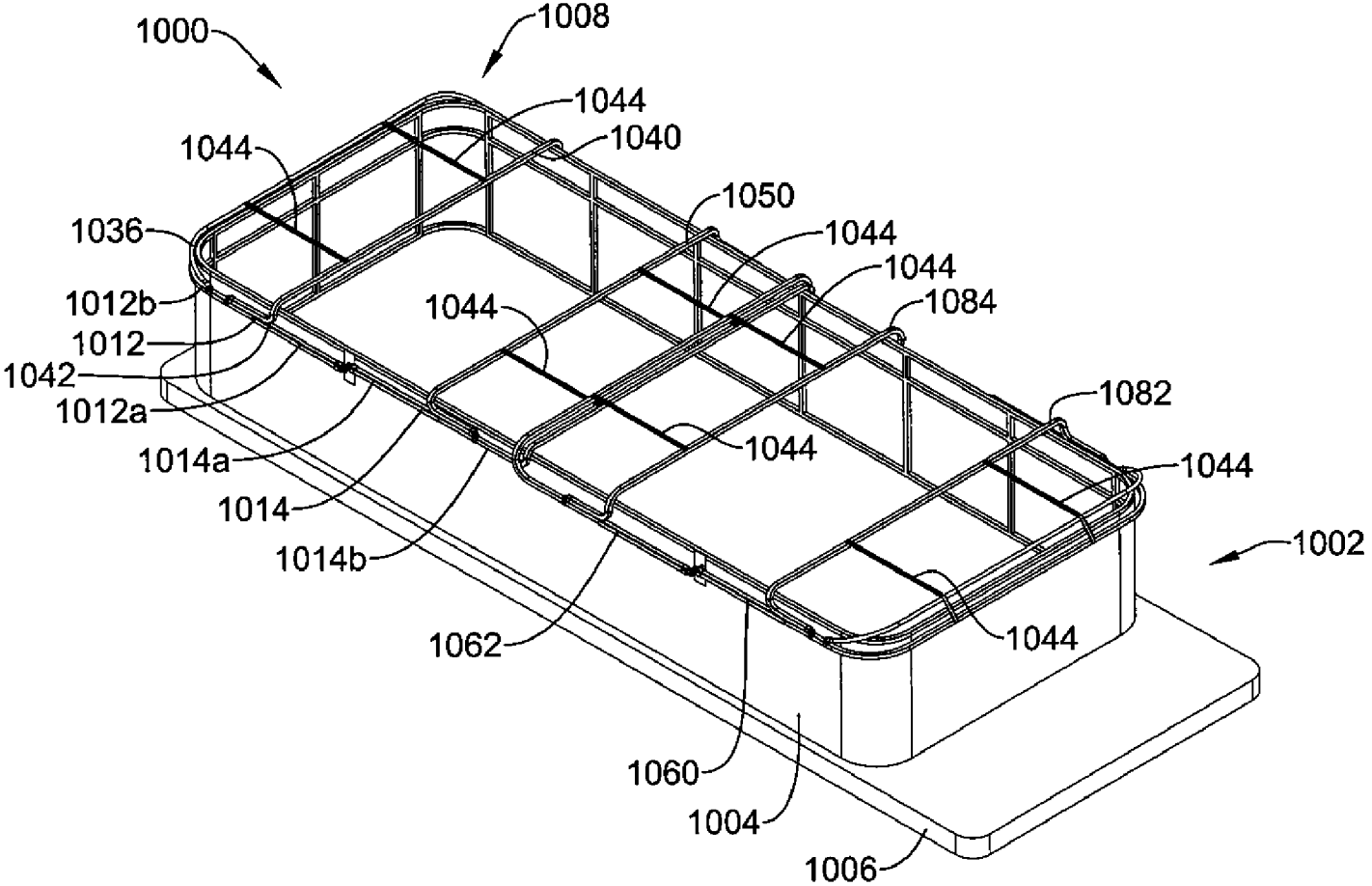
FIG. 39 is a perspective view of the illustrative cover system of FIG. 32 with both the rear and front cover assemblies in lowered covering positions.
Figure 41:
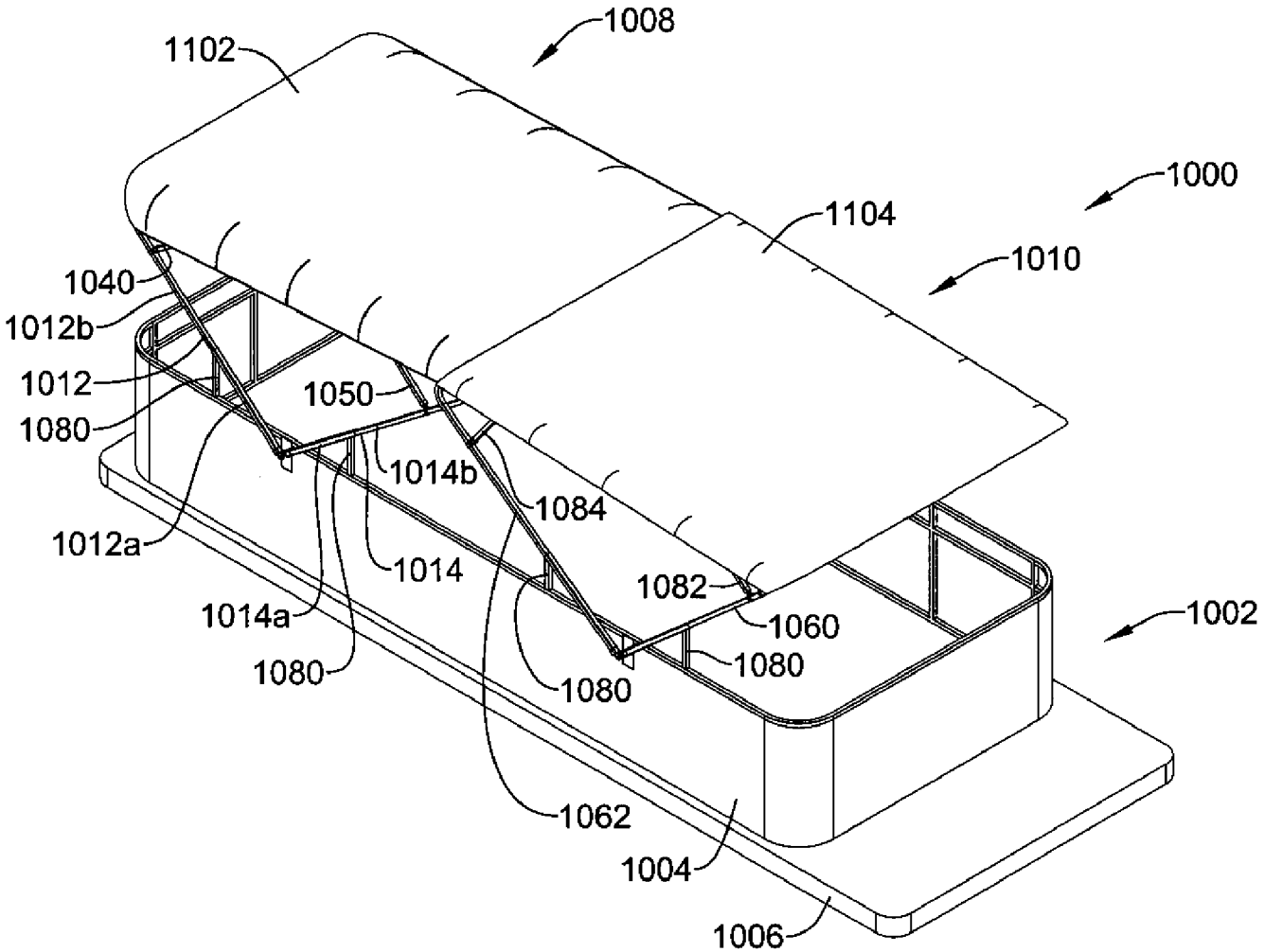
FIG. 41 is a perspective view of the illustrative cover system of FIG. 32 with the rear and front cover assemblies in their raised covering positions similar to FIGS. 32 and 38, but with flexible covers shown.
Figure 42:
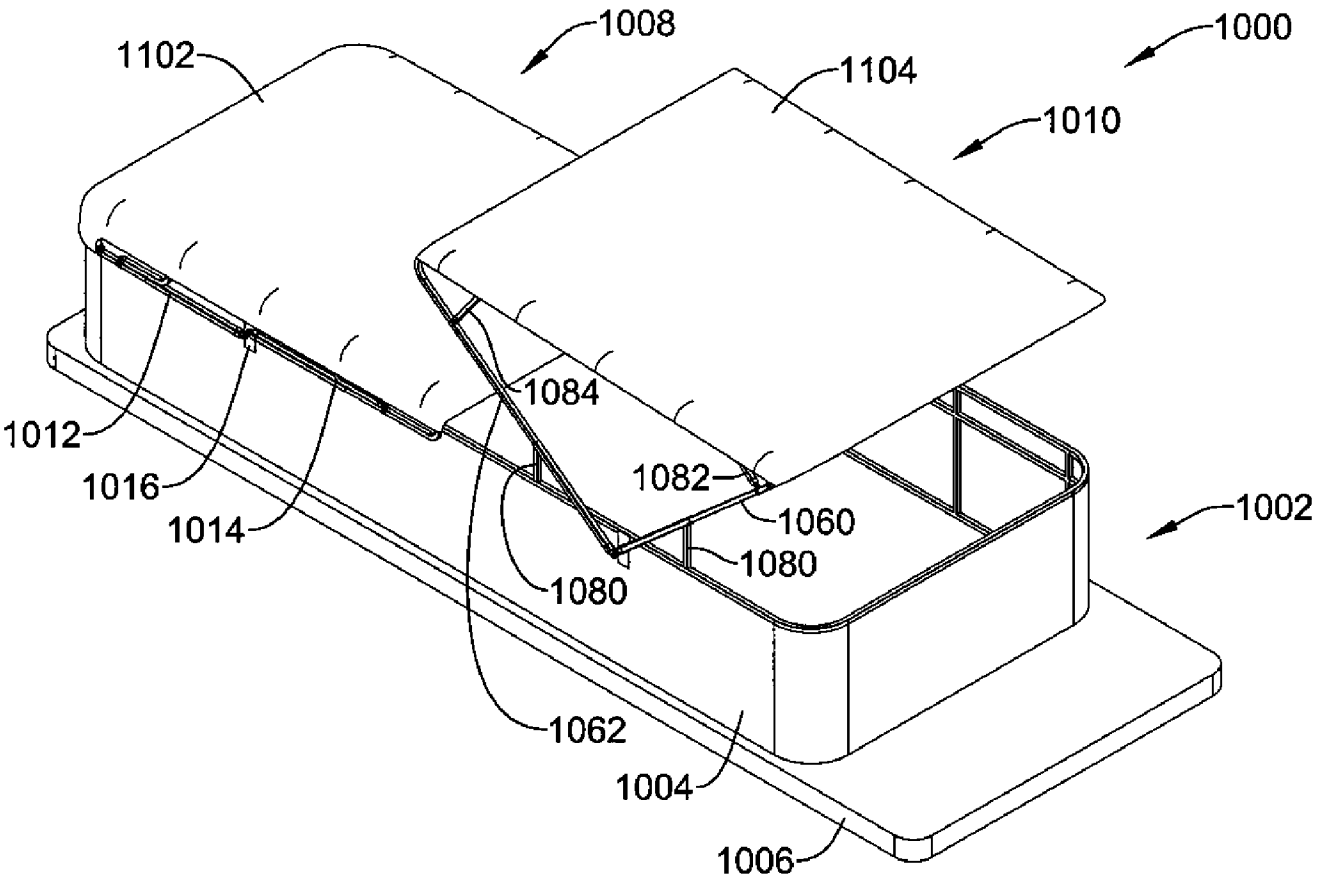
FIG. 42 is a perspective view of the illustrative cover system of FIG. 32 with the rear cover assembly in a lowered covering position, and the front cover assembly in a raised covering position similar to FIG. 36, but with flexible covers shown.
Figure 43:
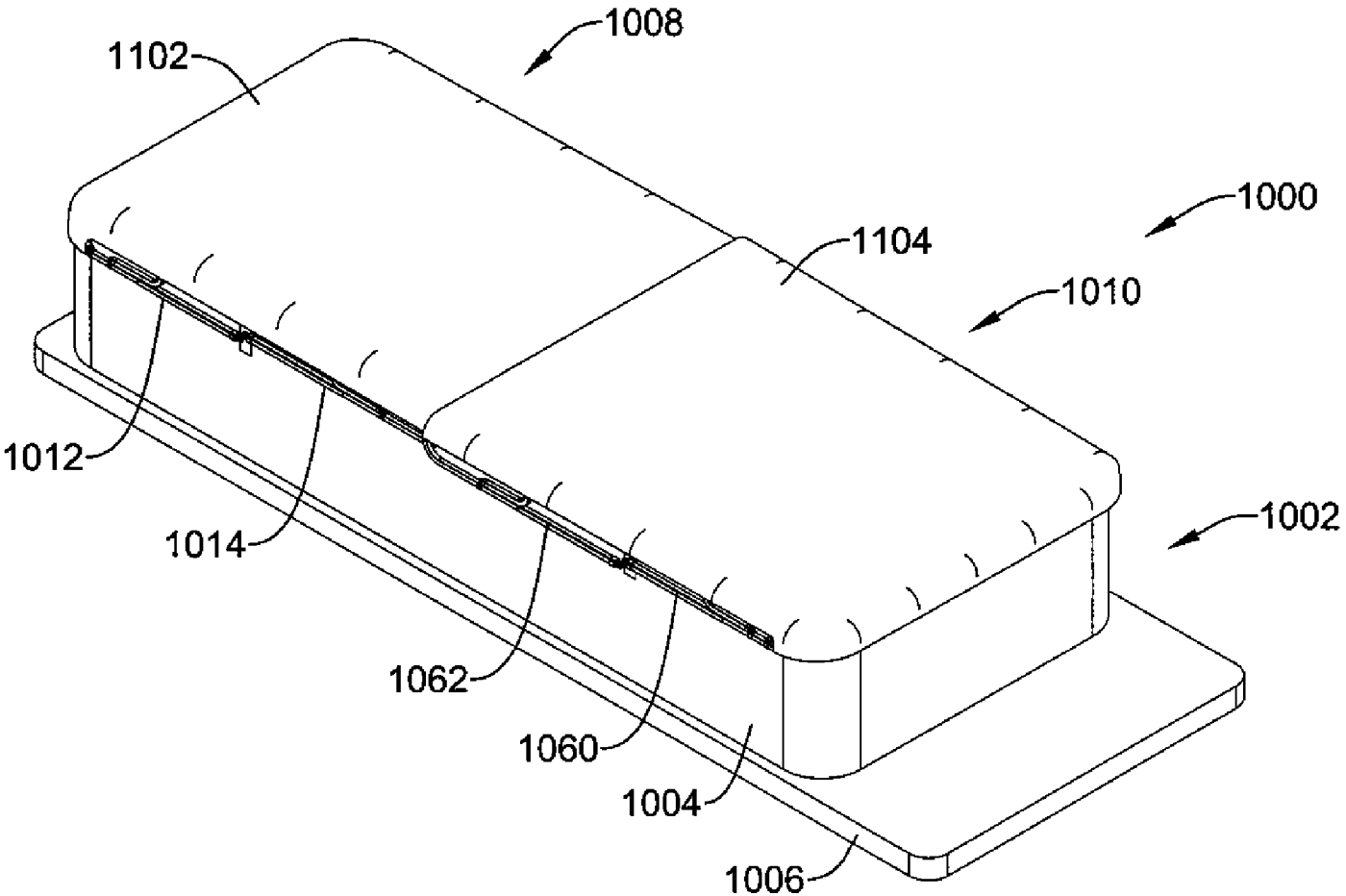
FIG. 43 is a perspective view of the illustrative cover system of FIG. 32 with the rear and front cover assemblies in lowered covering positions similar to FIGS. 37 and 39, but with flexible covers shown.
Figure 44:
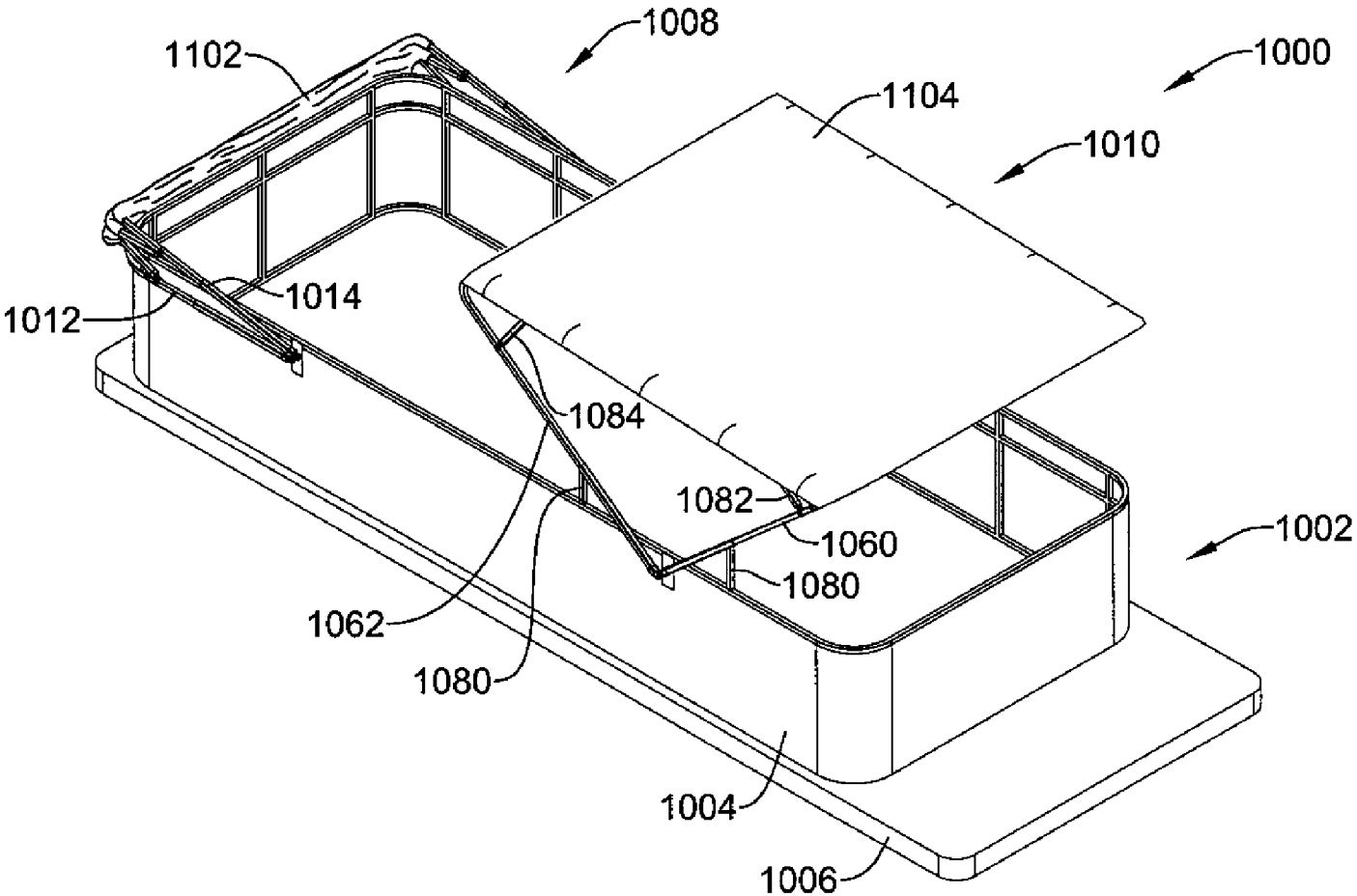
FIG. 44 is a perspective view of the illustrative cover system of FIG. 32 with the rear cover assembly in a lowered retracted position and the front cover assembly in a raised covering position similar to FIG. 34, but with flexible covers shown.
Figure 45:
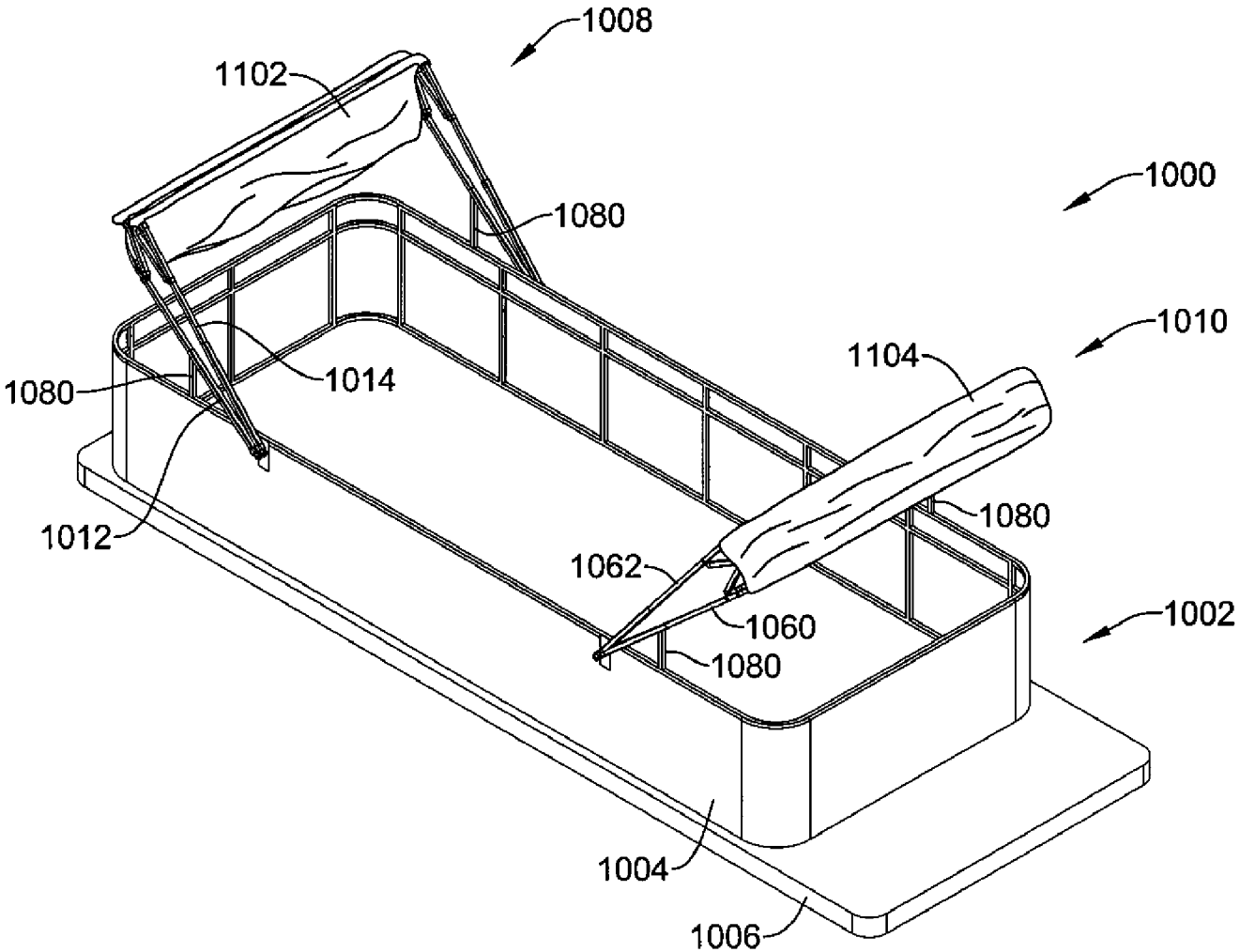
FIG. 45 is a perspective view of the illustrative cover system of FIG. 32 with both the rear and front cover assemblies in raised retracted positions similar to FIG. 35, but with flexible covers shown.

In the illustrative embodiment, both or either of the rear cover assembly 1008 and the front cover assembly 1010 may be configured to articulate between various positions. For example, both or either of the rear cover assembly 1008 and the front cover assembly 1010 may be configured to articulate between, for example, two or more of a lowered covering position, a raised covering position, a raised retracted position, a lowered retracted position, and/or any other suitable position, as desired. In one example, FIGS. 32, 38 and 41 show both the rear cover assembly 1008 and the front cover assembly 1010 in their raised covering positions. FIGS. 36 and 42 show the rear cover assembly 1008 in a lowered covering position and the front cover assembly 1010 in a raised covering position. FIGS. 37, 39 and 43 show both the rear cover assembly 1008 and the front cover assembly 1010 in lowered covering positions. FIGS. 34 and 44 show the rear cover assembly 1008 in a lowered retracted position and the front cover assembly 1010 in a raised covering position. FIGS. 35 and 45 show both the rear cover assembly 1008 and the front cover assembly 1010 in raised retracted positions. These are only illustrative positions, and it is contemplated that more or less articulated positions may be provided, as desired. In some cases, the rear cover assembly 1008 and the front cover assembly 1010 may be configured to articulate independent of one another, but this is not required. Also, while two cover assemblies are shown, it is contemplated that more or less that two cover assemblies may be used on any given boat, depending on the application.

Figure 33:
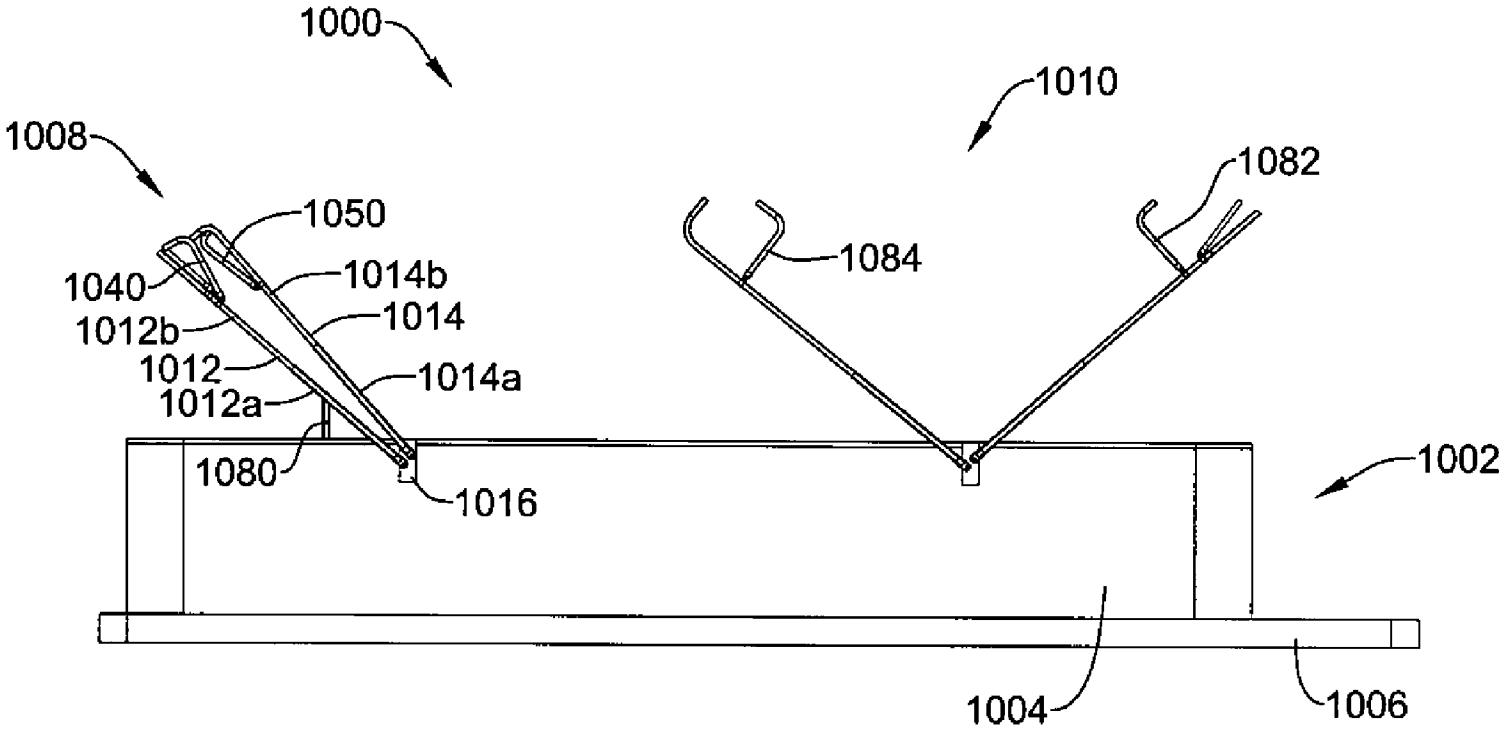
FIG. 33 is a schematic side view of the illustrative cover system of FIG. 32 with the rear cover assembly in a raised retracted position, and the front cover assembly in a raised covering position.

During use, and in the illustrative embodiment of FIG. 32, it is contemplated that the rear cover assembly 1008 and/or the front cover assembly 1010 may be articulated to whatever positions is desired. For example, when the boat is not in use, a user may articulate the rear cover assembly 1008 and the front cover assembly 1010 to their lowered covering positions, as shown in FIGS. 37, 39 and 43. This may provide a mooring cover for a protected area of the boat 1002. In another example, when the boat is in use, and maximum shade or rain protection is desired, the user may articulate the rear cover assembly 1008 and the front cover assembly 1010 to their raised covering positions, as shown in FIGS. 32, 38 and 41. In yet another example, when the boat is in use, and when maximum sun protection is desired while still maintaining access to the front and rear sidewalls of the boat (e.g. when access to a door positioned in the front or rear sidewall is desired), the user may articulate the rear cover assembly 1008 and the front cover assembly 1010 to their raised retracted positions, as shown in FIGS. 35 and 45. In another example, when the boat is in use, and when sun is desired in the back portion of the boat and shade is desired in the front of the boat, the user may articulate the rear cover assembly 1008 to the raised retracted position and the front cover assembly 1010 to the raised covering position, as shown in FIG. 33. In yet another example, when the boat is in use, and when sun is desired in the back part of the boat and shade is desired in the front of the boat, but access to the rear sidewall of the boat is not necessary or desired, the user may articulate the rear cover assembly 1008 to the lower retracted position and the front cover assembly 1010 to the raised covering position, as shown in FIG. 44. These positions are only illustrative, and it is contemplated that other combinations of these and other positions may be provided, as desired.

In some cases, the cover assemblies 1008 and 1010 may be moved between the various articulated positions under human power. A crank, a wench, and/or simply pushing and/or pulling the cover assemblies 1008 and/or 1010, and/or any other suitable human powered moving mechanism or method may be used, as desired. In other cases, the cover assemblies 1008 and/or 1010 may be moved between various positions using a powered system, such as a motor or pump. When a motor or pump is used, and in some illustrative embodiments, motion and/or energy from the motor or pump may be transferred to move the cover assemblies 1008 and/or 1010 to a desired position. Any number of methods may be used to transfer the motion and/or energy from the motor or pump to the cover assemblies 1008 and/or 1010 including, for example, one or more belts, cables, screw drives, shafts, tracks, hydraulic cylinders, hydraulic tubes, pulleys, gears, and/or any other suitable system or method, as desired.

While not limiting, the illustrative rear cover assembly 1008 of FIG. 32 may include a first cover support 1012 and a second cover support 1014. In some embodiments, the first cover support 1012 and the second cover support 1014 may include one or more tubular bars made from aluminum, steel, rigid plastic or any other suitable material or material combination. The cross-sectional shape of the one or more tubular bars may be of any suitable shape including square, round, triangular, star shaped, or any other suitable shape or combination of shapes along their length, as desired.

In the illustrative embodiment, the first cover support 1012 has a lower end 1018 that is rotatably coupled to the boat 1002 via rotatable coupling 1016. The rotatable coupling 1016 may allow the first cover support 1012 to rotate about a rotation axis, which in the embodiment shown, extends into the page of FIG. 32. Likewise, the second cover support 1014 may have a lower end 1020 that is rotatably coupled to the boat 1002 via rotatable coupling 1016. Again, the rotatable coupling 1016 may allow the second cover support 1014 to rotate about a rotation axis, which in the embodiment shown, extends into the page of FIG. 32. In the illustrative embodiment, the rotation axis of the first cover support 1012 and the rotation axis of the second cover support 1014 may be laterally offset relative to one another. When so provided, when the second cover support 1014 is rotated back toward the first cover support 1012 (e.g. in the raised retracted or lowered retracted positions), the second cover support 1014 may not interfere with the first cover support 1012 (see, for example, FIG. 33). In some embodiments, the rotation axis of the first cover support 1012 and the rotation axis of the second cover support 1014 may extend along a common rotation axis. In some cases, the first cover support 1012 may be offset in a direction along the common rotation axis relative to the second cover support 1014, but this is not required.

While the lower ends 1018 and 1020 of the first cover support 1012 and second cover support 1014 are shown coupled to a common rotatable coupling 1016, it is contemplated that they may be coupled to separate rotatable couplings, if desired. Also, while the rotatable coupling 1016 is shown mounted adjacent the outer surface of the sidewall 1004, it is contemplated that the rotatable coupling(s) 1016 may be mounted on top of the sidewall 1004, on the inside surface of the sidewall 1004, along the platform 1006, or at any other suitable location, as desired.

In the illustrative embodiment of FIG. 32, the first cover support 1012 is shown as generally U-shaped (see, for example, FIG. 38), and extends from rotatable coupling 1016 on a starboard side of the boat 1002, to a rotatable coupling (not shown) on a port side of the boat. Likewise, the second cover support 1014 may be generally U-shaped, and may extend from rotatable coupling 1016 on the starboard side of the boat 1002, to a rotatable coupling (not shown) on the port side of the boat. While the first cover support 1012 and the second cover support 1014 are shown as generally U-shaped, this is not required in all embodiments. The first cover support 1012 may have a first end that is coupled to the rotatable coupling 1016 and a second projecting end 1037 as shown. Likewise, the second cover support 1014 may have a first end that is coupled to the rotatable coupling 1016 and a second projecting end 1039 as shown.

In the illustrative embodiment of FIG. 32, the first cover support 1012 may be telescoping so that the length of the first cover support 1012 may change depending on the particular articulated position of the rear cover assembly 1008. As shown in FIG. 32, the first cover support 1012 may include a first telescoping member 1012*a* and a first U-shaped telescoping member 1012*b*. The first U-shaped telescoping member

1012*b* may slide into the first telescoping member 1012*a,* and into an equivalent first telescoping member 1012*a* on the opposite side of the boat as better shown in FIG. 38. Alternatively, the first U-shaped telescoping member 1012*b* may slide over the first telescoping member 1012*a,* and over an equivalent first telescoping member 1012*a* on the opposite side of the boat, as desired. Other telescoping configurations are also contemplated. For example, two (or more) members may be placed side by side, with one slidably disposed relative to the other, such that the two (or more) member may be telescoped to assume an extended and shortened overall length between the first end and the second projecting end 1037. More generally, it is contemplated that the phrase "telescoping" as used herein may include any two (or more) members that can be articulated, sometimes in a linear or near linear direction or motion, to assume a longer and/or shorter overall length.

Figure 40A:
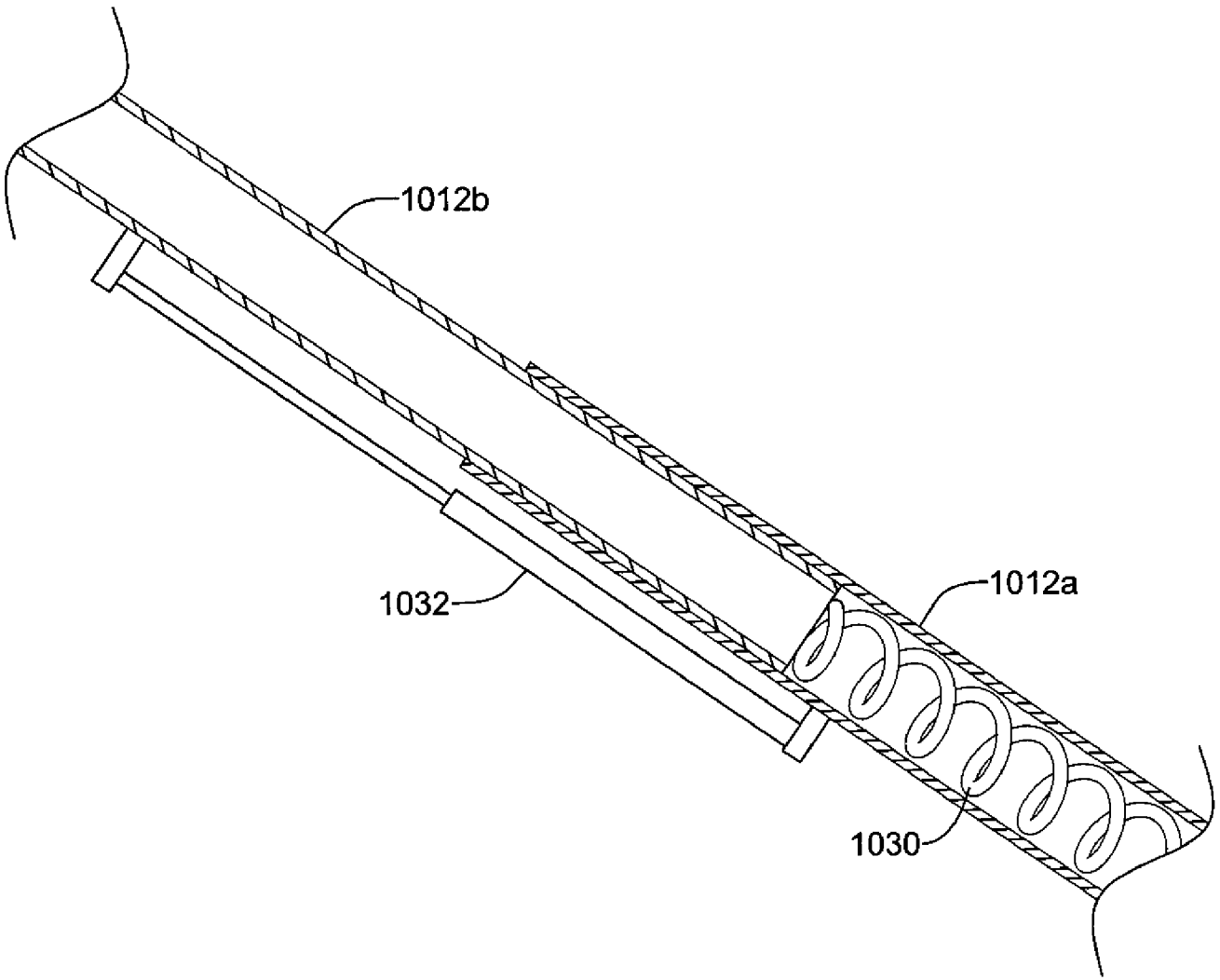
FIG. 40*a* is a close-up partial cross-sectional side view of an illustrative telescoping support member.

In some cases, a biasing element may be provided that provides a bias between the first telescoping member 1012*a* and the first U-shaped telescoping member 1012*b*. The biasing element may, for example, be configured to bias the first U-shaped telescoping member 1012*b* away from the first telescoping member 1012*a* and toward an extended position. For example, and referring to FIG. 40A, the biasing element may include a spring or the like 1030 that is configured to bias the first U-shaped telescoping member 1012*b* away from the first telescoping member 1012*a*. The spring 1030 may be any suitable spring such as a coil type spring, and may be situated within the first telescoping member 1012*a* and engage an end of the first U-shaped telescoping member 1012*b*. Alternatively, the spring 1030 may be positioned outside of the first telescoping member 1012*a,* and engage an end, stop, pin or other element (not shown) on the first U-shaped telescoping member 1012*b*. In some cases, the spring 1030 may be coated with a plastic or the like to help reduce noise the might be generated when the spring 1030 bangs against the first telescoping member 1012*a* when the boat is in use, but this is not required. Alternatively, or in addition, the biasing element may include a gas spring 1032 or the like that biases the first U-shaped telescoping member 1012*b* away from the first telescoping member 1012*a* and toward an extended position. It should be recognized that these are only illustrative biasing elements for biasing the telescoping support members. It is contemplated that any suitable biasing element may be used that can create a bias force between the first telescoping member 1012*a* and the first U-shaped telescoping member 1012*b,* as desired.

Figure 40B:
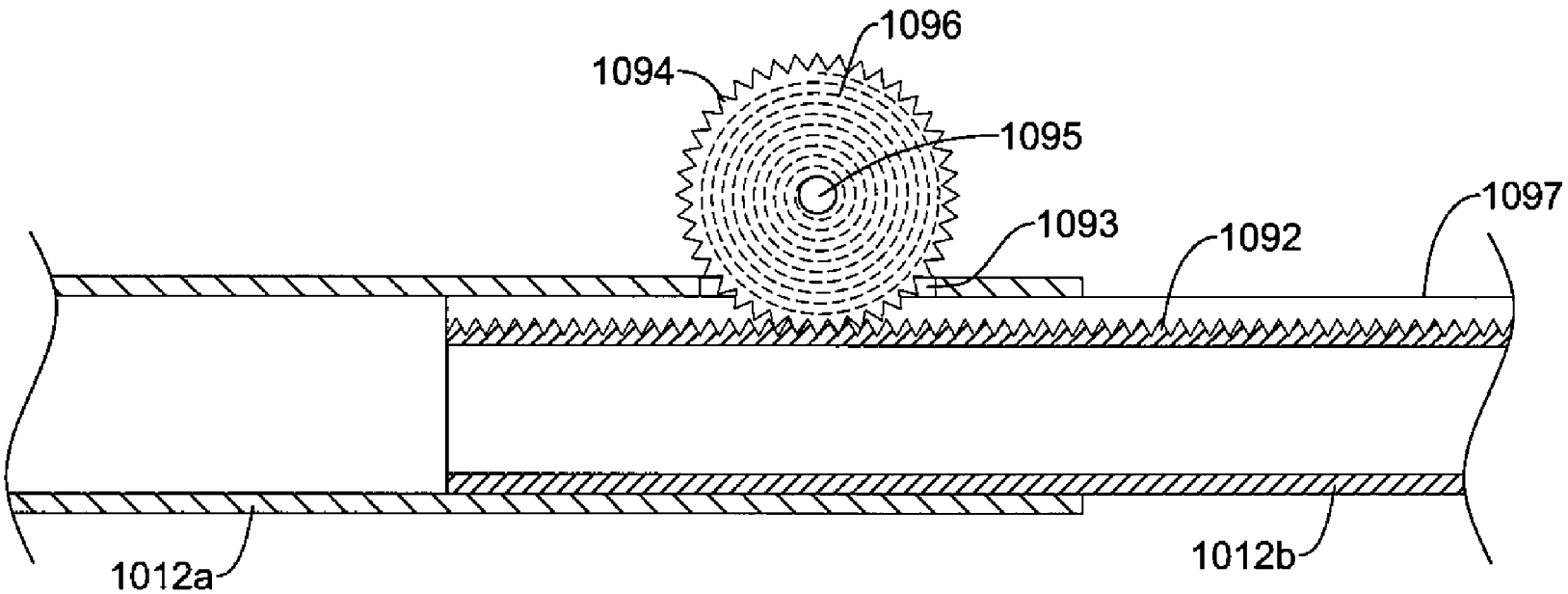
FIG. 40*b* is a close up partial cross-sectional side view of another illustrative telescoping support member.
Figure 40C:
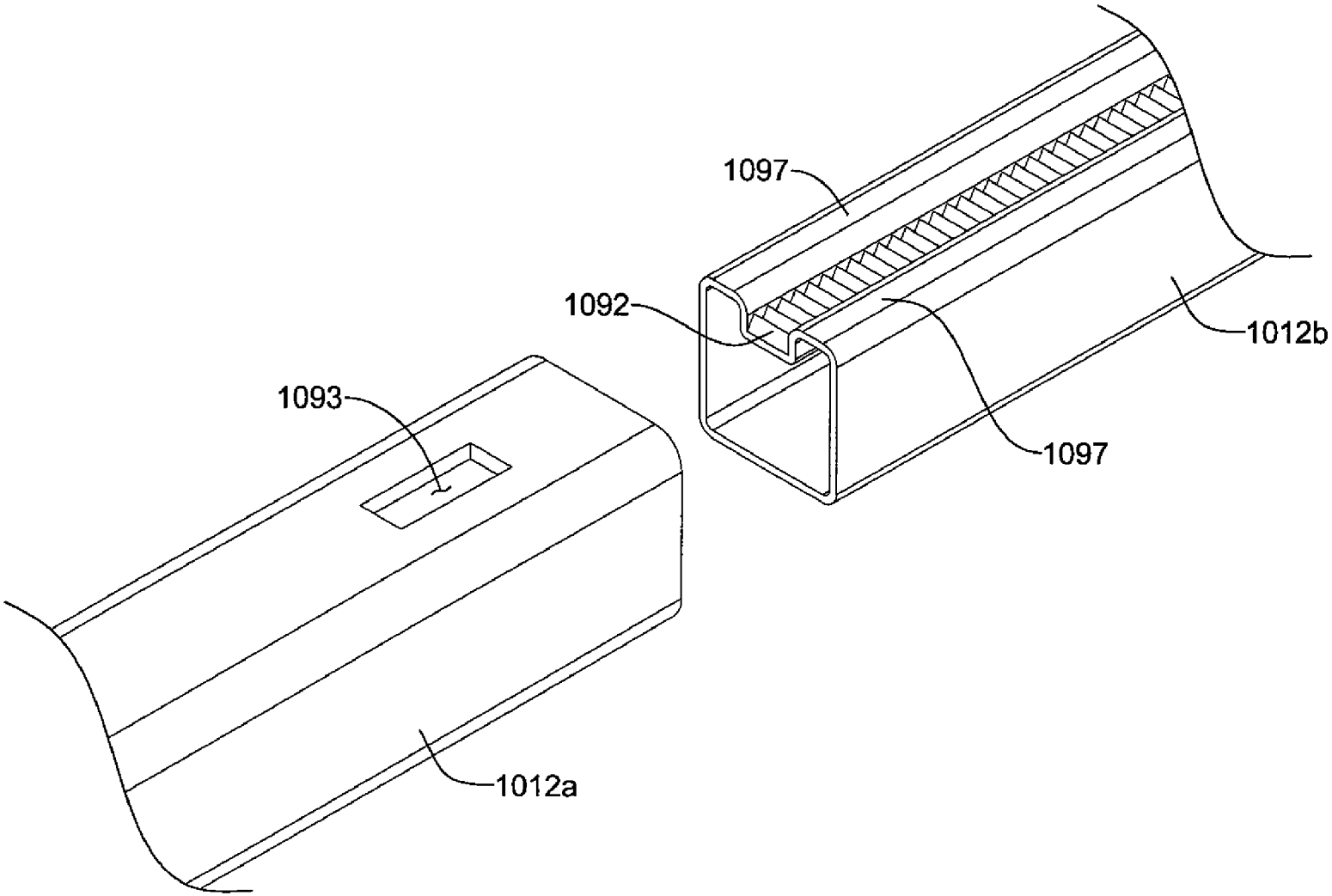
FIGS. 40*c*-40*d* are perspective views showing illustrative embodiments of the telescoping support member of FIG. 40*b;*

FIG. 40B is a close up partial cross-sectional side view of another illustrative telescoping support member, such as telescoping support member 1012. In the illustrative embodiment of FIG. 40B, a second telescoping support member, such as second telescoping support member 1012*b,* is inserted into a first telescoping member, such as first telescoping support member 1012*a*. The second telescoping support member 1012*b* may include a number of gear teeth 1092 extending along at least part of its length. In some case, the gear teeth 1092 of the second telescoping member 1012*b* may extend within an elongated recess extending in from an outer surface 1097 of the second telescoping member 1012*b,* as best shown in FIG. 40C.

The first telescoping support member 1012*a* may include a gear receiving aperture 1093. A gear 1094, having gear teeth, may rotate about a rotation axis 1095, and may extend into the receiving aperture 1093 so that the gear teeth of the gear 1094 mesh with the gear teeth 1092 of the second telescoping support member 1012*b,* as best shown in FIG. 40B. A bias spring 1096, such as a spiral torsion and/or a spiral power spring, may bias the gear 1094 such that the gear 1094 biases the second telescoping member 1012*b* to an extended telescoping position (to the right in FIG. 40B). When the second telescoping member 1012*b* is pushed inward toward a contracted telescoping position (to the left in FIG. 40B), the gear teeth 1092 of the second telescoping member 1012*b* may engage the gear teeth of the gear 1094 and rotate the gear 1094 in a clock-wise direction to further wind up the bias spring 1096. Since the bias spring 1096 may always be wound up at least to some degree, the bias spring 1096 may constantly bias the second telescoping support member 1012*b* away from the first telescoping support member 1012*a* and to an extended telescoping position (to the right in FIG. 40B).

In some cases, it is contemplated that the gear 1094 may be actuated via a motor or the like. For example, in some embodiments, rather than biasing the gear 1094 with a bias spring 1096 as described above, or in addition to a bias spring, the gear 1094 may be mechanically driven by an electric motor or the like. If desired, the electric motor may be controlled to provide a desired tension in the flexible cover of the cover assembly in the various articulated positions.

Figure 40D:
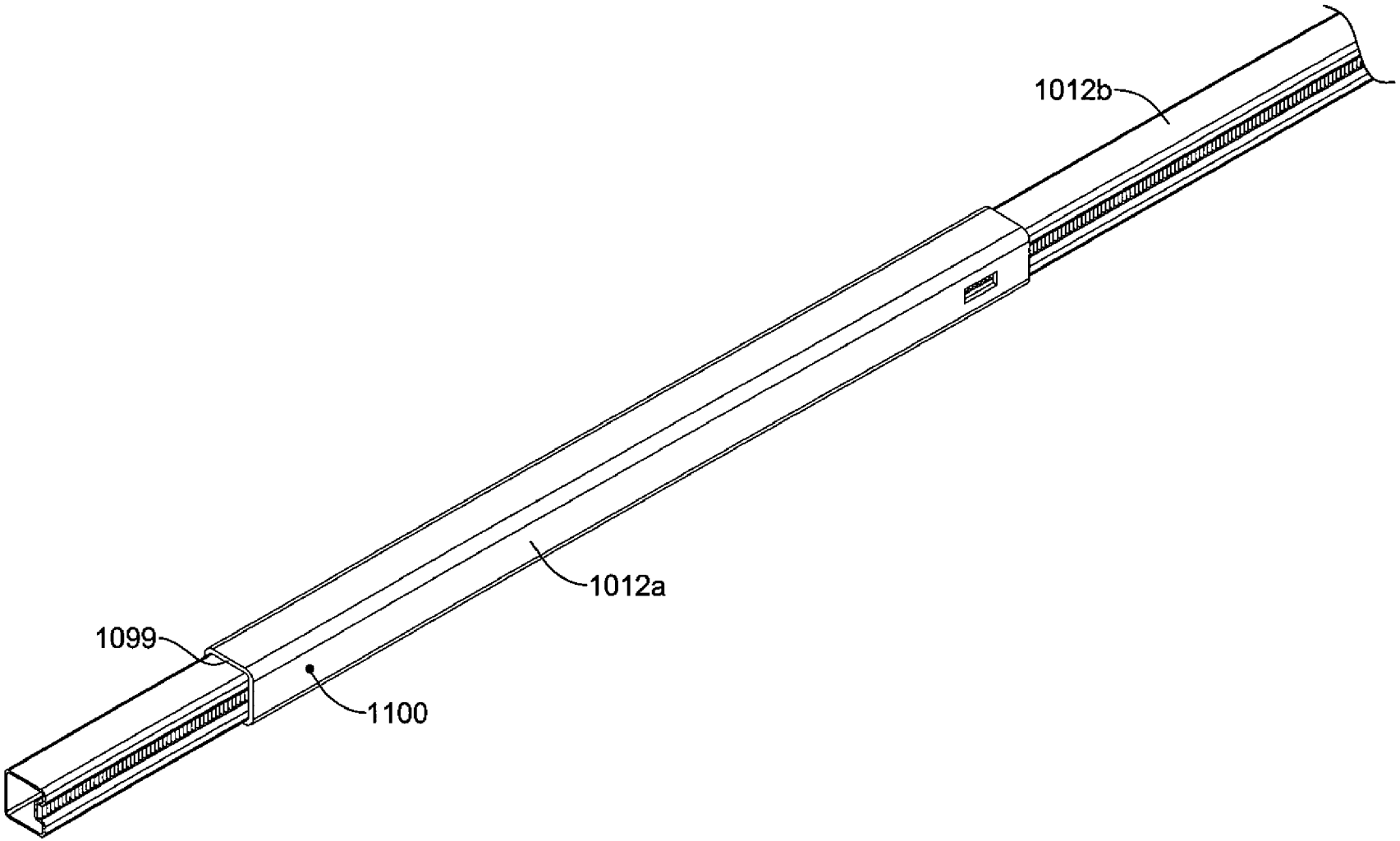

While not required, it is contemplated that the second telescoping support member 1012*b* may extend through the first telescoping support member 1012*a* and out the other end 1099, as best shown in FIG. 40D. In some cases, this may increase the distance by which the second telescoping support member 1012*b* can be extended relative to the first telescoping support member 1012*a*. In some cases, the first telescoping support member 1012*a* may be rotatable coupled to a boat near the lower end, such as end 1100, and the second telescoping support member 1012*b* may extend past the end 1100.

Returning to FIG. 32, in some embodiments, an edge support member 1036 may be rigidly coupled to the first cover support 1012, and in some cases may extend the width of the boat (see FIG. 38). In the illustrative embodiment, the edge support member 1036 extends at an angle 1038 relative to first cover support 1012, but this is not required. The edge support member 1036 may help keep the flexible cover (see, for example, FIG. 42) from engaging the top of the side wall 1004 of the boat 1002 when the rear cover assembly 1008 is articulated to the lowered covering position (see, for example, FIGS. 36, 39 and 42).

Also, and in some illustrative embodiments, a rear cross-support member 1040 may be provided, when desired. The rear cross-support member 1040 (see, FIGS. 32 and 38) may be rotatably coupled to the first cover support 1012, and in some cases may extend the width of the boat. The rear cross-support member 1040 may help provide support to the flexible cover. In some cases, the rear cross-support member 1040 may help provide support to the flexible cover in both the raised covering position and the lowered covering position, but this is not required.

A biasing element 1044, such as a spring, elastic strap, gas spring, or the like, may bias the rear cross-support member 1040 toward the first U-shaped telescoping member 1012*b* (see, for example, FIG. 39) of the first cover support 1012. In some cases, the rear cross-support member 1040 may have a bend 1042 that causes the end of the rear cross-support member 1040 to extend in an upward direction when the rear cross-support member 1040 is rotated clockwise as the rear cover assembly 1008 is moved to the lowered covering position (see, for example, FIGS. 36, 39 and 42). This may help provide additional support to the flexible cover when in the lowered covering position. The biasing element 1044 (see FIG. 39) may help the rear cross-support member 1040 provide a force against the flexible cover. It is contemplated that more or less than one rear cross-support member may be coupled relative to the first cover support 1012, as desired.

In some embodiments, the second cover support 1014 may also be telescoping so that the length of the second cover support 1014 may be adapted to the particular configuration of the rear cover assembly 1008. More specifically, and as shown in FIGS. 32 and 38, the second cover support 1014 may include a second telescoping member 1014*a*, and a second U-shaped telescoping member 1014*b*. The second U-shaped telescoping member 1014*b* may slide into the second telescoping member 1014*a*, and into an equivalent second telescoping member 1014*a* on the opposite side of the boat. Alternatively, the second U-shaped telescoping member 1014*b* may slide over the second telescoping member 1014*a*, and over an equivalent second telescoping member 1014*a* on the opposite side of the boat, as desired. In some cases, and similar to that described above with respect to the first cover support 1012, a biasing element may be provided between the second telescoping member 1014*a* and the second U-shaped telescoping member 1014*b*. The biasing element may, for example, be configured to bias the second U-shaped telescoping member 1014*b* away from the second telescoping member 1014*a* and toward an extended position. In some cases, just one of the first cover support 1012 and second cover support 1014 may be telescoping, but this is not required. In other cases, neither of the first cover support 1012 or the second cover support 1014 may be telescoping.

In the illustrative embodiment of FIG. 32, the second U-shaped telescoping member 1014*b* may include a bend 1046. The bend 1046 may help the second U-shaped telescoping member 1014*b* extend up and over the side walls 1004 of the boat 1002 and across the boat 1002 when the rear cover assembly 1008 is in the lowered covering position (see, for example, FIGS. 36, 39 and 42). This may be useful when, for example, the end 1039 of the second cover support 1014 terminates at an intermediate location between the front and rear sidewalls 1004 of the boat 1002.

In some cases, a front cross-support member 1050 may also be provided. The front cross-support member 1050 may be rotatably coupled to the second cover support 1014, and in some cases may extend the width of the boat (see also, FIGS. 38 and 39). The front cross-support member 1050 may help provide support to the flexible cover. In some cases, the front cross-support member 1050 may help provide additional support to the flexible cover when the rear cover assembly 1008 is in the raised covering position and the lowered covering position.

A biasing element 1044, such as a spring, elastic strap, gas spring, or the like, may bias the front cross-support member 1050 toward the second U-shaped telescoping member 1014*b* (see, for example, FIG. 39). In some cases, the front cross-support member 1050 may have a bend 1052 that causes the end of the front cross-support member 1050 to extend in an upward direction when the front cross-support member 1050 is rotated in a counter clockwise direction as the rear cover assembly 1008 is articulated to the lowered covering position (see, for example, FIGS. 36, 39 and 42). This may help provide additional support to the flexible cover when in the lowered covering position. The biasing element 1044 (see FIG. 39) may help the front cross-support member 1050 provide a force against the flexible cover, sometimes in both the raised and lowered covering positions. It is contemplated that more or less than one front cross-support member may be coupled relative to the second cover support 1014, as desired.

As indicated above, a flexible cover 1102 may be secured to and between the first U-shaped telescoping member 1012*b* and the second U-shaped telescoping member 1014*b* (see, for example, FIG. 41). The flexible cover 1102 may extend over the edge support member 1036, the rear cross-support member 1040, and the front cross-support member 1050.

In some cases, the flexible cover 1102 may have a first pocket or lumen for receiving the rear cross-support member 1040, and a second pocket or lumen for receiving the front cross-support member 1050, but this is not required. When provided, the pockets may be sufficiently wide to allow the rear cross-support member 1040 and the front cross-support member 1050 to slide relative to the flexible cover when moving between the various articulated positions of the rear cover assembly 1008.

In the illustrative embodiment of FIG. 32, the front cover assembly 1010 is constructed similar to the rear cover assembly 1008 discussed above, except that the front cover assembly 1010 is shown mounted to the boat 1002 in the reverse orientation. That is, the first cover support 1012 of the rear cover assembly 1008 is shown mounted toward the rear of the boat, while the first cover support 1060 of the front cover assembly 1010 is shown mounted toward the front of the boat. Likewise, the second cover support 1014 of the rear cover assembly 1008 is shown mounted toward the front of the boat relative to the first cover support 1012, while the second cover support 1062 of the front cover assembly 1010 is shown mounted toward the rear of the boat relative to the first cover support 1060 of the front cover assembly 1010.

In some cases, the width and/or height dimension of the second cover support 1062 of the front cover assembly 1010 may be different from the width and/or height dimension of the second cover support 1014 of the rear cover assembly 1008. This may help the front of the rear cover assembly 1008 assume an overlap with the rear of the front cover assembly 1010 when both are in their lowered covering positions (see, for example, FIGS. 36, 39 and 42), if desired. In some cases, it may be desirable to have the front of the rear cover assembly 1008 extend over the rear of the front cover assembly 1010 (e.g. when it is desirable to raise the rear cover assembly first), and in other cases, it may be desirable to have the rear of the front cover assembly 1010 extend over the front of the rear cover assembly 1008 (e.g. when it is desirable to raise the front cover assembly first).

However, in some embodiments, the front cover assembly 1010 and the rear cover assembly 1008 may not overlap at all, but rather may abut one another or may be spaced from another when in their lowered covering positions, if desired. In some cases, any space between the front and rear cover assemblies may be covered by a flexible cover insert, which may be attached to the front and rear cover assemblies when both are in their lowered covering positions, but this is not required.

As noted above, it is contemplated that the user of the boat may articulate the rear cover assembly 1008 and/or the front cover assembly 1010 to whatever positions is desired. For example, the user may move the rear cover assembly 1008 from the raised covering position shown in FIG. 32 to a lowered covering position as shown in FIG. 36. When in the raised covering position, the biasing element of the telescoping first support member 1012 and/or the telescoping second support member 1014 may provide a force that pulls the flexible cover 1102 taut, creating a tension in the flexible cover 1102. When so provided, the flexible cover 1102 may be tensioned by the first cover support 1012 and the second cover support 1014 when the rear cover assembly 1008 is in the raised covering position shown in FIG. 32, and in the lowered covering position as shown in FIG. 36. Biasing elements 1044 (see FIG. 39) may bias the rear cross-support member 1040 and the front cross-support member 1050 in an upward direction to provide a force against the flexible cover 1102. When so provided, the rear cross-support member 1040 and the front cross-support member 1050 may provide support to intermediate positions of the flexible cover 1102.

In the illustrative embodiment of FIG. 32, when the rear cover assembly 1008 is moved to the lowered covering position, the length of the flexible cover 1102 may remain approximately the same, and therefore, the first U-shaped telescoping member 1012*b* of the rear cover assembly 1008 may be pushed inward toward the first telescoping member 1012*a*, and the second U-shaped telescoping member 1014*b* may be pushed inward toward the second telescoping member 1014*a*.

At the same time, the tension in the flexible cover 1102 may push the rear cross-support member 1040 down, overcoming the bias member 1044 (see FIG. 39), and rotate the rear cross-support member 1040 in a clockwise direction. When this occurs, the rear cross-support member 1040 may slide in a forward direction relative to the flexible cover 1102. In some cases, a protective or slippery material may be used on the inside surface of the flexible cover 1102 along the expected range of motion of the rear cross-support member 1040, but this is not required. Likewise, the tension in the flexible cover 1102 may push the front cross-support member 1050 down, overcoming the bias member 1044 (see FIG. 39), and rotate the front cross-support member 1050 in a counter-clockwise direction. When this occurs, the front cross-support member 1050 may slide in a rearward direction relative to the flexible cover 1102. In some cases, a protective or slippery material may be used on the inside surface of the flexible cover along the expected range of motion of the front cross-support member 1050, but this is not required. While not required, the bends 1042 and 1052 in the rear and front cross-members 1040 and 1050 may help provide additional support to the flexible cover 1102 when the rear cover assembly 1008 is in the lowered covering position (see FIG. 39). FIGS. 36, 37, 39, 42 and 43 show the rear cover assembly 1008 in the lowered covering position.

When moving the rear cover assembly 1008 from the raised covering position (e.g. FIG. 32) to the raised retracted position (e.g. FIG. 33), the second support member 1014 may be rotated toward the first support member 1012, or visa-versa. In the orientation shown in FIG. 32, and in some cases, the rear cross-support member 1040 may be rotated counter-clockwise toward the first U-shaped telescoping member 1012*b*, and the front cross-support member 1050 may be rotated clockwise toward the second U-shaped telescoping member 1014*b* to provide a compact retracted configuration. As the second support member 1014 is rotated toward the first support member 1012, the tension in the flexible cover 1102 may be released. The flexible cover 1102 may collapse and be bunched up with the assembly as shown in FIG. 45, and in some cases, a boot (not explicitly shown) may be provided over the assembly to provide a clean look. The assembly may be held in the raised retracted position by a pair of support members 1080 (see FIG. 45), if desired. To move the rear cover assembly 1008 from the raised retracted position (e.g. FIGS. 33 and 45) to the lowered retracted position (e.g. FIGS. 34 and 44), the support members 1080 may be released or removed, and the first support member 1012 and the second support member 1014 may be rotated together until the collective assembly is near or against the sidewall 1004 of the boat 1002.

It is contemplated that the front cover assembly 1010 of FIG. 32 may operate in a similar manner to that described with respect to the rear cover assembly 1008 when moved between the various articulated positions. In some cases, only a single cover assembly may be used to provide a cover for a protected area of a boat. In other cases, two cover assemblies may be used to provide a cover for a protected area, as shown in, for example, FIG. 32. In yet other embodiments, three or more cover assemblies may be used to provide a cover for a protected area of a boat, as desired. In some cases, it is contemplated that part of a protected area of a boat may be covered by a flexible cover (e.g. canvas, flexible plastic, an outdoor fabric or the like) that is snapped or otherwise secured to the boat, similar to a conventional mooring cover (e.g. see FIGS. 17 and 18A-18C), and one or more articulating cover assemblies as described herein may be used to cover the remainder of the protected area, if desired.

FIGS. 33-39 and 41-45 show various articulated configurations that may be provided by the illustrative cover system 1000 of FIG. 32. FIG. 33 is a schematic side view of the illustrative cover system of FIG. 32 with the rear cover assembly 1008 in a raised retracted position, and the front cover assembly 1010 in a raised covering position. The flexible covers 1102 and 1104 that can be supported by the rear cover assembly 1008 and the front cover assembly 1010 have been removed in FIGS. 33-39 to better illustrate the operation of the illustrative rear cover assembly 1008 and front cover assembly 1010. However, flexible covers 1102 and 1104 are shown in FIG. 41-45.

With reference to FIG. 33, and from the raised covering position shown in FIG. 32, the second support member 1014 of the rear cover assembly 1008 has been rotated counter-clockwise toward the first support member 1012. Also, the rear cross-support member 1040 has been rotated counter-clockwise toward the first U-shaped telescoping member 1012*b*, and the front cross-support member 1050 has been rotated clockwise toward the second U-shaped telescoping member 1014*b* to provide a compact retracted configuration. As the second support member 1014 is rotated toward the first support member 1012, the tension in the flexible cover 1102 (not shown in FIG. 33) is released. The flexible cover 1102 may collapse and be bunched up with the cover assembly, as shown in FIG. 45, and in some cases, a boot (not explicitly shown) may be provided over the assembly to provide a clean look. The collective assembly may be held in the raised retracted position by a pair of support members generally indicated at 1080, if desired.

FIG. 34 is a schematic side view of the illustrative cover system of FIG. 32 with the rear cover assembly 1008 in a lowered retracted position, and the front cover assembly 1010 in a raised covering position. To move the rear cover assembly 1008 from the raised retracted position (e.g. FIGS. 33 and 45) to the lowered retracted position (e.g. FIGS. 34 and 44), the support members 1080 may be released or removed, and the first support member 1012 and the second support member 1014 may be rotated together until the collective assembly is near or against the sidewall 1004 of the boat 1002, as shown.

FIG. 35 is a schematic side view of the illustrative cover system of FIG. 32 with both the rear cover assembly 1008 and the front cover assemblies 1010 in raised retracted positions. Movement of the rear cover assembly 1008 from the raised covering position of FIG. 32 to the raised retracted position has been discussed above with respect to FIG. 33. Movement of the front cover assembly 1010 may operated in a similar manner. For example, from the raised covering position shown in FIG. 32, the second cover support 1062 of the front cover assembly 1010 has been rotated in a clock-wise direction toward the first cover support 1060. Also, a front cross-support member 1082 has been rotated clockwise toward the first cover support 1060, and rear cross-support member 1084 has been rotated counter-clockwise toward the second support member 1062 to provide a compact retracted configuration. As the second cover support 1062 is rotated toward the first cover support 1060, the tension in the flexible cover 1104 (not shown in FIG. 35) is released. The flexible cover 1104 may collapse and be bunched up with the assembly, as shown in FIG. 45, and in some cases, a boot (not shown) may be provided over the assembly to provide a clean look. The collective assembly may be held in the raised retracted position by a pair of support members 1080, if desired.

FIG. 36 is a schematic side view of the illustrative cover system of FIG. 32 with the rear cover assembly 1008 in a lowered covering position, and the front cover assembly 1010 in a raised covering position. From the raised covering position shown in FIG. 32, the rear cover assembly 1008 may be moved from the raised covering position to the lowered covering position, and visa-versa. When in the raised covering position, the biasing element (e.g. biasing element 1030 or 1032 of FIG. 40A, or biasing spring 1096 of FIG. 40B) of the telescoping first support member 1012 and/or the biasing element (e.g. biasing element 1030 or 1032 of FIG. 40A, or biasing spring 1096 of FIG. 40B) of telescoping second support member 1014, may provide a force that pulls the flexible cover 1102 taut (see, for example, FIG. 41), creating a tension in the flexible cover 1102. At the same time, the biasing elements 1044 (see FIG. 39) may bias the rear cross-support member 1040 and the front cross-support member 1050 in an upward direction to provide a force against the flexible cover 1102. In this configuration, the rear cross-support member 1040 and the front cross-support member 1050 may provide support to intermediate positions of the flexible cover 1102, if desired.

In the illustrative embodiment, when the rear cover assembly 1008 is moved to the lowered covering position as shown in FIG. 36, the length of the flexible cover 1102 may remain approximately the same, and therefore, the first U-shaped telescoping member 1012*b* of the rear cover assembly 1008 may be pushed inward toward the first telescoping member 1012*a*, and the second U-shaped telescoping member 1014*b* may be pushed inward toward the second telescoping member 1014*a*. At the same time, the tension in the flexible cover 1102 may push the rear cross-support member 1040 down, against the force of the bias member 1044 (see FIG. 39), and rotate the rear cross-support member 1040 in a clockwise direction. When this occurs, the rear cross-support member 1040 may slide in a forward direction relative to the flexible cover 1102. In some cases, a protective or slippery material may be used on the inside surface of the flexible cover 1102 along the expected range of motion of the rear cross-support member 1040, but this is not required. Likewise, the tension in the flexible cover 1102 may push the front cross-support member 1050 down, against the force of its bias member 1044 (see FIG. 39), and rotate the front cross-support member 1050 in a counter-clockwise direction. When this occurs, the front cross-support member 1050 may slide in a rearward direction relative to the flexible cover 1102. In some cases, a protective or slippery material may be used on the inside surface of the flexible cover 1102 along the expected range of motion of the front cross-support member 1050, but this is not required. While not required, the bends 1042 and 1052 in the rear and front cross-members 1040 and 1050 may help provide additional support to the flexible cover 1102 when the rear cover assembly 1008 is in the lowered covering position as shown in FIG. 36. The reverse may occur when the rear cover assembly 1008 is moved from the lowered covering position (e.g. see, FIG. 36) to the raised covering position (e.g. see, FIG. 32).

FIG. 37 is a schematic side view of the illustrative cover system of FIG. 32 with both the rear cover assembly 1008 and the front cover assembly 1010 in their lowered covering positions. FIG. 39 is a perspective view showing both the rear cover assembly 1008 and the front cover assembly 1010 in lowered covering positions. From the raised covering position shown in FIG. 36, the front cover assembly 1010 may be moved from the raised covering position to the lowered covering position, and visa-versa. When in the raised covering position, the biasing element (e.g. biasing element 1030 or 1032 of FIG. 40A, or biasing spring 1096 of FIG. 40B) of the telescoping first support member 1060 and the biasing element (e.g. biasing element 1030 or 1032 of FIG. 40A, or biasing spring 1096 of FIG. 40B) of telescoping second support member 1062 may provide a force that pulls the flexible cover 1104 taut (see, for example, FIG. 41), creating a tension in the flexible cover 1104. At the same time, the biasing elements 1044 (see FIG. 39) may bias the rear cross-support member 1084 and the front cross-support member 1082 in an upward direction to provide a force against the flexible cover 1104. In this configuration, the rear cross-support member 1084 and the front cross-support member 1082 may provide support to intermediate positions of the flexible cover 1104, if desired.

In the illustrative embodiment, when the front cover assembly 1010 is moved to the lowered covering position as shown in FIG. 37, the length of the flexible cover 1104 may remain approximately the same, and therefore, the telescoping first support member 1060 and the telescoping second support member 1062 may become contracted. At the same time, the tension in the flexible cover 1104 may push the rear cross-support member 1084 down, against the force of the bias member 1044 (see FIG. 39), and rotate the rear cross-support member 1084 in a clockwise direction. When this occurs, the rear cross-support member 1084 may slide in a forward direction relative to the flexible cover 1104. In some cases, a protective and/or slippery material may be used on the inside surface of the flexible cover 1104 along the expected range of motion of the rear cross-support member 1084, but this is not required. Likewise, the tension in the flexible cover 1104 may push the front cross-support member 1082 down, against the force of its bias member 1044 (see FIG. 39), and rotate the front cross-support member 1082 in a counter-clockwise direction. When this occurs, the front cross-support member 1082 may slide in a rearward direction relative to the flexible cover 1104. In some cases, a protective and/or slippery material may be used on the inside surface of the flexible cover 1104 along the expected range of motion of the front cross-support member 1082, but this is not required. While not required, bends in the rear and front cross-members 1084 and 1082 may help provide additional support to the flexible cover 1104 when the front cover assembly 1010 is in the lowered covering position as shown in FIG. 37, if desired. The reverse may occur when the front cover assembly 1010 is moved from the lowered covering position (e.g. see, FIG. 27) to the raised covering position (e.g. see, FIG. 32).

FIG. 41 is a perspective view of the illustrative cover system of FIG. 32 with both the rear cover assembly 1008 and the front cover assembly 1010 in their raised covering positions, similar to that shown in FIGS. 32 and 38, but with the flexible covers 1102 and 1104 shown. In the illustrative embodiment, a rear end of the rear flexible cover 1102 may be secured to the first U-shaped telescoping member 1012*b*. The rear end of the rear flexible cover 1102 may, in some cases, include a pocket, lumen or sleeve that receives the first U-shaped telescoping member 1012*b*. Alternatively, or in addition, the rear end of the rear flexible cover 1102 may be snapped or otherwise secured relative to the first U-shaped telescoping member 1012*b*, as desired. Likewise, a front end of the rear flexible cover 1102 may be secured to the second U-shaped telescoping member 1014*b*. The front end of the rear flexible cover 1102 may, in some cases, include a pocket, lumen or sleeve that receives the second U-shaped telescoping member 1014*b*. Alternatively, or in addition, the front end of the rear flexible cover 1102 may be snapped or otherwise secured relative to the second U-shaped telescoping member 1014*b*, as desired. The front flexible cover 1104 may be secured to the front cover assembly 1010 in a similar manner.

In some illustrative embodiments, the rear flexible cover 1102 and/or the front flexible cover 1104 may be made from a material that is relatively non-compliant (non-stretchy) in the plane of the flexible cover, but this is not required. When so provided, and as described above, the length of the flexible covers 1102 and 1104 may remain approximately the same, regardless of the articulated position of the corresponding cover assembly 1008 and 1010. As such, and using the rear cover assembly 1008 as an example, the first U-shaped telescoping member 1012*b* of the rear cover assembly 1008 may be pushed inward toward the first telescoping member 1012*a*, and the second U-shaped telescoping member 1014*b* may be pushed inward toward the second telescoping member 1014*a*, when the rear cover assembly 1008 is moved from the raised covering position to the lowered covering position. In some cases, the rear flexible cover 1102 and/or the front flexible cover 1104 may be made from, for example, a canvas, a flexible plastic (e.g. polyester, nylon, etc.), an outdoor fabric such SunBrella™ available from Glen Raven Custom Fabrics, LLC of Glen Raven, N.C., or any other suitable material or combination of materials, as desired.

In FIG. 41, the rear of the front flexible cover 1104 is shown extending over the front of the rear flexible cover 1102 in the raised covering position. In other embodiments, the front of the rear flexible cover 1102 may extend over the rear of the front flexible cover 1104. In yet other embodiments, the rear of the front flexible cover 1104 may abut or be spaced from the front of the rear flexible cover 1102 in the raised covering position. When spaced from, and in some cases, it is contemplated that a flexible cover insert may be provided between the rear flexible cover 1102 and the front flexible cover 1104, but this is not required. The flexible cover insert may be permanently or selectively secured (e.g. via zipper(s), snaps, hook and loop fasteners such as Velcro™, etc.) to the rear flexible cover 1102 and/or the front flexible cover 1104, if desired.

FIG. 42 is a perspective view of the illustrative cover system of FIG. 32 with the rear cover assembly 1008 in a lowered covering position, and the front cover assembly 1010 in a raised covering position similar to FIG. 36, but with flexible covers 1102 and 1104 shown. In the illustrative embodiment of FIG. 42, and in the lowered covering position, the perimeter of the rear cover assembly 1008 may extend laterally out to at least the side walls 1004 of the boat 1002 to provide a cover for the rear part of the protected area. In some cases, the perimeter of the flexible cover 1102 of the rear cover assembly 1008 may extend laterally out past the side walls 1004 of the boat 1002, and in some cases, overlap in a downward vertical direction over a top portion of the side walls 1004 of the boat, but this is not required. Such a vertical overlap may, in some cases, help provide better protection to the interior of the boat 1002 from wind swept rain, blowing dirt, dust, debris, etc.

FIG. 43 is a perspective view of the illustrative cover system of FIG. 32 with the rear cover assembly 1008 and the front cover assembly 1010 in lowered covering positions similar to FIGS. 37 and 39, but with flexible covers 1102 and 1104 shown. In the illustrative embodiment of FIG. 43, and in the lowered covering position, the perimeter of the front cover assembly 1010 may extend laterally out to at least the side walls 1004 of the boat 1002 to provide a cover for the front part of the protected area. In some cases, the perimeter of the flexible cover 1104 of the front cover assembly 1010 may extend laterally out past the side walls 1004 of the boat 1002, and in some cases, overlap in a downward vertical direction over a top portion of the side walls 1004 of the boat 1002, but this is not required. Such a vertical overlap may, in some cases, help provide better protection to the interior of the boat 1002 from wind swept rain, blowing dirt, dust, debris, etc.

In FIG. 43, the rear of the front flexible cover 1104 is shown extending over the front of the rear flexible cover 1102 in the lowered covering position. In other cases, however, it is contemplated the front of the rear flexible cover 1102 may extend over the rear of the front flexible cover 1104. In yet other cases, the rear of the front flexible cover 1104 may abut or be spaced from the front of the rear flexible cover 1102 in the lowered covering position. When spaced from, and in some cases, it is contemplated that a flexible cover insert may be provided between the rear flexible cover 1102 and the front flexible cover 1104, but this is not required. The flexible cover insert may be permanently or selectively secured (e.g. via zipper(s), snaps, hook and look fasteners such as Velcro™, etc.) to the rear flexible cover 1102 and/or the front flexible cover 1104, as desired.

FIG. 44 is a perspective view of the illustrative cover system of FIG. 32 with the rear cover assembly 1008 in a lowered retracted position and the front cover assembly 1010 in a raised covering position similar to FIG. 34, but with flexible covers 1102 and 1104 shown. Beginning in the raised covering position shown in FIG. 41 (see also, FIG. 32), the second support member 1014 of the rear cover assembly 1008 has been rotated counter-clockwise toward the first support member 1012. Also, the rear cross-support member 1040 has been rotated counter-clockwise toward the first U-shaped telescoping member 1012*b*, and the front cross-support member 1050 has been rotated clockwise toward the second U-shaped telescoping member 1014*b* to provide a compact retracted configuration. As the second support member 1014 is rotated toward the first support member 1012, the tension in the flexible cover 1102 may be released. The flexible cover 1102 may collapse and be bunched up with the assembly, as shown in FIG. 45, and in some cases, a boot (not explicitly shown) may be provided over the assembly to provide a clean look. In some cases, the collective assembly may be held in the raised retracted position by a pair of support members 1080 as shown in FIG. 45, if desired. As discussed above with reference to FIG. 34, to move the rear cover assembly 1008 from the raised retracted position (e.g. FIGS. 33 and 45) to the lowered retracted position (e.g. FIGS. 34 and 44), the first support member 1012 and the second support member 1014 may be rotated together until the collective assembly is near or against the sidewall 1004 of the boat 1002, as shown in FIG. 44.

FIG. 45 is a perspective view of the illustrative cover system of FIG. 32 with both the rear cover assembly 1008 and the front cover assembly 1010 in raised retracted positions similar to FIG. 35, but with flexible covers 1102 and 1104 shown. The front cover assembly 1010 may be moved to the raised retracted position as shown in FIG. 45 in a similar manner as the rear cover assembly 1008. For example, from the raised covering position shown in FIGS. 32 and 44, the second cover support 1062 of the front cover assembly 1010 has been rotated clockwise toward the first cover support 1060. Also, a front cross-support member 1082 has been rotated clockwise toward the first cover support 1060, and the rear cross-support member 1084 has been rotated counter-clockwise toward the second support member 1062 to provide a compact retracted configuration. As the second cover support 1062 is rotated toward the first cover support 1060, the tension in the flexible cover 1104 is released. The flexible cover 1104 may collapse and be bunched up with the assembly, as shown in FIG. 45, and in some cases, a boot (not explicitly shown) may be provided over the assembly to provide a clean look. The collective assembly may be held in the raised retracted position by a pair of support members 1080, if desired.

Figure 46A:
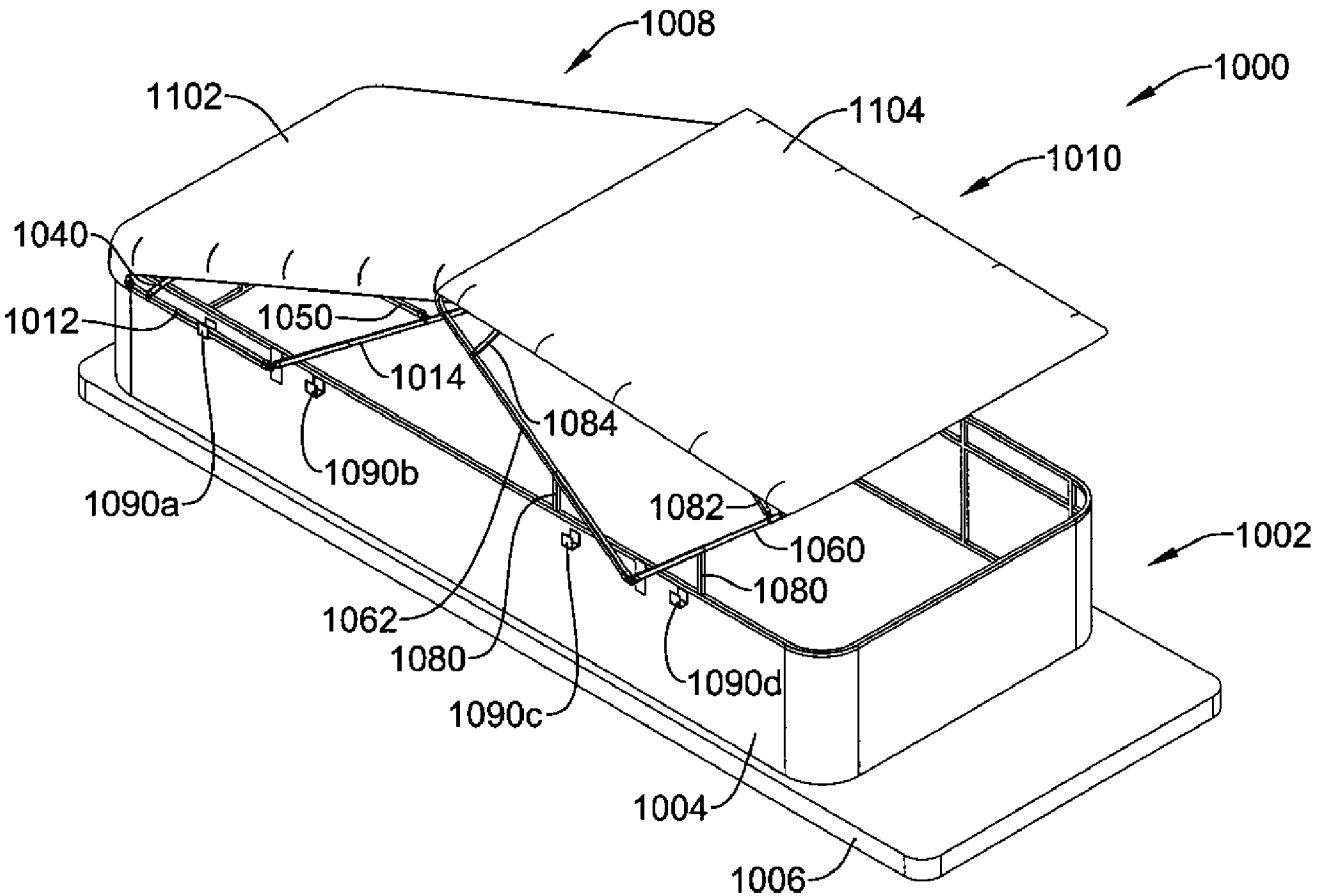
FIGS. 46A-46C are perspective views of the illustrative cover system of FIG. 32 showing an illustrative method for moving the cover system between the raised covering position and the lowered covering position.
Figure 46B:
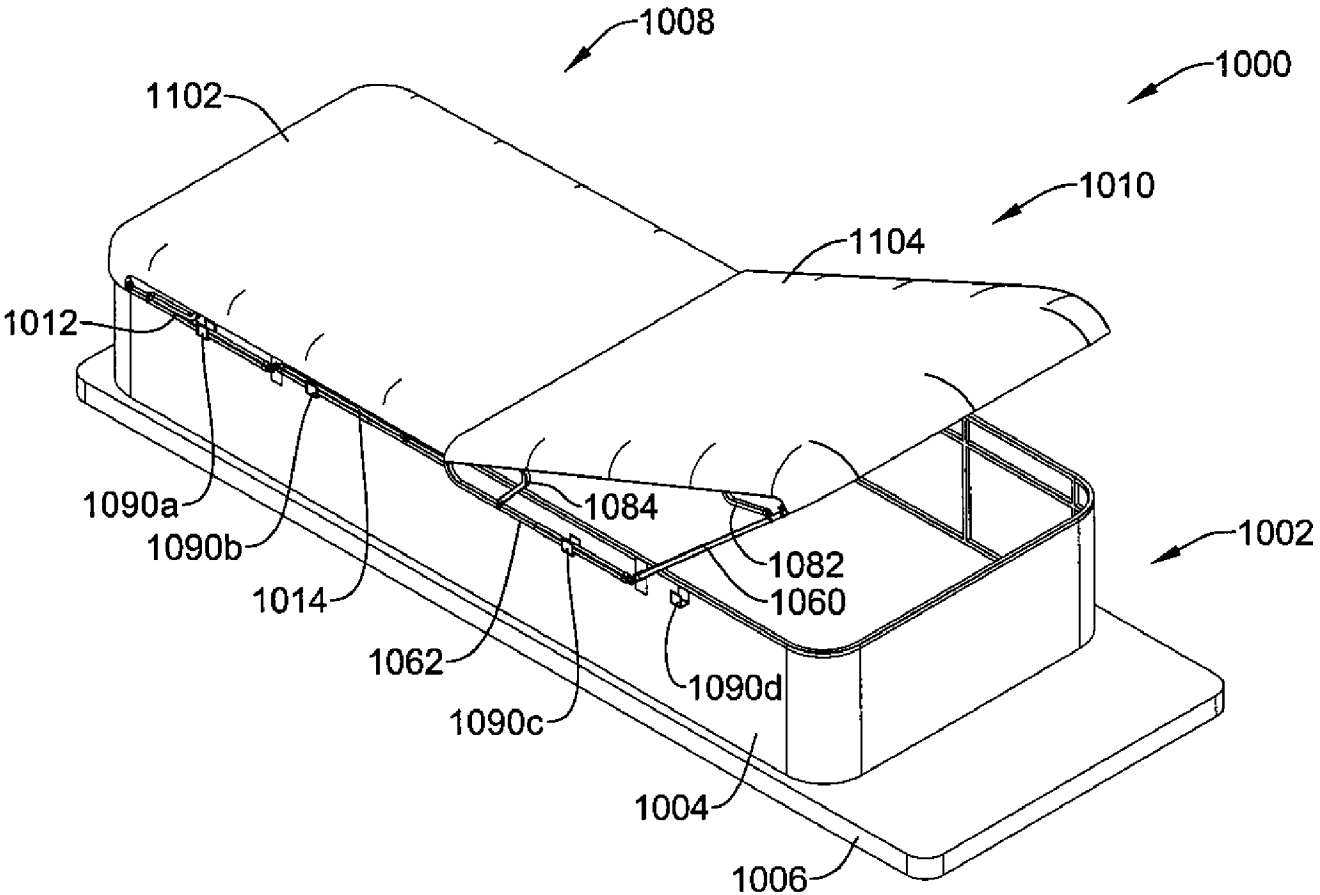
Figure 46C:
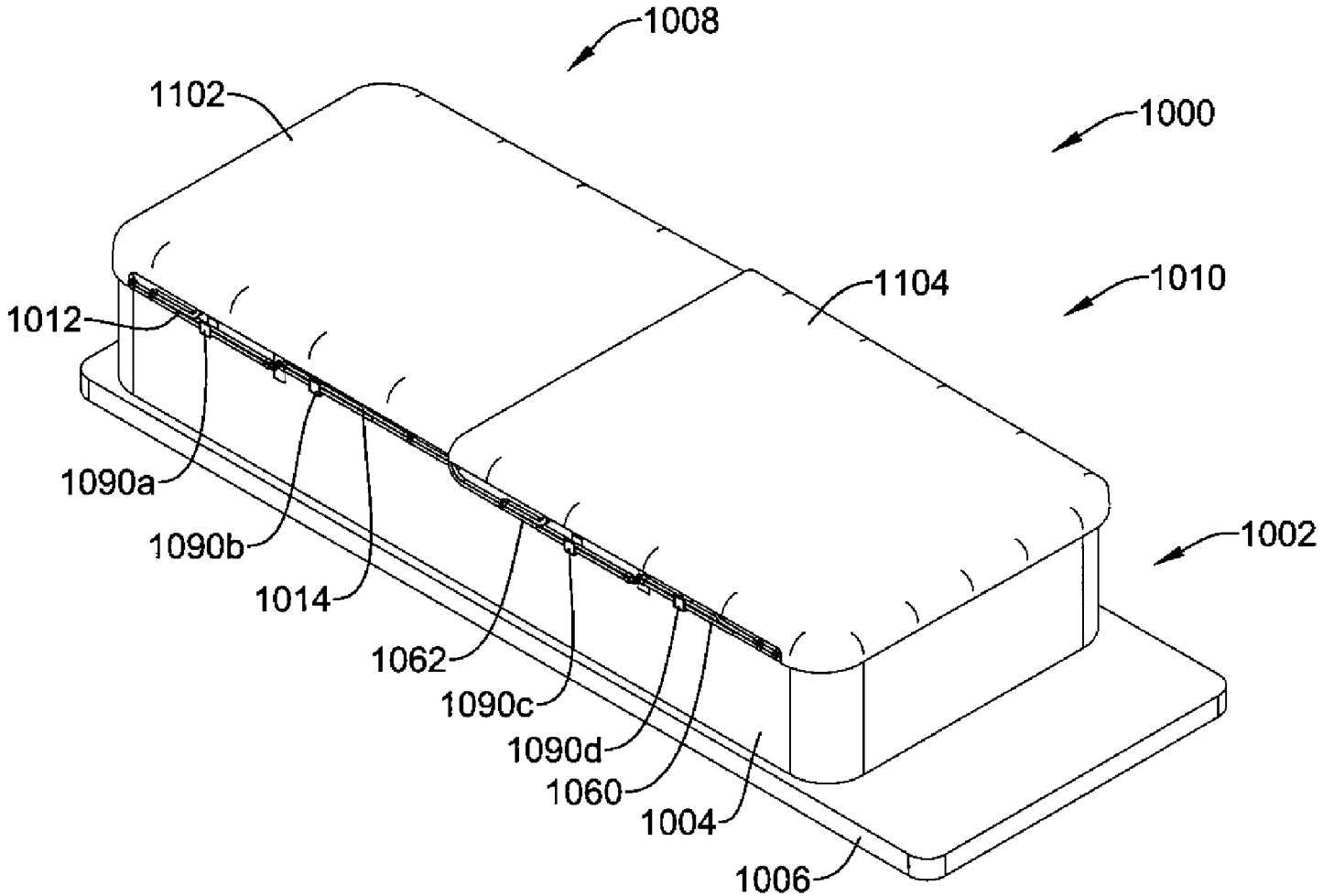

FIG. 46A-46C are perspective views of the illustrative cover system of FIG. 32 showing an illustrative method for moving the cover system 1000 between the raised covering position and the lowered covering position. In the illustrative method, the rear end of the rear cover assembly 1008 may be moved down and secured relative to the boat, as shown in FIG. 46A. In some cases, the rear end of the rear cover assembly 1008 is secured relative to the boat via one or more latching elements, such as latching element 1090*a*. It is contemplated that the latching element 1090*a* may be located at any suitable location that is capable of latching or otherwise selectively securing the rear end of the rear cover assembly 1008 relative to the boat. For example, the latching element 1090*a* may be located along the side of the boat 1002 as shown in FIG. 46A, along the back of the boat, or at any other suitable location. In some cases, more than one latching element 1090*a* may be used to help latch or otherwise selectively securing the rear end of the rear cover assembly 1008 relative to the boat 1002.

With the rear end of the rear cover assembly 1008 selectively secured relative to the boat 1002, the front end of the rear cover assembly 1008 may be moved down and secured relative to the boat 1002, as shown in FIG. 46B. In some cases, the front end of the rear cover assembly 1008 is secured relative to the boat via one or more latching elements, such as latching element 1090*b*. It is contemplated that the latching element 1090*b* may be located at any suitable location that is capable of latching or otherwise selectively securing the front end of the rear cover assembly 1008 relative to the boat. In some cases, more than one latching element 1090*b* may be used to help latch or otherwise selectively securing the front end of the rear cover assembly 1008 relative to the boat.

With the front end of the rear cover assembly 1008 selectively secured relative to the boat, the rear end of the front cover assembly 1010 may be moved down and secured relative to the boat, as also shown in FIG. 46B. In some cases, the rear end of the front cover assembly 1010 is secured relative to the boat via one or more latching elements, such as latching element 1090*c*. It is contemplated that the latching element 1090*c* may be located at any suitable location that is capable of latching or otherwise selectively securing the rear end of the front cover assembly 1010 relative to the boat 1002. In some cases, more than one latching element 1090*c* may be used to help latch or otherwise selectively securing the rear end of the front cover assembly 1010 relative to the boat.

With the rear end of the front cover assembly 1010 selectively secured relative to the boat 1002, the front end of the front cover assembly 1010 may be moved down and secured relative to the boat 1002, as shown in FIG. 46C. In some cases, the front end of the front cover assembly 1010 is secured relative to the boat 1002 via one or more latching elements, such as latching element 1090*d*. It is contemplated that the latching element 1090*d* may be located at any suitable location that is capable of latching or otherwise selectively securing the front end of the front cover assembly 1010 relative to the boat. For example, the latching element 1090*d* may be located along the side of the boat 1002 as shown in FIG. 46C, along the front of the boat, or at any other suitable location. In some cases, more than one latching element 1090*d* may be used to help latch or otherwise selectively securing the front end of the front cover assembly 1010 relative to the boat. By releasing the latching elements in the reverse order, the cover system 1000 may be moved from the lowered covering position to the raised covering position.

As can be seen, this illustrative method may help move the cover system 1000 between the raised covering position and the lowered covering position in a relatively easy manner, even by a single person. The illustrative method shown in FIGS. 46A-46C is only meant to be illustrative, and it is contemplated that any suitable method may be used. For example, it is contemplated that the front end of the front cover assembly 1010 may be moved down first, followed by the rear end of the front cover assembly 1010, followed by the front end of the rear cover assembly 1008, and concluding with the rear of the rear cover assembly 1008. When such an alternative method is used, and when an overlap is desired between the front of the rear cover assembly 1008 and the rear of the front cover assembly 1010, it may be desirable to have the front of the rear cover assembly 1008 extend over the rear of the front cover assembly 1010.

It is also contemplated that both the front end and the rear end of the front cover assembly 1010 may be moved between the raised covering position and the lowered covering position simultaneously or substantially simultaneously. Likewise, it is contemplated that both the front end and the rear end of the rear cover assembly 1008 may be moved between the raised covering position and the lowered covering position simultaneously or substantially simultaneously. It is also contemplated that the rear cover assembly 1008 and the front cover assembly 1010 may be moved between the raised covering position and the lowered covering position simultaneously or substantially simultaneously.

Figure 47:
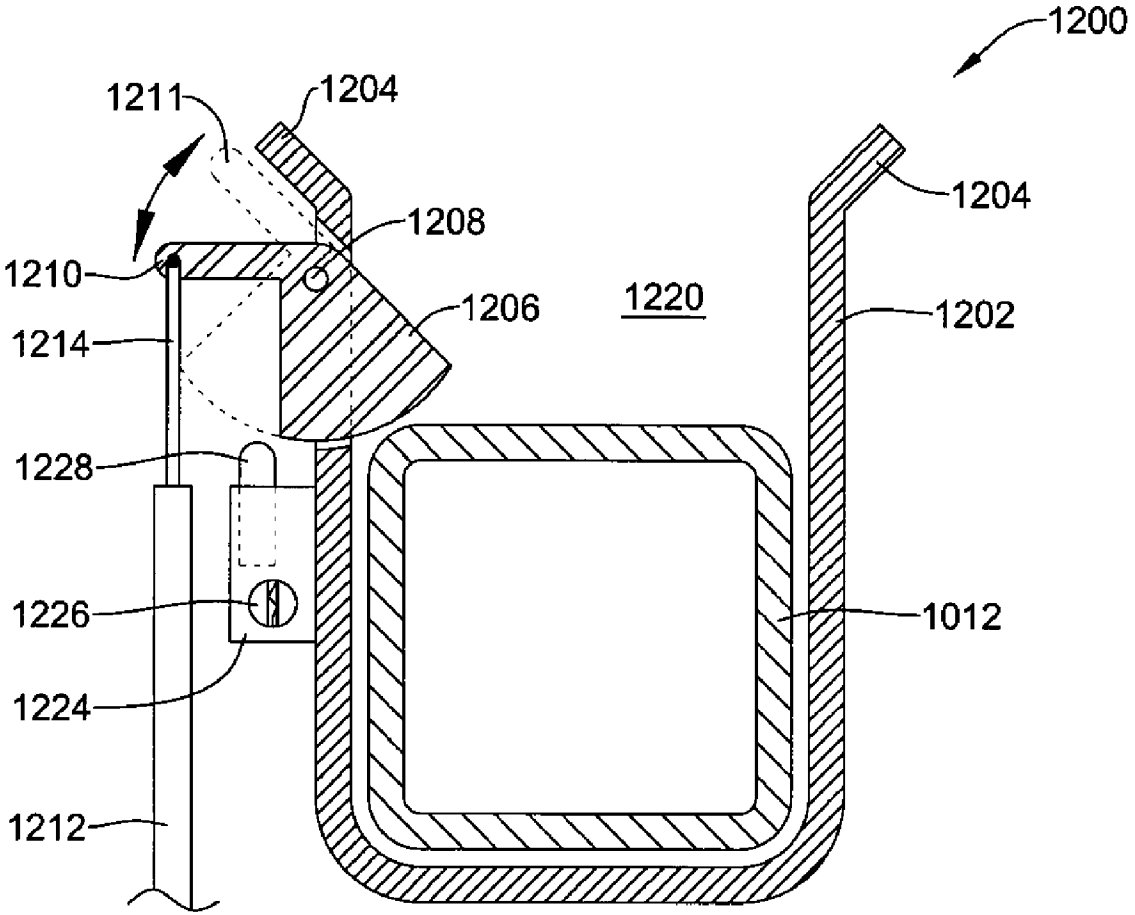
FIG. 47 is a partial cross-sectional side view of an illustrative latch that may be used to latch the cover system in the lowered covering and/or lowered retracted positions.

FIG. 47 is a partial cross-sectional side view of an illustrative latching element 1200 that may be used to latch a cover system to the boat in the lowered covering and/or lowered retracted positions. In some cases, the latching elements 1090*a*-1090*d* may be similar to latching element 1200, but this is not required. The illustrative latching element of FIG. 47 includes a housing 1202 that has a generally U-Shape, and defines a channel 1220. The terminating ends of the U-shaped housing 1202 may define a guide flange 1204, when such a guide flange 1204 is desired. The channel 1220 may be configured to receive, for example, the first support member 1012, the second support member 1014 or some other part of a cover assembly. When provided, the guide flange 1204 may help guide the first support member 1012, second support member 1014 or other part of a cover assembly into the channel 1220.

A latch member 1206 is shown rotatable about a pivot 1208. In a latching position, the illustrative latch member 1206 extends through the housing 1202 and into the channel 1220. In a releasing position, the latch member 1206 rotates about the pivot 1208 and out of the channel 1200, as shown by dashed lines at 1211. The latch member 1206 may include a handle 1210 that may be used to move the latch member 1206 between the latching position and the releasing position 1211. In some cases, the latch member 1206 may be biased toward the latching position via a spring or the like (not explicitly shown), but this is not required.

During use, and in one illustrative embodiment, as a cover assembly such as rear cover assembly 1008 of FIG. 46A is moved to the lowered covering and/or lowered retracted positions, the first support member 1012 may eventually arrive near the channel 1220. When provided, the guiding flange 1204 may help guide the first support member 1012 into the channel 1220. As the first support member 1012 is moved further into the channel 1220, the first support member 1012 may move the latch member 1206 toward the releasing position as shown at 1211. Once the top of the first support member 1012 clears the lower end of the latch member 1206, the latch member 1206 may move to the latching position, sometimes under the influence of a bias spring or the like. Once in the latching position, the latch member 1206 may hold the first support member 1012 within the housing 1202. To raise the cover assembly from the lowered covering and/or lowered retracted positions, the handle 1210 of the latch member 1206 may be used to rotate the latch member 1206 to the releasing position 1211. When the in releasing position 1211, the first support member 1012 may slide past the latching member 1206 and out of the channel 1220.

In some cases, the latching element 1200 may operate under human power. For example, a user of the boat may move the handle 1210 of the latch member 1206 from the latching position to the releasing position 1211. In some cases, it may be more convenient to operate the latch element 1200 from a location that is remote from the latch element 1200. When this is desirable, a cable 1212 or the like may be used to move the position of the latch member 1206 between the latching position and the releasing position. In the illustrative embodiment, the cable 1212 may include an outer sheath surrounding an internal cable member 1214. The cable 1212 may be, for example, similar to a bike cable commonly used to activate the brakes and/or gear shifters of a bicycle. A latch activating unit (not explicitly shown) may be coupled to the other end of the cable 1212 and may be located at a location remote from the latching element 1200, such at the front and/or rear of a cover assembly. When activated by the user, the latch activating unit may slide the cable member 1214 relative to the sheath, and move the position of the latch member 1206 to a desired functional position. Alternatively, or in addition, it is contemplated that the latching element 1200 may be actuated between the latching position and the releasing position using an actuator. For example, the latching element 1200 may be actuated via a solenoid actuator, an electric motor actuator, or any other suitable actuator, as desired.

In some cases, a locking mechanism 1224 may be provided. The locking mechanism 1224 may allow a user to lock the latch, for example, in the latching position. In one illustrative embodiment, the locking mechanism 1224 may include a locking pin 1228 that, when in the locked position, moves in an upward direction in FIG. 47 to prevent the latch member 1206 from moving to the releasing position 1211. Under some circumstances, such a locking mechanism may help prevent unauthorized users from raising the cover assembly and gaining access to the boat. It is contemplated that the locking mechanism 1224 may be switched from a locked position to an unlocked position via a key that may be inserted into a key hole 1226. In other cases, the locking mechanism 1224 may be controlled via an actuator, such as a solenoid actuator, an electric motor actuator, or any other suitable actuator, as desired.

FIG. 47 shows just one example of a suitable latching element 1200. It is contemplated, however, that any suitable latching element may be used, when a latching element is desired. Further, it is contemplated that a latching element may be mounted to the boat, and may accept part of a cover assembly to latch the cover assembly relative to the boat, as shown in FIG. 47. In other cases, a latching element may be mounted to a cover assembly, and may accept part of the boat to latch the cover assembly relative to the boat. In yet other cases, a first part of a latching element may be mounted to a cover assembly and a second part may be mounted to the boat, where the first part and the second part of the latching element may be configured to engage each other in order to secure the cover assembly relative to the boat. These are some examples of suitable alternative latching elements.

Figure 48B:
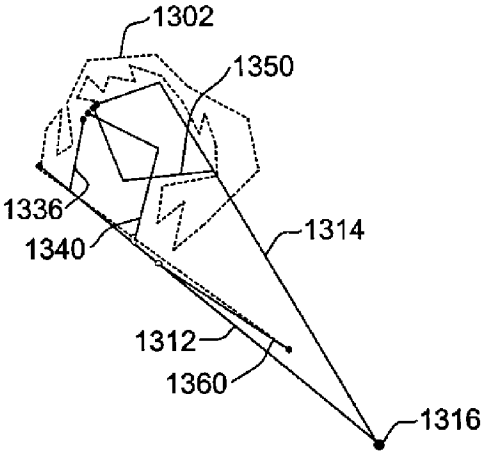
FIGS. 48A-48C are schematic side views of another illustrative cover system for a boat in a raised covering position, a raised retracted position and a lowered covering position, respectively.
Figure 48A:
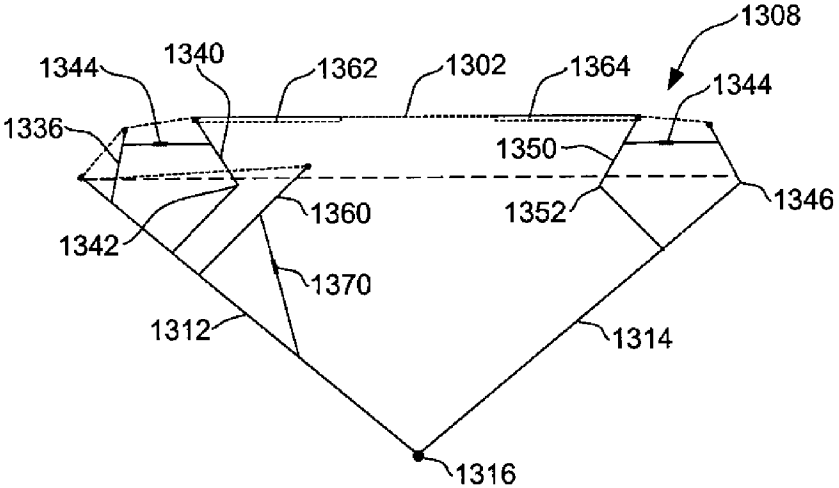
Figure 48C:
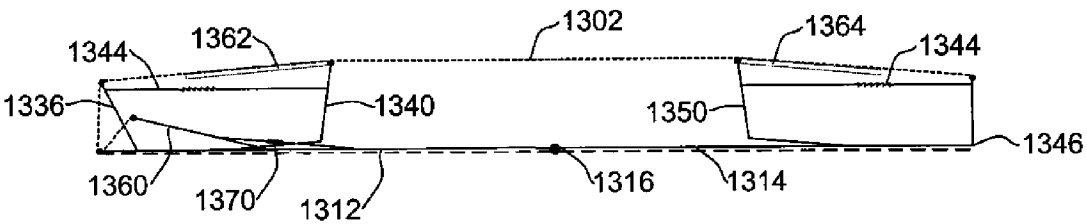

FIGS. 48A-48C are schematic side views of another illustrative cover assembly 1308 for a boat in a raised covering position, a raised retracted position and a lowered covering position, respectively. With respect to FIG. 48A, the illustrative cover assembly 1308 includes a first cover support 1312 and a second cover support 1314. In the illustrative embodiment, the first cover support 1312 has a lower end that is rotatably coupled to a boat via rotatable coupling 1316 (see, for example, FIGS. 49A-49B). The rotatable coupling 1316 may allow the first cover support 1312 to rotate about a rotation axis, which in the embodiment shown, extends into the page of FIG. 48A. Likewise, the second cover support 1314 may have a lower end that is rotatably coupled to a boat via rotatable coupling 1316. Again, the rotatable coupling 1316 may allow the second cover support 1314 to rotate about a rotation axis, which in the embodiment shown, also extends into the page of FIG. 48A. In the illustrative embodiment, the rotation axis of the first cover support 1312 and the rotation axis of the second cover support 1314 may be laterally offset relative to one another, so that when the second cover support 1314 is rotated back toward the first cover support 1312 (e.g. in a raised retracted position as shown in FIG. 48B, or lowered retracted position), the second cover support 1314 may not interfere with the first cover support 1312, but this is not required. In some embodiments, the first cover support 1312 and the second cover support 1314 may rotate along a common rotation axis. In some cases, the first cover support 1312 may be offset in a direction along the common rotation axis relative to the second cover support 1314. While the lower ends of the first cover support 1312 and second cover support 1314 are shown coupled to a common rotatable coupling 1316, it is contemplated that they may be coupled to separate rotatable couplings, if desired.

In the illustrative embodiment of FIG. 48A, the first cover support 1312 may be generally U-shaped, and may extend from rotatable coupling 1316 on the starboard side of a boat to a rotatable coupling (not shown) on the port side of the boat. Likewise, the second cover support 1314 may be generally U-shaped, and may extend from rotatable coupling 1316 on the starboard side of a boat to a rotatable coupling (not shown) on the port side of the boat. While the first cover support 1312 and the second cover support 1314 may be generally U-shaped, this is not required in all embodiments.

In some embodiments, an edge support member 1336 may be rigidly coupled to the first cover support 1312, and may extend the width of the boat. In the illustrative embodiment, the edge support member 1336 extends at an angle relative to first cover support 1312, but this is not required. When provided, the edge support member 1336 may help keep a flexible cover 1302 from engaging the top of a side wall of a boat when the cover assembly 1308 is articulated to the lowered covering position (see, for example, FIGS. 48C and 49A-49B). In some cases, a similar edge support member may be rigidly coupled to the second cover support 1314, and may extend the width of the boat.

A rear cross-support member 1340 may also be provided, when desired. The rear cross-support member 1340 may be rotatably coupled to the first cover support 1312, and in some cases may extend the width of the boat. The rear cross-support member 1340 may help provide support to the flexible cover 1302. In some cases, the rear cross-support member 1340 may help provide support to the flexible cover 1492 in both the raised covering position (see FIG. 48A) and the lowered covering position (see FIG. 48C). A biasing element 1344, such as a spring, elastic strap, gas spring, or the like, may bias the rear cross-support member 1340 toward the first cover support 1312. In some cases, the rear cross-support member 1340 may have a bend 1342 that causes the rear cross-support member 1340 to extend in an upward direction when the rear cross-support member 1340 is rotated in a clockwise direction in FIG. 48A as the cover assembly 1308 is moved to the lowered covering position (see, for example, FIG. 48C). This may help provide additional support to the flexible cover 1302 when in the lowered covering position. The biasing element 1344 may help the rear cross-support member 1340 provide a force against the flexible cover 1302. It is contemplated that more or less than one rear cross-support member may be coupled relative to the first cover support 1312, if desired.

In some embodiments, the second cover support 1314 may be similar to the first cover support 1312. In some cases, the second cover support 1314 may include a bend 1346. When provided, the bend 1346 may help the second cover support 1314 extend up over side walls of a boat and across the boat when the cover assembly 1308 is in the lowered covering position (see, for example, FIG. 49B). However, when the cover assembly 1308 does not need to extend up over the side walls of a boat, the bend 1346 may not be provided. In some cases, an edge support member similar to edge support member 1336 may be rigidly coupled to the second cover support 1314, and in some cases, may extend the width of the boat, if desired.

It is contemplated that a front cross-support member 1350 may also be provided. The front cross-support member 1350 may be rotatably coupled to the second cover support 1314, and in some cases, may extend the width of the boat. The front cross-support member 1350 may help provide support to the flexible cover 1302. In some cases, the front cross-support member 1350 may help provide additional support to the flexible cover 1302 when the cover assembly 1308 is in the raised covering position (see FIG. 48A) and the lowered covering position (see, FIG. 48C). A biasing element 1344, such as a spring, elastic strap, gas spring, or the like, may bias the front cross-support member 1350 toward the second cover support 1314. In some cases, the front cross-support member 1350 may have a bend 1352 that causes the end of the front cross-support member 1350 to extend in an upward direction when the front cross-support member 1350 is rotated counter clockwise in FIG. 48A as the cover assembly 1308 is articulated to the lowered covering position (see, for example, FIG. 48C). This may help provide additional support to the flexible cover 1302 when in the lowered covering position. The biasing element 1308 may help the front cross-support member 1350 provide a force against the flexible cover 1302. It is contemplated that more or less than one front cross-support member may be coupled relative to the second cover support 1314, as desired.

In the illustrative embodiment, the flexible cover 1302 may be secured to the second cover support 1314, extends over the front cross-support member 1350, the rear cross-support member 1340, over the edge support member 1336, around the first cover support 1312 and to a flexible cover tension member 1360. The flexible cover tension member 1360 may provide a tension force to the flexible cover 1302 in the lengthwise direction of the flexible cover 1302. A bias member 1370, such as a spring, elastic strap, gas spring, or the like, may bias the flexible cover tension member 1360 away from the first cover support 1312 to create the desired tension force in the flexible cover 1302. It is contemplated that the flexible cover 1302 may be made from a flexible material such as a canvas, a flexible plastic (e.g. polyester, nylon, etc.), an outdoor fabric such SunBrella™ available from Glen Raven Custom Fabrics, LLC of Glen Raven, N.C., or any other suitable material or combination of materials, as desired.

In some cases, the flexible cover 1302 may have a first pocket or lumen 1362 for receiving the rear cross-support member 1340, and a second pocket or lumen 1364 for receiving the front cross-support member 1350, but this is not required. The pockets 1362 and 1364 may be sufficiently wide to allow the rear cross-support member 1340 and the front cross-support member 1350 to slide relative to the flexible cover 1302 when moving between the various articulated positions of the cover assembly 1308.

It is contemplated that a user of the boat may articulate the cover assembly 1308 to whatever positions is desired. For example, the user may move the cover assembly 1308 between, for example, a raised covering position shown in FIG. 48A to a lowered covering position as shown in FIG. 48C. The user may also move the cover assembly 1308 between, for example, a raised covering position shown in FIG. 48A to a raised retracted position as shown in FIG. 48B. The user may also move the cover assembly 1308 between, for example, the raised retracted position shown in FIG. 48B to a lowered retracted position (not explicitly shown, but similar to that described above with respect to FIG. 34). More generally, a user may articulate the cover assembly 1308 to whatever positions is desired.

When in the raised covering position as shown in FIG. 48A, the bias member 1370 may provide a force to the flexible cover tension member 1360 that pulls the flexible cover 1302 taut, creating a tension in the flexible cover 1302. Biasing elements 1044 may bias the rear cross-support member 1340 and the front cross-support member 1350 in an upward direction to provide a force against the flexible cover 1302. When so provided, the rear cross-support member 1340 and the front cross-support member 1350 may provide support to intermediate positions of the flexible cover.

When the cover assembly 1308 is moved to the lowered covering position as shown in FIG. 48C, the effective length of the flexible cover 1302 may increase by pulling the flexible cover tension member 1360 in a counter clockwise direction against the force of the bias member 1370. The tension in the flexible cover 1302 created by the flexible cover tension member 1360 may push the rear cross-support member 1340 down, against its bias member 1044, and rotate the rear cross-support member 1340 in a clockwise direction. When this occurs, the rear cross-support member 1340 may slide in a forward direction relative to the flexible cover 1302. In some cases, a protective or slippery material may be used on the inside surface of the flexible cover 1302 along the expected range of motion of the rear cross-support member 1340, but this is not required. Likewise, the tension in the flexible cover 1302 may push the front cross-support member 1350 down, against its bias member 1044, and rotate the front cross-support member 1350 in a counter-clockwise direction. When this occurs, the front cross-support member 1350 may slide in a rearward direction relative to the flexible cover 1302. In some cases, a protective or slippery material may be used on the inside surface of the flexible cover along the expected range of motion of the front cross-support member 1350, but this is not required. While not required, the bends 1342 and 1352 in the rear and front cross-members 1340 and 1350 may help provide additional support to the flexible cover 1302 when the cover assembly 1308 is in the lowered covering position (see FIG. 48C).

When moving the cover assembly 1308 between the raised covering position (e.g. FIG. 48A) and the raised retracted position (e.g. FIG. 48B), the second support member 1314 may be rotated toward the first support member 1312, or visa-versa. In some cases, the rear cross-support member 1340 may be rotated counter-clockwise toward the first support member 1312, and the front cross-support member 1350 may be rotated clockwise toward the second support member 1314 to provide a compact retracted configuration. As the second support member 1314 is rotated toward the first support member 1312, the tension in the flexible cover 1302 is released. The flexible cover 1302 may collapse and be bunched up with the cover assembly 1302 as shown schematically in FIG. 48B, and in some cases, a boot (not explicitly shown) may be provided over at least part of the cover assembly 1302 to provide a clean look. The cover assembly 1302 may be held in the raised retracted position by support members 1380 (see, for example, FIG. 49A), if desired.

Figure 49A:
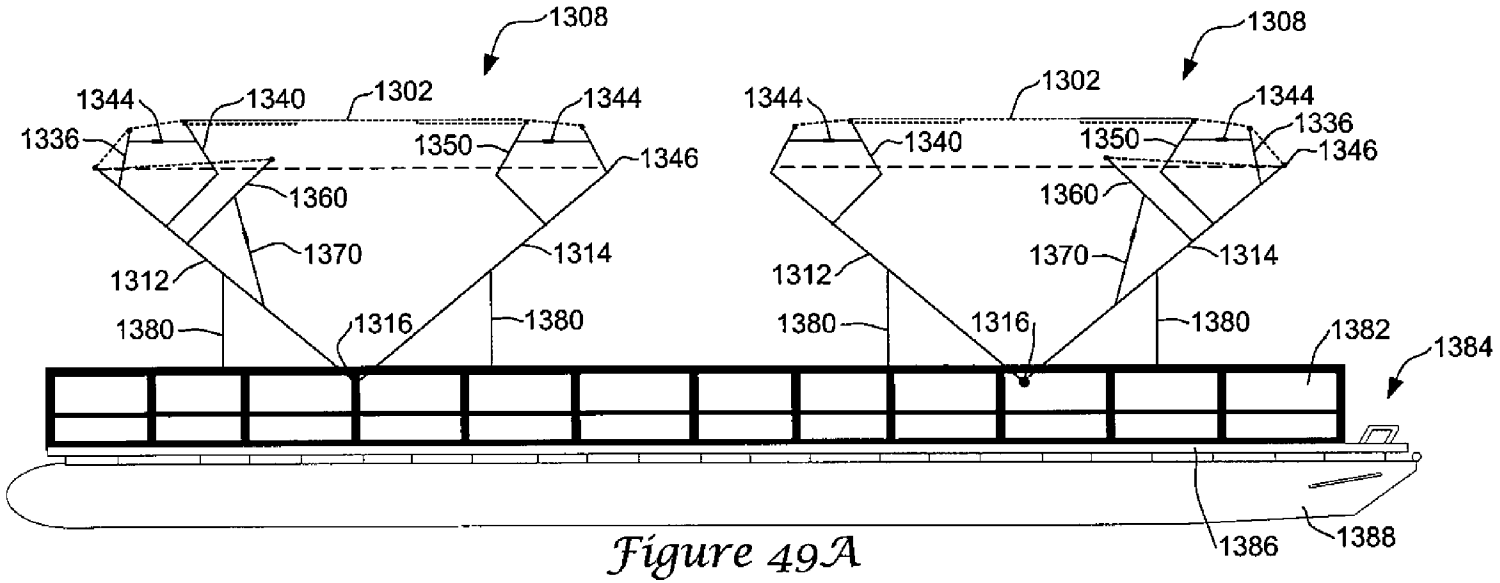
FIGS. 49A-49B are schematic side views of the illustrative cover system of FIGS. 48A-48C installed on a boat, with the illustrative cover system in a raised covering position and a lowered covering position, respectively.

To move the cover assembly 1308 from the raised retracted position (e.g. FIG. 49B) to the lowered retracted position (not explicitly shown), the support members 1380 may be released or removed, and the first support member 1312 and the second support member 1314 may be rotated together until the collective assembly is near or against sidewalls of a boat (see, for example, sidewalls 1382 and boat 1384 in FIG. 49A).

In the illustrative embodiment, the "effective" length of the flexible cover 1302 may change to accommodate the changing lengthwise dimension of the cover assembly 1308 as the cover assembly 1308 is moved between a raised covering position (see FIG. 48A) and a lowered covering position (see FIG. 48B). The "effective" length of the flexible cover 1302 may be the length of the flexible cover 1302 that extends between the first support member 1312 and the second support member 1314, but may not include the length of flexible cover that extends between the first support member 1312 and the flexible cover tension member 1360. In some cases, the first support member 1312 and the second support member 1314 may not be telescoping, but rather may be rigid members. As such, the lengthwise dimension of the cover assembly 1308 may increase when the cover assembly is moved from the raised covering position (see FIG. 48A) to the lowered covering position (see FIG. 48C). In other cases, the first support member 1312 and/or the second support member 1314 may be telescoping or otherwise adapted to change length, depending on the position of the cover assembly 1308. When so provided, the lengthwise dimension of the cover assembly 1308 may stay the same (or increase) when the cover assembly is moved from the raised covering position (see FIG. 48A) to the lowered covering position (see FIG. 48C), with any increase in the lengthwise dimension accommodated by the increased "effective" length of the flexible cover 1302.

Figure 49B:
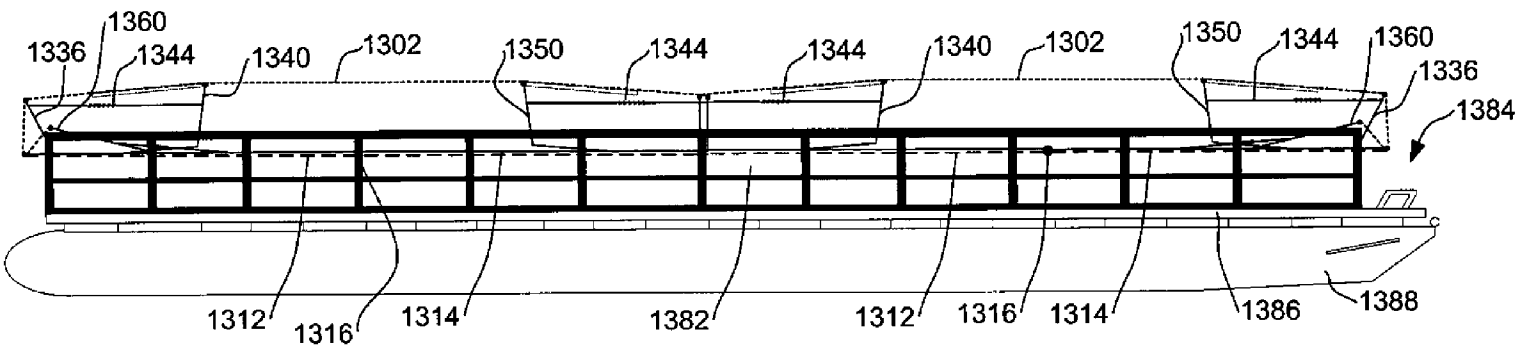

FIGS. 49A-49B are schematic side views of the illustrative cover assembly 1308 of FIGS. 48A-48C installed on a boat 1384, with the illustrative cover system in a raised covering position and a lowered covering position, respectively. In the illustrative embodiment, a rear cover assembly, similar to the cover assembly 1308, is secured to a rear part of the boat 1384, and a front cover assembly, also similar to the cover assembly 1308, is secured to a front part of the boat 1384. The rear cover assembly is shown secured to the boat 1384 in the same orientation as that shown and described with respect to FIGS. 48A-48C. The front cover assembly is shown secured to the boat 1384 in the reverse orientation to that shown and described with respect to FIGS. 48A-48C. It is contemplated that the boat 1384 may be any type of boat. However, in FIGS. 49A-49B, the boat 1384 is shown as a pontoon boat with sidewalls 1382 extending up from a platform 1386 defining a protected area. The tubular pontoon floats 1388 of the pontoon boat 1384 are shown supporting the platform 1386.

In the illustrative embodiment, both or either of the rear cover assembly and the front cover assembly may be configured to articulate between various positions. For example, both or either of the rear cover assembly and the front cover assembly may be configured to articulate between, for example, a raised covering position, a raised retracted position, a lowered retracted position and/or a lowered covering position. FIG. 49A shows both the rear cover assembly and the front cover assembly in their raised covering positions, and FIG. 49B shows both the rear cover assembly and the front cover assembly in their lowered covering positions. These are only illustrative positions, and it is contemplated that more or less articulated positions may be provided, as desired. In some cases, the rear cover assembly and the front cover assembly may be configured to articulate independent of one another, but this is not required in all embodiments. Also, while two cover assemblies are shown (e.g. a rear and front cover assembly), it is contemplated that more or less that two cover assemblies may be used, depending on the application.

During use, and in the illustrative embodiment of FIG. 49A, it is contemplated that the rear cover assembly and/or the front cover assembly may be articulated to whatever positions is desired. For example, when the boat is not in use, a user may articulate the rear cover assembly and the front cover assembly to their lowered covering positions, as shown in FIG. 49B. This may provide a mooring cover for a protected area of the boat 1384. In another example, when the boat is in use, and maximum shade or rain protection is desired, the user may articulate the rear cover assembly and the front cover assembly to their raised covering positions, as shown in FIG. 49A. In yet another example, when the boat is in use, and when maximum sun is desired, the user may articulate the rear cover assembly and/or the front cover assembly to their raised retracted positions (see FIG. 48B). In another example, when the boat is in use, and when sun is desired in the back portion of the boat 1384 and shade is desired in the front of the boat 1384, the user may articulate the rear cover assembly to the raised retracted position (see FIG. 48B) and the front cover assembly to the raised covering position (see, FIG. 48A). These configurations are only illustrative, and it is contemplated that other combinations of these and other positions may be provided, as desired.

In some cases, the rear and/or front cover assemblies may be moved between the various articulated positions under human power. A crank, a wench, or simply pushing and/or pulling the cover assemblies, and/or any other suitable human powered moving mechanism or method may be employed. In other cases, the rear and/or front cover assemblies may be moved between the various positions using a powered system, such as a motor or pump. When a motor or pump is used, and in some illustrative embodiments, motion and/or energy from the motor or pump may be transferred to move the cover assemblies to a desired position. Any number of methods may be used to transfer the motion and/or energy from the motor or pump to the cover assemblies including, for example, one or more belts, cables, screw drives, shafts, tracks, hydraulic cylinders, hydraulic tubes, pulleys, gears, and/or any other suitable system or method, as desired.

In some cases, the width and/or height dimension of the front cover assembly may be different from the width and/or height dimension of the rear cover assembly. This may allow the front of the rear cover assembly to overlap with the rear of the front cover assembly when both are in their lowered covering positions (see FIG. 49B), if desired. In some cases, it may be desirable to have the front of the rear cover assembly extend over the rear of the front cover assembly (e.g. when it is desirable to raise the rear cover assembly first), and in other cases, it may be desirable to have the rear of the front cover assembly extend over the front of the rear cover assembly (e.g. when it is desirable to raise the front cover assembly first). However, in some embodiments, the front cover assembly and the rear cover assembly may not overlap at all, but rather may abut one another or may be spaced from another when in their lowered covering positions, if desired.

Figure 50:
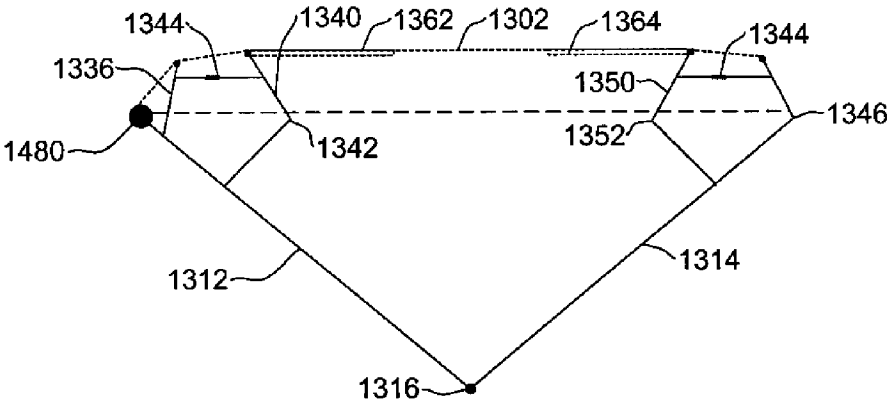
FIG. 50 is a schematic side view of another illustrative cover system for a boat in a raised covering position.

FIG. 50 is a schematic side view of another illustrative cover system for a boat in a raised covering position. This illustrative embodiment is similar to that shown and described with reference to FIGS. 48A-49B. However, rather than providing a flexible cover tension member 1360 and bias member 1370 as in FIGS. 48A-49B to provide tension to the flexible cover 1302 and allow the effective length of the flexible cover to change, the embodiment shown in FIG. 50 includes a biased roller element 1480 (such as a spring roller). In the illustrative embodiment, one end (e.g. rear end) of the flexible cover 1302 is connected to a roller element 1480 and rolled up around the roller element 1480. The roller element 1480 may be biased to rotate in a wind-up direction, so that the roller element 1480 imparts a tension to the flexible cover 1302 in both the raised covering position and the lowered covering position.

When the cover assembly is moved from the raised covering position shown in FIG. 50 to a lowered covering position (not explicitly shown), the bias of the roller element 1480 may be overcome, and the roller element 1480 may un-roll and release some of the flexible cover 1302 in order to increase the "effective" length of the flexible cover 1302. The "effective" length of the flexible cover 1302 may be the length of the flexible cover 1302 that extends between the first support member 1312 and the second support member 1314. This dimension may increase as the cover assembly is moved from the raised covering position of FIG. 50 to a lowered covering position in some embodiments. When the cover assembly of FIG. 50 is moved from the lowered covering position to the raised covering position, the dimension between the first support member 1312 and the second support member 1314 may decrease, and the bias of the roller element 1480 may cause the roller element 1480 to roll up some of the flexible cover to decrease the "effective" length of the flexible cover 1302.

Figure 51:
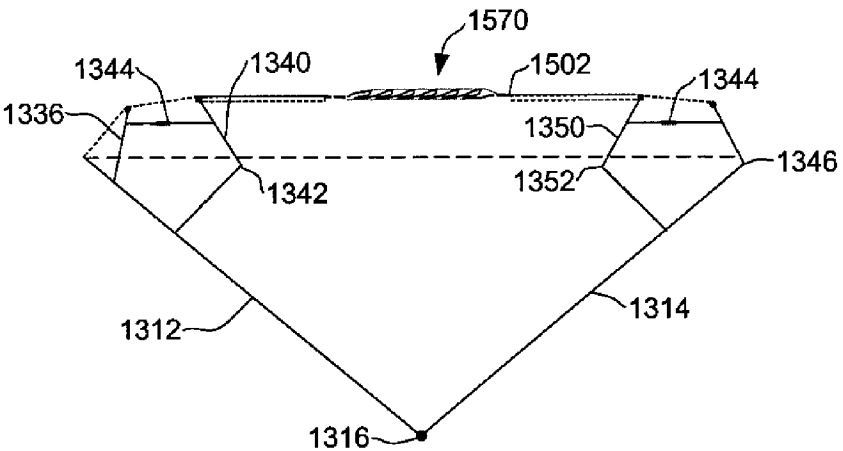
FIG. 51 is a schematic side view of another illustrative cover system for a boat in a raised covering position.

FIG. 51 is a schematic side view of another illustrative cover system for a boat in a raised covering position. This illustrative embodiment is similar to that shown and described with reference to FIGS. 48A-49B. However, rather than providing a flexible cover tension member 1360 and bias member 1370 as in FIGS. 48A-49B to provide tension to the flexible cover 1302 and allow the effective length of the flexible cover to change, the embodiment shown in FIG. 51 includes an expandable flexible cover section 1570 in the flexible cover 1502. In the illustrative embodiment, one end of the flexible cover 1502 is coupled to the first support member 1312, and the other end of the flexible cover 1502 is coupled to the second support member 1314. In the illustrative embodiment, an intermediate section 1570 is provided between the first support member 1312 and the second support member 1314. The intermediate section 1570 of the flexible cover 1502 may be expandable from a contracted state to an expanded state. The intermediate section 1570 may be biased toward the contracted state to impart a tension to the flexible cover 1502 in both the raised covering position and the lowered covering position. It is contemplated that the intermediate section 1570 may include any suitable mechanism for allowing the intermediate section 1570 to be expandable from a contracted state to an expanded state, and visa-versa.

In one illustrative embodiment, the intermediate section 1570 of the flexible cover 1502 may include a sheet or one or more strips of an elastic material (e.g. rubber or the like) that are stretched and then attached to the underside of the flexible cover 1502. Once the elastic material is released, that portion of the flexible cover 1502 that was attached to the elastic material may tend to bunch up and pull the flexible cover 1502 to a contracted position. In another illustrative embodiment, several alternating folds may be provided in the flexible cover 1502 along a direction that is transverse to the direction of desired expandability. A top sheet or one or more top strips of an elastic material (e.g. rubber or the like) may be attached to the folds on the top side of the flexible cover 1502, and a bottom sheet or one or more bottom strips of an elastic material (e.g. rubber or the like) may be attached to the folds on the bottom side of the flexible cover 1502. The top sheet or one or more top strips of elastic material may be configured to pull the top folds in one direction (e.g. toward the rear), and the bottom sheet or one or more bottom strips of elastic material may be configured to pull the bottom folds in the opposite direction (e.g. toward the front). These are only illustrative, and it is contemplated that any suitable expandable intermediate section 1570 may be provided.

When the cover assembly is moved from the raised covering position shown in FIG. 51 to a lowered covering position (not shown), the expandable intermediate section 1570 of the flexible cover 1502 may move from a contracted position to an expanded position, thereby increasing the "effective" length of the flexible cover 1502. The "effective" length of the flexible cover 1502 may be the length of the flexible cover 1502 that extends between the first support member 1312 and the second support member 1314. This dimension may increase as the cover assembly is moved from the raised covering position of FIG. 51 to a lowered covering position. When the cover assembly is moved from the lowered covering position to the raised covering position, the dimension between the first support member 1312 and the second support member 1314 may decrease, and the expandable intermediate section 1570 of the flexible cover 1502 may move from an expanded position to a contracted position, thereby decreasing the "effective" length of the flexible cover 1502.

Figure 52:
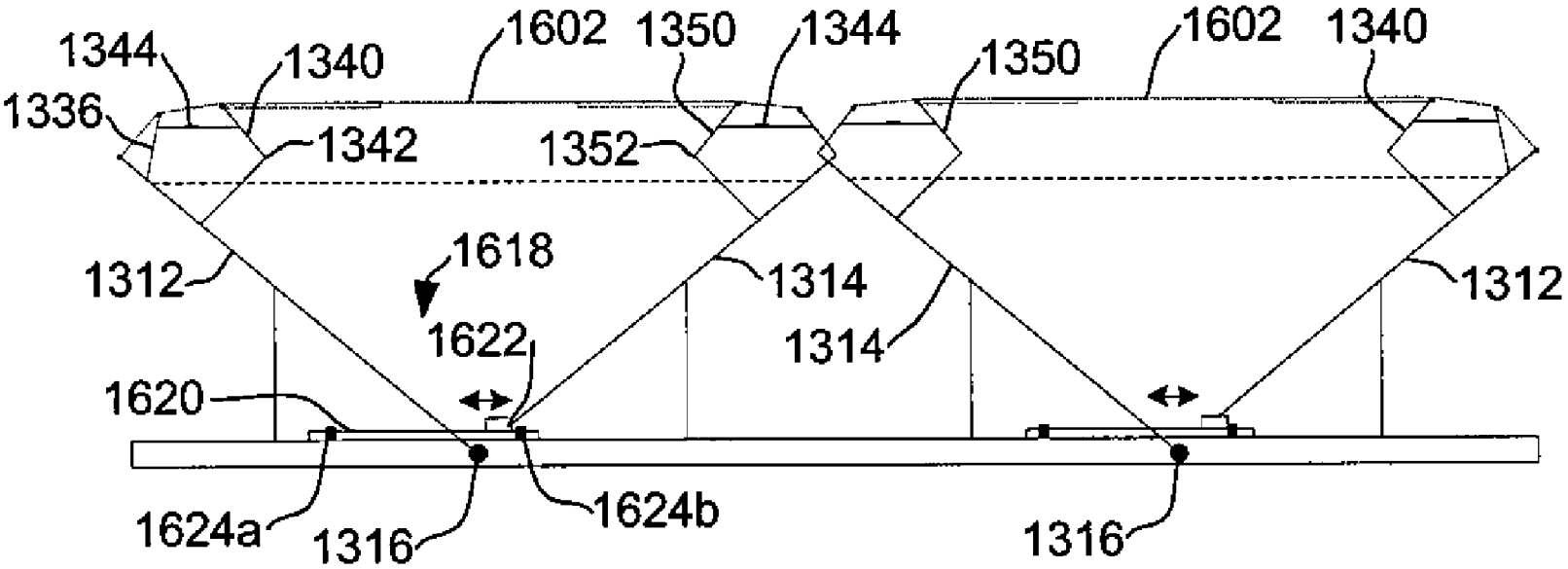
FIG. 52 is a schematic side view of another illustrative cover system, with the illustrative cover system in a raised covering position on a boat.

FIG. 52 is a schematic side view of another illustrative cover system, with the illustrative cover system in a raised covering position on a boat. The illustrative cover system includes a rear cover assembly and a front cover assembly mounted to a boat. Only part of the boat is shown in FIG. 52. This illustrative embodiment is similar to that shown and described with reference to FIGS. 48A-49B. However, rather than providing a flexible cover tension member 1360 and bias member 1370 as in FIGS. 48A-49B to provide tension to the flexible cover 1302 and allow the effective length of the flexible cover to change, a slider 1618 is provided for the rear cover assembly and the front cover assembly.

In the illustrative embodiment, one end of the flexible cover 1602 is coupled to the first support member 1312, and the other end of the flexible cover 1602 is coupled to the second support member 1314. The lower end of the first cover support 1312 of the rear cover assembly is coupled to a rotatable coupling 1316, and the lower end of the second cover support 1314 is rotatably coupled to a slider 1618. The slider 1618 includes a track 1620 and a cart 1622, where the cart 1622 is slidable along the track 1620. The lower end of the second cover support 1314 of the rear cover assembly is coupled to the cart 1622. End stops 1624*a* and 1624*b* may be provided to limit the range of motion of the cart 1622 along the track 1620, but this is not required.

In some cases, and with respect to the rear cover assembly, the cart 1622 may be biased to the right in FIG. 52. The cart 1622 may be biased using, for example, one or more springs, rubber straps, gas springs, compressed cylinders, or any other suitable bias providing element(s). Because the cart 1622 is rotatably coupled to the lower end of the second cover support 1314 of the rear cover assembly, the bias of the cart 1622 will tend to bias the second cover support 1314 in the rightward direction in FIG. 52.

When the rear cover assembly is moved from the raised covering position as shown in FIG. 52 to a lowered covering position, the bias of the cart 1622 may be overcome, and the cart 1622 may slide in a leftward direction in FIG. 52 along the track 1620. When the rear cover assembly is moved from the lowered covering position to the raised covering position, the bias of the cart 1622 may slide the cart 1622 in a rightward direction in FIG. 52 along the track 1620. In some cases, this may allow the flexible cover 1602 to remain substantially the same length in both the raised covering position and the lowered covering position. The front cover assembly shown in FIG. 52 may operate in a similar manner to the rear cover assembly.

Figure 53:
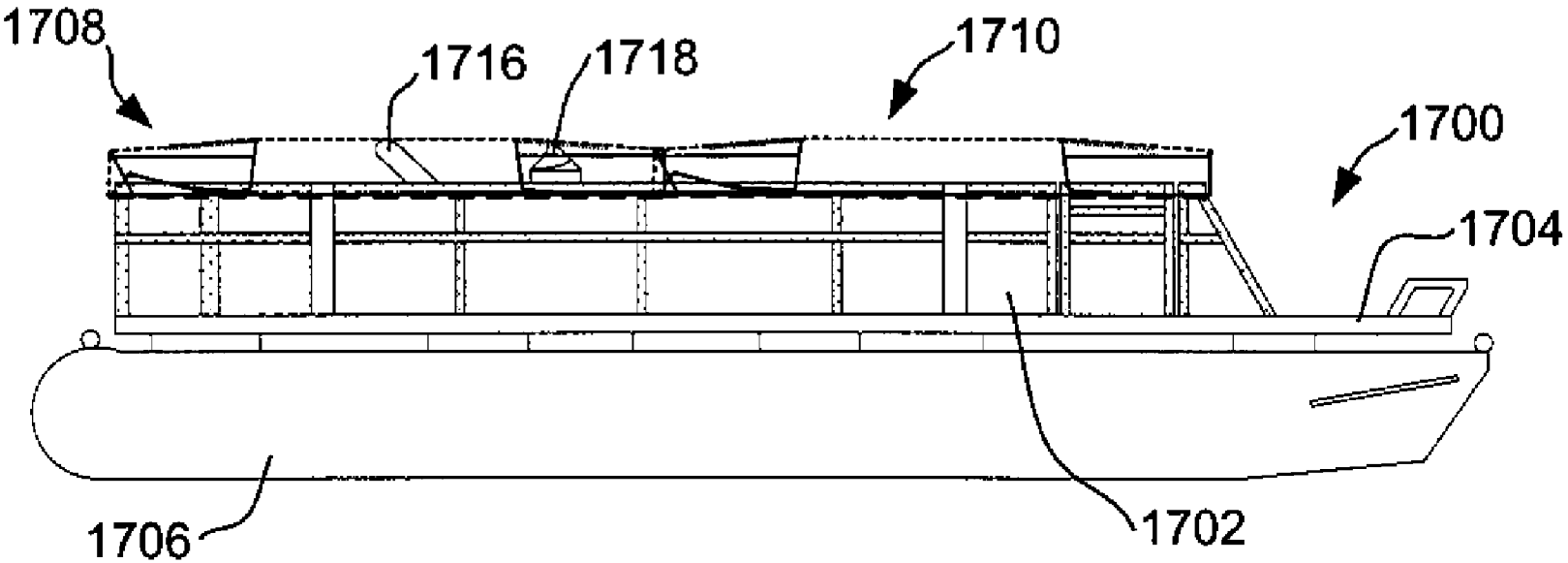
FIG. 53 is a schematic side view of an illustrative cover system installed on a boat, with one or more upwardly extending objects extending above the sidewalls of the boat.

FIG. 53 is a schematic side view of an illustrative cover system installed on a boat 1700, with one or more upwardly extending objects extending above the sidewalls of the boat 1700. It is contemplated that the boat 1700 may be any type of boat. However, in FIG. 53, the boat 1700 is shown as a pontoon boat with sidewalls 1702 extending up from a platform 1704 defining a protected area. Tubular pontoon floats 1706 of the pontoon boat 1700 are shown supporting the platform 1704. FIG. 53 shows that in some cases, a boat 1700 may have one or more objects that extend above the sidewalls 1702 of the boat 1700. For example, in FIG. 53, both a seat 1716 and a console 1718 extend up above the side walls 1702 of the boat 1700.

It is contemplated that the cover system shown in FIG. 53 may be any type of cover system that can be moved between, for example, a lowered covering position and another position such as a raised covering position. For example, the cover system shown in FIG. 53 may represent any of the various illustrative cover systems disclosed herein.

In some embodiments, and in the lowered covering position, the cover system may extend out to at least the side walls 1702 of the boat, and in some cases, may extend over and vertically overlap the top of the side walls 1702 of the boat, and around the perimeter of at least part of a protected area of the boat 1700. As noted above, this may help protect the interior of the boat from the elements when the boat is not in use.

To help accommodate the objects 1716 and 1718 that extend up above the sidewalls 1702 of the boat 1700, it is contemplated that the cover system may be configured to have a depth that is sufficient to accommodate the objects 1716 and 1718 while still having the lower end of the cover system extend down to, and in some cases, vertically overlap the top of the side walls 1702 of the boat 1700, as shown in FIG. 53.

In some cases, some of the objects 1716 and 1718 may be configured to move down or otherwise reduce the distance that they extend up above the side walls 1702 when the boat 1700 is not in use. For example, the seat 1716 may include a recline feature, which may allow the back of the seat 1716 to recline back and reduce the distance that the seat 1716 extends above the side walls 1702. Alternatively, or in addition, the seat 1716 may have a back section that can be selectively folded down, if desired. Likewise, it is contemplated that the console 1718 may be configured to have the ability to move down or otherwise reduce the distance that the console 1718 extends up above the side walls 1702 when the boat 1700 is not in use.

Figure 54A:
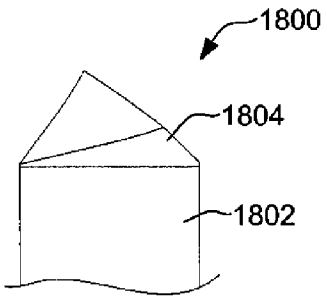
FIGS. 54A-54C are schematic side views of an illustrative console of a boat, with the console in an extended position, an intermediate position and a retracted position, respectively.
Figure 54B:
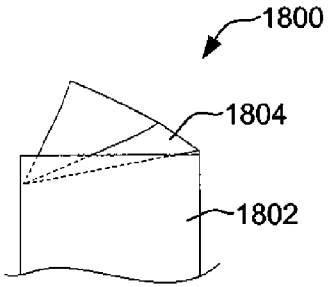
Figure 54C:
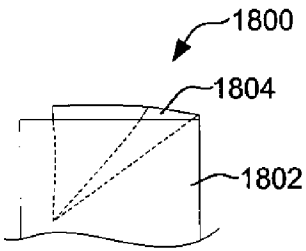

One illustrative console, labeled 1800, is shown in FIGS. 54A-54C. As can be seen in FIG. 54A, console 1800 may include a lower section 1802 and an upper section 1804. In the illustrative embodiment, the upper section 1804 of the console 1800 may be folded down or otherwise retracted into or over the lower section 1802. FIG. 54A shows the upper section 1804 in an extended position relative to the lower section 1802. It is contemplated that the console 1800 may be in the extended position while the boat is in use and underway. FIG. 54B shows the upper section 1804 partially folded down into/over the lower section 1802, and FIG. 54C shows the upper section 1804 fully folded down into/over the lower section 1802. Providing a boat with such a console may reduce the distance that the console 1800 extends up above the side walls 1702 of the boat 1700 when the boat 1700 is not in use.

Figure 55A:
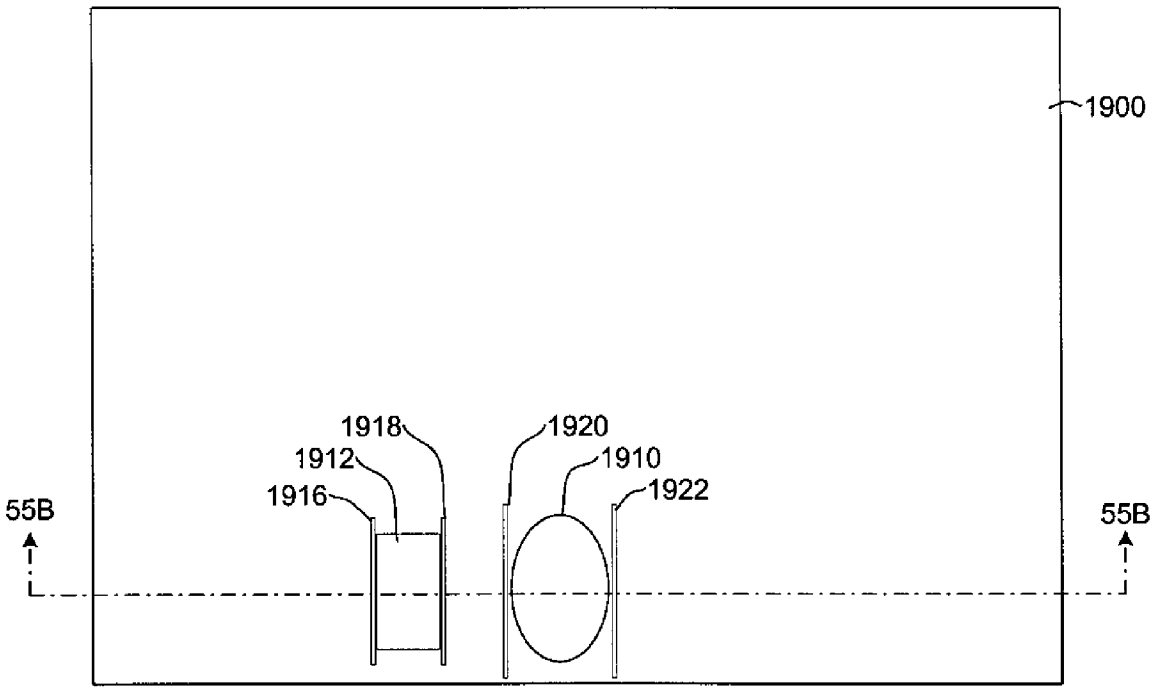
FIG. 55A is a schematic top view of an illustrative flexible cover with relief regions formed therein.

In some embodiments, it may be desirable to provide one or more relief regions in the cover assembly to help accommodate the objects 1716 and 1718 that extend, for example, above the sidewalls of a boat. FIG. 55A is a schematic top view of an illustrative flexible cover with relief regions formed therein. A top view of a flexible cover of an illustrative cover assembly is generally shown at 1900 in FIG. 55A. One or more relief regions, such as relief regions 1910 and 1912 are shown in the flexible cover. In the illustrative embodiment, relief region 1910 is sized and otherwise configured to accommodate console 1718 that extends above the side walls of a boat, and relief region 1912 is sized and configured to accommodate seat 1716 (see, for example, FIG. 53).

Figure 55B:
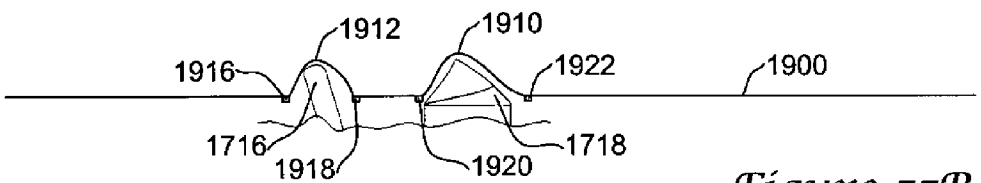
FIG. 55B is a schematic cross-sectional side view of the illustrative flexible cover of FIG. 55A taken along line 55B-55B.

FIG. 55B is a schematic cross-sectional side view of the illustrative flexible cover of FIG. 55A taken along line 55B-55B. As can be seen, relief region 1910 forms a recess in the flexible cover 1900 that is sufficiently sized in both a lateral and depth dimension to accommodate the console 1718 when the cover system is in the lowered covering position (e.g. extends down to, and in some cases, vertically overlaps the top of the side walls 1702 of the boat 1700). Likewise, relief region 1912 forms a recess in the flexible cover 1900 that is sufficiently sized in both a lateral and depth dimension to accommodate the seat 1716 when the cover system is in the lowered covering position (e.g. extends down to, and in some cases, vertically overlaps the top of the side walls 1702 of the boat 1700).

It is contemplated that the relief regions 1910 and 1912 may be formed in any suitable way using any suitable material or material combination. For example, and in some cases, the relief regions 1910 and 1912 may be formed by a flexible material, such as the same flexible material used for the flexible cover 1900. In other cases, the relief regions 1910 and 1912 may be formed using a rigid material, such as a plastic or other material. In yet other cases, the relief regions 1910 and 1912 may be formed by both a flexible material and a rigid material. For example, the relief regions 1910 and 1912 may be formed by a rigid material that is covered on the top side by a flexible material.

In some cases, one or more support members 1916, 1918, 1920, and/or 922 may be provided. The support members 1916, 1918, 1920, and/or 922 may be, for example, relatively thin slats (e.g. 1.4"×1" in cross-section) that are attached to the flexible cover 1900 on either or both sides of the relief regions 1910 and/or 1912. The support members 1916, 1918, 1920, and/or 922 may help transfer tension in the flexible cover 1900 around the relief regions 1910 and/or 1912, when desired. In some cases, the support members 1916, 1918, 1920, and/or 922 may slide into pockets formed in the flexible cover 1900, or may be attached in any other suitable manner.

Figure 56:
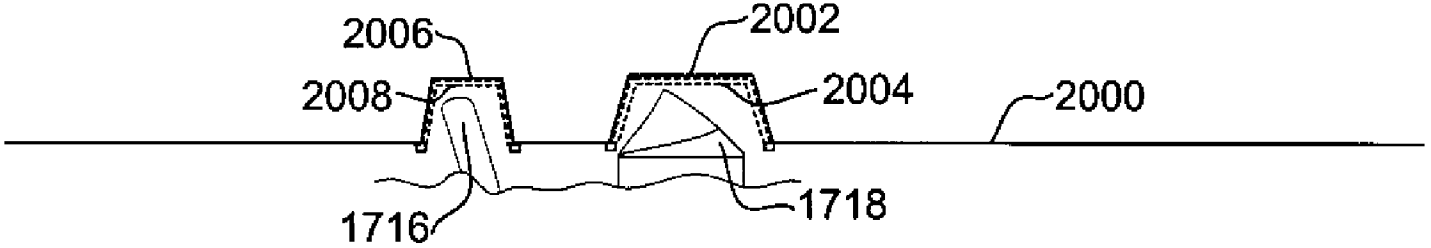
FIG. 56 is a schematic cross-sectional side view of another illustrative flexible cover with relief regions.

FIG. 56 is a schematic cross-sectional side view of another illustrative flexible cover 2000 with relief regions 2002 and 2006 formed therein. Like above, the relief regions 2002 and 2006 may be sized and otherwise configured to accommodate a console 1718 and a seat 1716 (and/or any other desired object) that extend above the side walls of a boat. In FIG. 56, relief region 2002 is formed by a flexible material, such as the same flexible material used for the flexible cover 2000. In the illustrative embodiment, a support layer 2004 may be provided along at least part of the inside (and/or outside) surface of the relief region 2002. The support layer 2004 may be any suitable support layer. For example, the support layer 2004 may be a foam support layer that is secured relative to the flexible cover 2000. The foam support layer 2004 may have side walls and/or a top wall, and in some cases, may provide sufficient support to maintain the shape of the relief region 2002 when the boat is underway.

In some cases, the foam support layer 2004 may include one or more rigid or semi-rigid support members on the surface or inside the foam support layer 2004. The rigid or semi-rigid support members may include, for example, one or more rods or slats that extend inside of the foam layer in a direction that corresponds to the width of the boat (e.g. into the page of FIG. 56), so that when desired, the foam support layer 2004 may collapse into a compact form when the cover assembly is moved to a raised and/or lowered retracted position. That is, when the cover assembly that carriers the flexible cover 2000 is moved to a raised and/or lowered retracted position, the foam support layer 2004 (and any support rods or slats, if present) may be relatively easy to collapse with the remainder of the flexible cover 2000, yet the flexible cover 2000 and foam support layer 2004 may return to the desired shape when the cover assembly returns to a raised and/or lowered covering position. The one or more rods or slats may be made from carbon fiber, aluminum, plastic, or any other suitable material, as desired.

In another example, the support layer 2004 may be a plastic or some other more rigid support layer. In some cases, a relatively thin and lightweight plastic support layer may be formed in the appropriate shape and secured to the flexible cover 2000 and/or relief region 2002. Like above, it is contemplated that the plastic support layer 2004 may be secured to the flexible cover 2000 and/or relief region 2002 using any suitable method such as sewing, an adhesive, hook and loop fasteners (e.g. Velcro™), etc.

Relief region 2006 may also be formed by a flexible material, such as the same flexible material used for the flexible cover 2000. In some cases, a support layer 2008 may be provided along at least part of the inside (or outside) surface of the relief region 2006. Relief region 2006 may be constructed similar to that described above with respect to relief region 2002. As discussed above with respect to FIGS. 55A-55B, one or more support members (e.g. slats) may be provided adjacent to the relief regions 2002 and 2006, if desired.

Figure 57:
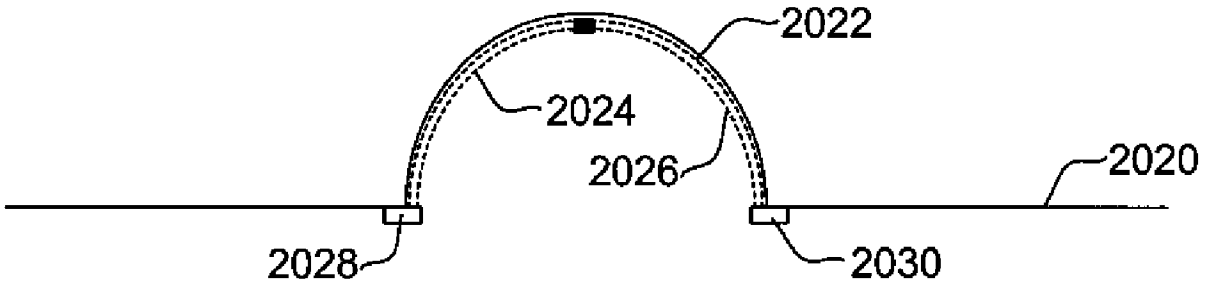
FIG. 57 is a schematic cross-sectional side view of another illustrative flexible cover with a relief region.

FIG. 57 is a schematic cross-sectional side view of another illustrative flexible cover 2020 with a relief region 2022. Like above, the relief region 2022 may be sized and otherwise configured to accommodate an object that extend above the side walls of a boat. In FIG. 57, relief region 2022 is formed by a flexible material, such as the same flexible material used for the flexible cover 2020. One or more support members may be provided inside (or outside) of the relief region to provide support to the relief region 2022, if desired. The one or more supports may include any sort of support including, for example, one or more flexible or rigid bars that extend around at least part of the relief region 2022. In one example, the one or more supports may include one or more flexible poles 2024 and 2026, similar to the carbon fiber or other poles that are commonly used to support portable tents. Such poles may be secured relative to the relief region 2022 by anchors 2028 and 2030, and may extend up into the relief region 2022. The anchors 2028 and 2030 may include pockets sewn into the flexible cover 2020 and/or relief region 2022, or any other suitable anchor, as desired. The poles may be bent as shown when installed to impart a tension to the flexible material of the relief region 2022. In another example, the one or more supports may include slats that extend within pockets or are otherwise attached to the relief region 2022. These are only illustrative supports.

Figure 58A:
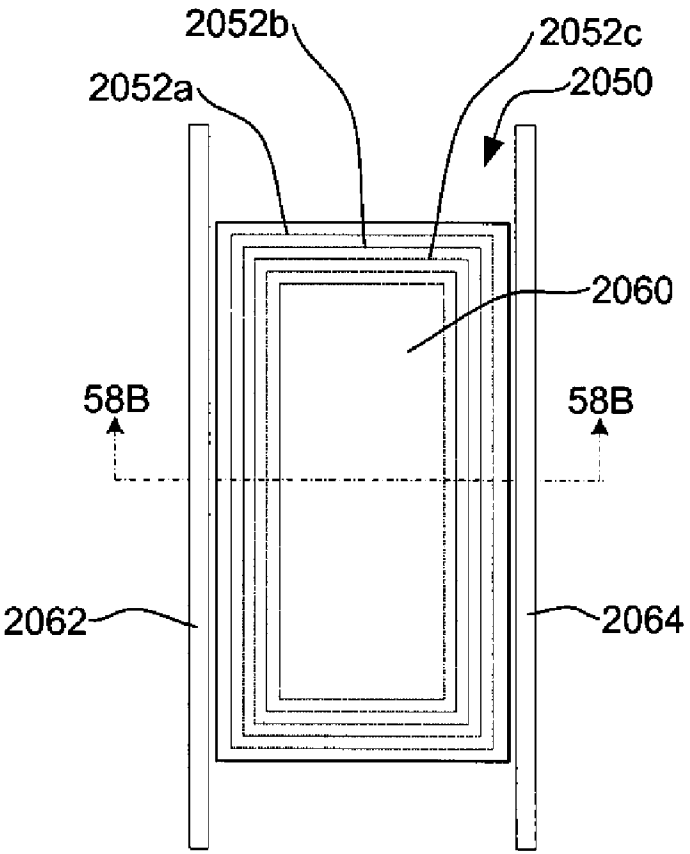
FIG. 58A is a schematic top view of an illustrative cover with an expandable relief region.

FIG. 58A is a schematic top view of an illustrative flexible cover with an expandable relief region 2050. In FIG. 58A, the relief region 2050 may be expandable from a contracted state to an expanded state when the relief region 2050 is engaged by an object that extends above the sidewalls 1702 of the boat 1700. The relief region 2050 may be biased toward the contracted state and may remain relatively flat when no object is engaging and protruding into the relief region 2050, such as when the cover system is in a raised covering position. However, when the cover system is moved to the lowered covering position, and an object comes into engagement and moves into the relief region 2050, the object may push the relief region 2050 into an expanded state.

Figure 58B:
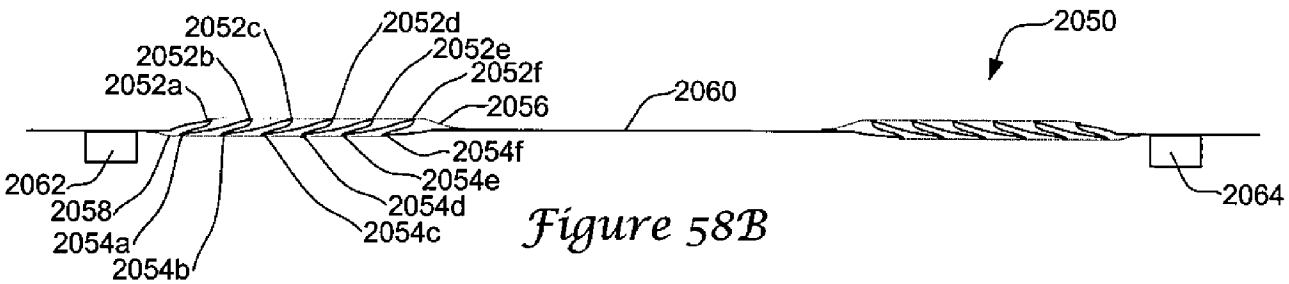
FIGS. 58B-58C are schematic cross-sectional side views of the illustrative cover of FIG. 58A, with the relief region in a non-expanded position and an expanded position, respectively.

It is contemplated that any suitable structure may be used to allow the relief region 2050 to move from a contracted to an expanded state. In the illustrative embodiment, the relief region 2050 includes several alternating folds, such as folds 2052*a*-2052*c*. As best shown in FIG. 58B, a top sheet or one or more top strips 2056 of an elastic material (e.g. rubber or the like) may be attached to the folds 2052*a*-2052*f* on the top side of the flexible cover, and a bottom sheet or one or more bottom strips 2058 of an elastic material (e.g. rubber or the like) may be attached to the folds 2054*a*-2054*f* on the bottom side of the flexible cover. The top sheet or one or more top strips 2056 of elastic material may be configured to pull the top folds 2052*a*-2052*f* in one direction (e.g. toward the right in FIG. 58B), and the bottom sheet or one or more bottom strips 2058 of elastic material may be configured to pull the bottom folds 2054*a*-2054*f* in the opposite direction (e.g. toward the left in FIG. 58B). In FIG. 58B, the relief region 2050 is biased by the elastic material 2056 and 2058 toward the contracted state and may remain relatively flat when no object is engaging and protruding into the relief region 2050, such as when the cover system is in a raised covering position.

Figure 58C:
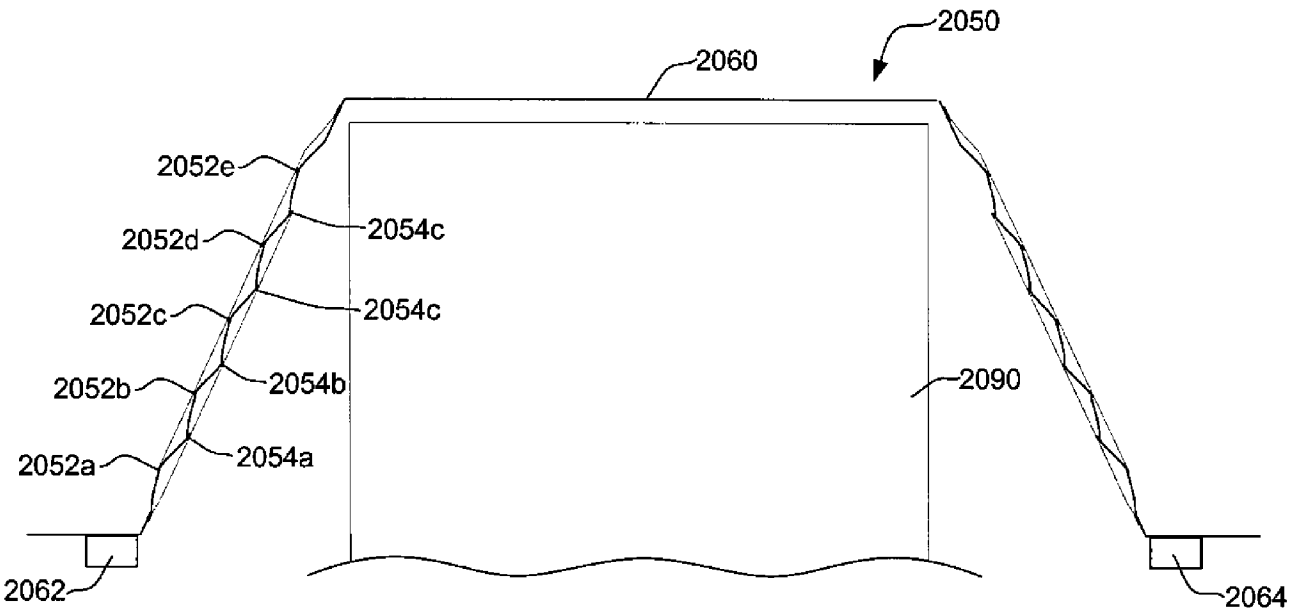

However, and as shown best in FIG. 58C, when the cover system is moved to the lowered covering position, and an object 2090 moves into the relief region 2050, the object 2090 may push and move the relief region 2050 to an expanded state. In the illustrative embodiment, the object 2090 provides an upward force to the relief region 2050, which expands the top sheet (or one or more top strips) 2056 and the bottom sheet (or one or more bottom strips) 2058, and expands the folds 2052*a*-2052*f* and 2054*a*-2054*f* to provide an expanded area to accommodate the object 2090. In some cases, one or more support members 2062 and 2064 may be provided on either, both or all sides of the relief region 2050, but this is not required. The support members 2062 and 2064 may be, for example, relatively thin slats (e.g. 1.4"×1" in cross-section) that are attached to the flexible cover.

Having thus described various illustrative embodiments of the present invention, those of skill in the art will readily appreciate that yet other embodiments may be made and used within the scope of the claims hereto attached. Changes may be made in details, particularly in matters of shape, size, and arrangement of parts without exceeding the scope of the invention. Also, it should be understood that features described with respect to one illustrative embodiment may be used in conjunction with other illustrative embodiments, and still be within the scope of the invention.

What is claimed is:

1. A cover system for a boat, the cover system comprising:

a flexible cover;

a front support configured to be rotatable coupled to the boat, the front support for supporting a front part of the flexible cover;

a rear support configured to be rotatable coupled to the boat, the rear support for supporting a rear part of the flexible cover;

the front support and the rear support each configured to be rotated to a lowered covering position, wherein in the lowered covering position, the front support and the rear support provide a tension to at least a portion of the flexible cover that extends therebetween, and the tensioned flexible cover is configured to provide a mooring cover to at least part of a protected area of the boat;

the front support and/or the rear support is/are configured to be rotated toward the other to a retracted position, wherein in the retracted position, the front support and the rear support release the tension in at least a portion of the flexible cover that extends therebetween; and wherein the front support and the rear support are each configured to be rotated to a raised covering position, wherein in the raised covering position, the front support and the rear support collectively suspend the flexible cover above the boat sufficiently far so that occupants of the boat can move about thereunder, and wherein in the raised covering position, the front support and the rear support provide a tension to at least a portion of the flexible cover that extends therebetween.

2. The cover system of claim 1 wherein:

the front support includes a first end that is configured to be rotatable coupled to the boat, and a second end;

the second support includes a first end that is configured to be rotatable coupled to the boat, and a second end; and wherein in the retracted position, the second end of the front support and a second end of the rear support are positioned adjacent one another, and the flexible cover is collapsed near the adjacent second ends of the front and rear supports.

3. The cover system of claim 2 further comprising a boot, wherein the boot is configured to be placed over the flexible cover and the adjacent second ends of the front and rear supports in the retracted position.

4. The cover system of claim 1, wherein at least one of the front support and the rear support move between a contracted shortened position and an expanded lengthened position.

5. The cover system of claim 4, wherein at least one of the front support and the rear support telescope between the contracted shortened position and the expanded lengthened position.

6. The cover system of claim 4, wherein at least one of the front support and the rear support are in the contracted shortened position when in the lowered covering position, and in the expanded lengthened position when in the raised covering position.

7. The cover system of claim 1, wherein at least one of the front support and the rear support translate horizontally relative to the boat when moved between the lowered covering position and the raised covering position.

8. The cover system of claim 1, wherein the front support is configured to rotate about a first rotation axis, and the second support is configured to rotate about a second rotation axis, wherein the first rotation axis is offset relative to the second rotation axis.

9. The cover system of claim 1, wherein the front support is configured to rotate about a first rotation axis, and the second support is configured to rotate about a second rotation axis, wherein the first rotation axis is aligned with the second rotation axis.

10. The cover system of claim 1 wherein the front support and/or the rear support are configured to articulate between a lowered retracted position and a raised retracted position.

11. A cover system for a boat, the cover system comprising:

a flexible cover;

a front support configured to be rotatable coupled to the boat, the front support for supporting a front part of the flexible cover;

a rear support configured to be rotatable coupled to the boat, the rear support for supporting a rear part of the flexible cover;

the front support and the rear support each configured to be rotated to a lowered covering position, wherein in the lowered covering position, the front support and the rear support provide a tension to at least a portion of the flexible cover that extends therebetween and the tensioned flexible cover is configured to provide a mooring cover to at least part of a protected area of the boat;

the front support and the rear support are each configured to be rotated to a raised covering position from the lowered covering position, with the front support rotating in a first direction and the rear support rotating in a second opposite direction; and wherein in the raised covering position, the front support and the rear support suspend the flexible cover above the boat sufficiently far so that occupants of the boat can move about thereunder, and wherein in the raised covering position, the front support and the rear support provide a tension to at least a portion of the flexible cover that extends therebetween.

12. The cover system of claim 11 wherein the front support and/or the rear support are configured to be rotated toward the other to a retracted position, wherein in the retracted position, the front support and the rear support release the tension in the flexible cover that was imparted by the front and rear supports in the raised covering position.

13. The cover system of claim 12 wherein the front support and/or the rear support are configured to articulate between a lowered retracted position and a raised retracted position.

14. The cover system of claim 11, wherein at least one of the front support and the rear support move between a contracted shortened position and an expanded lengthened position.

15. The cover system of claim 14, wherein at least one of the front support and the rear support telescope between the contracted shortened position and the expanded lengthened position.

16. The cover system of claim 14, wherein at least one of the front support and the rear support are in the contracted shortened position when in the lowered covering position, and in the expanded lengthened position when in the raised covering position.

17. The cover system of claim 11, wherein at least one of the front support and the rear support translate horizontally relative to the boat when moved between the lowered covering position and the raised covering position.

18. The cover system of claim 11, wherein the front support is configured to rotate about a first rotation axis, and the second support is configured to rotate about a second rotation axis, wherein the first rotation axis is offset relative to the second rotation axis.

19. The cover system of claim 11, wherein the front support is configured to rotate about a first rotation axis, and the second support is configured to rotate about a second rotation axis, wherein the first rotation axis is aligned with the second rotation axis.

20. A cover system for a boat having a length, the cover system comprising:

a flexible cover;

an articulating support structure configured to be secured to a boat for supporting the flexible cover, wherein the articulating support structure is movable to at least three separate positions including:

a lowered covering position for providing a mooring cover to at least part of a protected area of the boat, wherein in the lowered covering position, the articulating support structure imparts a tension to at least part of the flexible cover in a lengthwise direction of the boat;

a raised covering position for suspending the flexible cover above the boat sufficiently far so that occupants of the boat can move about thereunder, wherein in the raised covering position, the articulating support structure imparts a tension to at least part of the flexible cover in a lengthwise direction of the boat; and a retracted position, wherein in the retracted position, the flexible cover is collapsed adjacent to at least part of the articulating support structure.

21. The cover system of claim 20 wherein the articulating support structure is movable to at least two retracted positions including a raised retracted position and a lowered retracted position.

22. A cover system for a boat, the cover system comprising:

a flexible cover;

a front support configured to be rotatable coupled to the boat, the front support for supporting a front part of the flexible cover;

a rear support configured to be rotatable coupled to the boat, the rear support for supporting a rear part of the flexible cover;

the front support and the rear support configured to be rotated in opposite relative directions to move the flexible cover in a vertical or substantially vertical direction between a lowered covering position and a raised covering position; and wherein in the lowered covering position, the flexible cover is configured to provide a mooring cover to at least part of a protected area of the boat, and in the raised covering position, the flexible cover is suspended above the boat sufficiently far so that occupants of the boat can move about thereunder.

23. The cover system of claim 22 wherein the front support is configured to rotate about a first rotation axis adjacent the boat, and the rear support is configured to rotate about a second rotation axis adjacent the boat, wherein the first rotation axis is offset relative to the second rotation axis.

24. The cover system of claim 22 wherein the front support is configured to rotate about a first rotation axis adjacent the boat, and the rear support is configured to rotate about a second rotation axis adjacent the boat, wherein the first rotation axis is aligned with the second rotation axis.

25. The cover system of claim 22 wherein the front support is configured to rotate about a first rotation axis adjacent the boat, and the rear support is configured to rotate about a second rotation axis adjacent the boat, wherein the first rotation axis and the second rotation axis are at fixed positions relative to the boat.

26. The cover system of claim 22 wherein the front support is configured to rotate about a first rotation axis adjacent the boat, and the rear support is configured to rotate about a second rotation axis adjacent the boat, wherein at least one of the first rotation axis and the second rotation axis also translates in a lengthwise direction relative to the boat when the flexible cover is moved between a lowered covering position and a raised covering position.

27. A cover system for a boat, the cover system comprising:

a flexible cover;

a front support having a first end configured to be rotatable coupled to the boat and a second end for supporting a front part of the flexible cover;

a rear support having a first end configured to be rotatable coupled to the boat and a second end for supporting a rear part of the flexible cover;

the front support and the rear support configured to create a tension to at least a portion of the flexible cover that extends therebetween; and the front support and the rear support rotate about their first ends in opposite relative directions when moving the flexible cover between a lowered covering position and a raised covering position, and wherein the tensioned flexible cover keeps the second ends of the front support and rear support at a relatively constant spacing when moving the between the lowered covering position and the raised covering position.

28. The cover system of claim 27 wherein the front support includes a front cover support member and a front cross-support member, wherein the front cross-support member is rotatably coupled to the front cover support member and is biased toward the front cover support member.

29. The cover system of claim 28 wherein the tensioned flexible cover engages the front cross-support member in the lowered covering position and the raised covering position and works against the bias.

30. The cover system of claim 29 wherein the front cross-support member rotates in an opposite relative direction relative to the front support when moving the flexible cover between the lowered covering position and the raised covering position.

31. The cover system of claim 30 wherein the rear support includes rear cover support member and a rear cross-support member, wherein the rear cross-support member is rotatably coupled to the rear cover support member and is biased toward the rear cover support member.

32. The cover system of claim 31 wherein the tensioned flexible cover engages the rear cross-support member in the lowered covering position and the raised covering position and works against the bias.

33. The cover system of claim 32 wherein the rear cross-support member rotates in an opposite relative direction relative to the rear support when moving the flexible cover between the lowered covering position and the raised covering position.

34. The cover system of claim 27 wherein the tensioned flexible cover is configured to provide a mooring cover to at least part of a protected area of the boat when the flexible cover is in the lowered covering position.

35. The cover system of claim 34 wherein, in the raised covering position, the tensioned flexible cover is configured to be suspended above the boat sufficiently far so that occupants of the boat can move about thereunder.

* * * * *